US009141013B2

(12) United States Patent
Moriya et al.

(10) Patent No.: US 9,141,013 B2
(45) Date of Patent: Sep. 22, 2015

(54) ELECTROPHOTOGRAPHIC TONER, DEVELOPER CONTAINING THE TONER, AND IMAGE FORMING APPARATUS

(75) Inventors: Yoshihiro Moriya, Shizuoka (JP); Masahide Yamada, Shizuoka (JP); Taichi Nemoto, Shizuoka (JP); Yukiko Nakajima, Kanagawa (JP); Yoshitaka Yamauchi, Shizuoka (JP); Keiji Makabe, Shizuoka (JP); Daiki Yamashita, Kanagawa (JP); Suzuka Amemori, Shizuoka (JP); Akiyoshi Sabu, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/344,515

(22) PCT Filed: Sep. 12, 2012

(86) PCT No.: PCT/JP2012/073969

§ 371 (c)(1),
(2), (4) Date: Mar. 12, 2014

(87) PCT Pub. No.: WO2013/039255

PCT Pub. Date: Mar. 21, 2013

(65) Prior Publication Data

US 2014/0342284 A1 Nov. 20, 2014

(30) Foreign Application Priority Data

Sep. 13, 2011 (JP) ..... 2011-199343
Sep. 14, 2011 (JP) ..... 2011-200170
Jun. 26, 2012 (JP) ..... 2012-143071

(51) Int. Cl.
*G03G 9/08* (2006.01)
*G03G 9/087* (2006.01)

(52) U.S. Cl.
CPC ..... *G03G 9/08755* (2013.01); *G03G 9/0821* (2013.01); *G03G 9/08788* (2013.01); *G03G 9/08791* (2013.01); *G03G 9/08795* (2013.01); *G03G 9/08797* (2013.01)

(58) Field of Classification Search
CPC ..... G03G 9/0821; G03G 9/08755
USPC ..... 430/109.4, 111.4
See application file for complete search history.

(56) References Cited

U.S. PATENT DOCUMENTS 8,679,714 B2 3/2014 Inoue et al.
2001/0003636 A1 6/2001 Suwa et al.
2008/0227002 A1 9/2008 Moriya et al.

(Continued)

FOREIGN PATENT DOCUMENTS

EP 0640882 3/1995
EP 2 296 045 A1 3/2011

(Continued)

OTHER PUBLICATIONS

Extended European Search Report issued Jan. 22, 2015 in Patent Application No. 12831678.3.

(Continued)

*Primary Examiner* — Mark A Chapman
(74) *Attorney, Agent, or Firm* — Oblon, McClelland, Maier & Neustadt, L.L.P.

(57) ABSTRACT

An electrophotographic toner including: a binder resin, wherein the binder resin has one glass transition temperature Tg and the glass transition temperature Tg of the binder resin is within 25° C. to 65° C. as measured in second heating with a differential scanning calorimeter at a heating rate of 5° C./min, and wherein a phase image of the binder resin obtained with an atomic force microscope (AFM) of tapping mode contains first phase difference regions and a second phase difference region such that the first phase difference regions are dispersed in the second phase difference region, where the first phase difference regions correspond to greater phase difference regions and the second phase difference region corresponds to a smaller phase difference region when an intermediate value between a maximum value and a minimum value of the phase differences is used as a threshold.

12 Claims, 5 Drawing Sheets

(56) References Cited

U.S. PATENT DOCUMENTS

| | | | |
|---|---|---|---|
| 2009/0003885 | A1 | 1/2009 | Sabu et al. |
| 2010/0330489 | A1 | 12/2010 | Inoue et al. |
| 2011/0065036 | A1 | 3/2011 | Inoue et al. |
| 2011/0104608 | A1 | 5/2011 | Nakajima et al. |
| 2011/0281213 | A1 | 11/2011 | Sakashita et al. |

FOREIGN PATENT DOCUMENTS

| | | |
|---|---|---|
| JP | 59-096123 | 6/1984 |
| JP | 2909873 | 4/1999 |
| JP | 3347406 | 9/2002 |
| JP | 3785011 | 3/2006 |
| JP | 2007-025656 | 2/2007 |
| JP | 2008-262179 | 10/2008 |
| JP | 2009-109732 | 5/2009 |
| JP | 2010-070756 | 4/2010 |
| JP | 2010-204358 | 9/2010 |
| JP | 2011-013245 | 1/2011 |

OTHER PUBLICATIONS

International Search Report Issued for counterpart International Patent Application No. PCT/JP2012/073969 Filed Sep. 12, 2012.

ELECTROPHOTOGRAPHIC TONER, DEVELOPER CONTAINING THE TONER, AND IMAGE FORMING APPARATUS

TECHNICAL FIELD

The present invention relates to a toner for use in image forming apparatus using an electrostatic copying process such as copying machines, facsimiles and printers, a developer using the toner, and an image forming apparatus using the toner.

BACKGROUND ART

In electrophotographic apparatuses and electrostatic recording apparatuses, electric or magnetic latent images have been developed into images by the use of toner. For example, in an electrophotographic process, an electrostatic image or latent image is formed on a photoconductor, and then the latent image is developed by using a toner to form a toner image. Typically, the toner image is transferred onto a transfer material such as paper and then fixed by means of, for example, heating.

A toner typically includes a binder resin in an amount of 70% by mass or more. Since most of the binder resins are made from oil resources, there are concerns of depletion of the oil resources and the issue of global warming caused by discharge of a carbon dioxide gas into the air due to heavy consumption of the oil resources. If a binder resin can be synthesized from a plant which grows by utilizing carbon dioxide gas in the air, the carbon dioxide gas can be circulated. Namely, there is a possibility of preventing the global warming and the depletion of the oil resources. Therefore, polymers derived from plant resources (i.e., biomass) are receiving attention recently.

In attempting to use polymers derived from plant resources as a binder resin, a toner including polylactic acid as a binder resin is disclosed (see PTL 1). Polylactic acid is a commonly-used, easily-available polymer formed from plant resources as raw materials. It is known that polylactic acid is synthesized through dehydration condensation of lactic acid monomers or through ring-opening polymerization of cyclic lactides of lactic acids (see PTLs 2 and 3). However, when polylactic acid is directly used alone for the production of a toner, it is difficult to obtain necessary properties for a toner. This is because the concentration of an ester group is higher than that of a polyester resin, and the molecular chains bonded together via the ester bond are formed only of carbon atoms.

In one possible measure to overcome this problem, polylactic acid and a second resin different therefrom are mixed together or copolymerized to thereby ensure physical properties and thermal characteristics required for toner. For example, there has been proposed that a terpene-phenol copolymer is incorporated as a low-molecular-weight ingredient into a polylactic acid biodegradable resin for improving thermal characteristics (see PTL 4). This proposal, however, does not achieve both desired low-temperature fixing property and desired hot offset resistance at the same time, and the polylactic acid resin has not been practically used for toner. Furthermore, polylactic acid is quite poor in compatibility and dispersibility with polyester resins and/or styrene-acryl copolymers commonly used for toner. Thus, when such polylactic acid is used in combination with other resins, it is considerably difficult to control the composition of the uppermost surface responsible for important properties of toner such as storageability, chargeability and flowability.

As an example of attempting to solve the above existing problem through copolymerization, there has been reported a block copolymer resin formed between polyester resins other than polylactic acids and defined in D/L ratio of polylactic acids (see PTL 5). However, the strength of the binder resin formed from polylactic acids with this method is not necessarily high. As elucidated from studies conducted by the present inventors, the toner, the binder resin of which has low strength, causes background smear and scattering accompanied by stress applied during long-term stirring when used in the developing process.

In general, a binder resin for toner is designed to provide a toner with suitable chargeability and fixability as well as is required to have strength. When a rein having low strength is used, the produced toner is cracked or chipped by contact stress in the developing process. Toner dust formed as a result of chipping is easier to make the inside low-melting-point wax to be exposed thereon. Since such toner dust has large electrostatic or non-electrostatic attachment force onto a carrier, it remains on the carrier to cause toner filming. The carrier contaminated by toner filming decreases in ability to charge toner particles. As a result, so-called background smear occurs where toner particles are attached (printed) on blank portions. Similarly, as has been known, when the amount of charges which the toner can receive from the carrier decreases, the ability to electrostatically retain the toner on the carrier surface also decreases, so that the toner is scattered in the developing device during stirring to contaminate the developing device (i.e., toner scattering). The above-described problem similarly arises for the binder resin formed from polylactic acid. At present, satisfactory results have not yet been attained for improvement in durability of toner against stress applied during long-term stirring.

CITATION LIST

Patent Literature

PTL 1: Japanese Patent (JP-B) No. 2909873
PTL 2: JP-B No. 3347406
PTL 3: Japanese Patent Application Laid-Open (JP-A) No. 59-96123
PTL 4: JP-B No. 3785011
PTL 5: JP-A No. 2008-262179

SUMMARY OF INVENTION

Technical Problem

The present invention aims to solve the above existing problem and achieve the following object which is, specifically, to provide an electrophotographic toner which is free of unwanted sticking after long-term storage at high temperatures and of background smear, filming and toner scattering even when a resin having a polylactic acid skeleton is used as a binder resin.

Solution to Problem

The present inventors conducted extensive studies to achieve the above object. As a result, they have found that the above-described problem can be solved by using a polyester resin for toner which has been accurately controlled in thermal characteristics and phase-separation structure, and have completed the present invention.

The present invention is based on the above finding. Means for solving the problem are as follows.

An electrophotographic toner of the present invention is a toner including:

a binder resin, wherein the binder resin has one glass transition temperature Tg and the glass transition temperature Tg of the binder resin is within 25° C. to 65° C. as measured in second heating with a differential scanning calorimeter at a heating rate of 5° C./min, and wherein a binarized image of a phase image of the binder resin contains first phase difference regions each formed of first pixels and a second phase difference region formed of second pixels such that the first phase difference regions are dispersed in the second phase difference region, where the binarized image of the phase image of the binder resin is obtained through a process containing: measuring the binder resin with an atomic force microscope (AFM) of tapping mode to obtain phase differences at locations of the binder resin; converting the phase differences to image densities of pixels so that the locations having greater phase differences are lighter than the locations having smaller phase differences; mapping the locations to obtain the phase image; and subjecting the phase image to binarization using, as a threshold, an intermediate value between a maximum value and a minimum value of the image densities so that the image densities of the first pixels are equal to or more than the minimum value but less than the intermediate value and the image densities of the second pixels are equal to or more than the intermediate value but equal to or less than the maximum value.

Advantageous Effects of Invention

The present invention can provide: an electrophotographic toner which is free of unwanted sticking after long-term storage at high temperatures and of background smear, filming and toner scattering.

DESCRIPTION OF EMBODIMENTS (Toner)

First Embodiment

Figure 1:
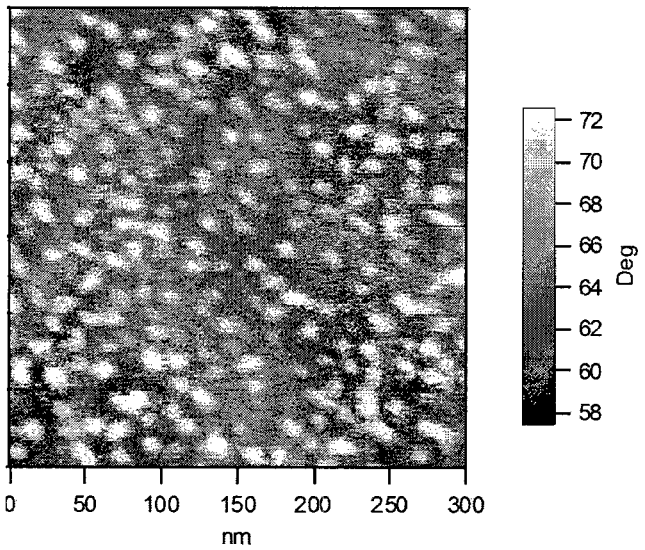
FIG. 1 is a phase image of binder resin 1 used in Example 1, which is measured with AFM of tapping mode.

A toner according to a first embodiment of the present invention contains at least a binder resin and a colorant; and, if necessary, further contains other ingredients.

<Binder Resin>

The above binder resin is a binder resin dissolvable in an organic solvent and has one glass transition temperature Tg where the glass transition temperature Tg of the binder resin is within 25° C. to 65° C. as measured in second heating with a differential scanning calorimeter at a heating rate of 5° C./min, and a binarized image of a phase image of the binder resin contains first phase difference regions each formed of first pixels and a second phase difference region formed of second pixels such that the first phase difference regions are dispersed in the second phase difference region, where the binarized image of the phase image of the binder resin is obtained through a process containing: measuring the binder resin with an atomic force microscope (AFM) of tapping mode to obtain phase differences at locations of the binder resin; converting the phase differences to image densities of pixels so that the locations having smaller phase differences are dark colored and the locations having greater phase differences are light colored; mapping the locations to obtain the phase image; and subjecting the phase image to binarization using, as a threshold, an intermediate value between a maximum value and a minimum value of the image densities so that the image densities of the first pixels are equal to or more than the minimum value but less than the intermediate value and the image densities of the second pixels are equal to or more than the intermediate value but equal to or less than the maximum value.

In the binarized image, the average of the maximum Feret diameters of the first phase difference regions is preferably 10 nm or more but less than 45 nm.

Notably, in the present invention, the description "the first phase difference regions are dispersed in the second phase difference region" in the binarized image of the phase image of the binder resin observed with AFM means that the bondaries between domains can be defined in the binarized image and the Feret diameters of the first phase difference regions can be defined in the binarized image. When the first phase difference regions in the binarized image have such small particle diameters that the first phase difference regions are difficult to judge whether they are image noise or phase difference regions, or when the Feret diameters of the regions cannot be clearly defined, it is judged that "the first phase difference regions are not dispersed in the second phase difference region." The Feret diameters of the first phase difference regions cannot be defined, when they are not discriminated from image noise and the bondaries between domains cannot be defined.

In order to improve the strength of the binder resin, it is necessary to incorporate into a resin a structure for relieving external deformation and pressure. One exemplary means for this is incorporating a more flexible structure. For example, suitable is a binder resin showing a rubber state at ambient temperature. However, in this case, the glass transition temperature of the binder resin has to be made lower than a temperature during actual use, and thus it is easy to cause blocking where toner particles fuse with each other during storage. In order to prevent blocking of toner particles in the temperature range for actual use, it is necessary to make the glass transition temperature of the binder resin equal to or higher than the temperature range for actual use. This trade-off problem has to be solved to improve both the strength and the storageability of the resin at the same time.

In the present invention, it has been found that the trade-off problem between the strength and the storageability of the resin can be overcome by making the resin have a structure containing first phase difference regions (units of low Tg) corresponding to the regions having greater phase differences, which are advantageous for relieving stress and improving the strength, and a second phase difference region (unit of high Tg) corresponding to a region having a smaller phase difference which is advantageous for improving storageability of toner, where the first phase difference regions are finely dispersed in the second phase difference region.

The above binder resin is preferably a block copolymer containing at least polyester skeleton A containing in a repeating structure a constituent unit formed through dehydration condensation of hydroxycarboxylic acid, and skeleton B not containing in a repeating structure a constituent unit formed through dehydration condensation of hydroxycarboxylic acid, since it is possible to obtain a dispersion phase which can be observed as a fine, clear image having a large phase difference.

—Polyester Skeleton a Containing in a Repeating Structure a Constituent Unit Formed Through Dehydration Condensation of Hydroxycarboxylic Acid—

The polyester skeleton A containing in a repeating structure a constituent unit formed through dehydration condensation of hydroxycarboxylic acid (hereinafter referred to as "polyester skeleton A") is not particularly limited and may be appropriately selected depending on the intended purpose, so long as it has in a repeating structure a constituent unit formed through dehydration condensation or (co)polymerization of hydroxycarboxylic acid. Examples of the polyester skeleton A include a skeleton of polyhydroxycarboxylic acid. Examples of the method for forming the polyester skeleton A include a method where hydroxycarboxylic acid is subjected directly to dehydration condensation and a method where the corresponding cyclic ester is subjected to ring-opening polymerization. Among them, more preferred is a method where the corresponding cyclic ester is subjected to ring-opening polymerization from the viewpoint of increasing the molecular weight of the polymerized polyhydroxycarboxylic acid.

The monomer constituting the polyester skeleton A is preferably an aliphatic hydroxycarboxylic acid from the viewpoint of transparency and thermal characteristics of toner, with C2-C6 hydroxycarboxylic acids such as lactic acid, glycolic acid, 3-hydroxybutyric acid and 4-hydroxybutyric acid being preferred. Lactic acid is particularly preferred since the formed binder resin shows a proper glass transition temperature and has good transparency and affinity to a colorant.

In addition to hydroxycarboxylic acid, the monomer constituting the polyester skeleton A may be a cyclic ester of hydroxycarboxylic acid. In this case, the polyester skeleton A of a resin obtained through polymerization is a skeleton of hydroxycarboxylic acid forming the cyclic ester. For example, the polyester skeleton A of a resin obtained using lactide (lactide of lactic acid) is a skeleton of lactic acid polymerized. The polyester skeleton A is preferably a skeleton obtained by subjecting a mixture of L-lactide and D-lactide to ring-opening polymerization.

The polyester skeleton A is not particularly limited and may be appropriately selected depending on the intended purpose, but is preferably a polylactic acid skeleton. Polylactic acid is a polymer formed of lactic acids linked via an ester bond, and has recently attracted attention as environmentally-friendly biodegradable plastics. That is, in the natural world, enzymes that cleave ester bonds (esterases) are widely distributed. Thus, polylactic acids are gradually cleaved by such enzymes in the environment and then converted to lactic acids (i.e., monomers), which are finally converted carbon dioxide and water.

In the polylactic acid skeleton, the optical purity X (%) calculated by the following equation (as converted to monomer components) is preferably 80% or lower:

$$X(\%)=|X(L\text{ form})-X(D\text{ form})|$$

where X (L form) denotes a ratio (%) of L form (lactic acid monomer equivalent) and X (D form) denotes a ratio (%) of D form (lactic acid monomer equivalent).

The method of measuring the optical purity X is not particularly limited and may be appropriately selected depending on the intended purpose. For example, the optical purity X can be found in the following manner. A polymer or toner that has a polyester skeleton is added to a mixture solvent consisting of pure water, 1 mol/L sodium hydroxide solution and isopropyl alcohol. The mixture is then heated to 70° C. and stirred for hydrolysis, followed by filtration for removal of solids and by addition of sulfuric acid for neutralization to give an aqueous solution containing L-lactic acid and/or D-lactic acid that have been produced by decomposition of the polyester. The aqueous solution is subjected to high-performance liquid chromatography (HPLC) on a SUMICHIRAL OA-5000 column, a chiral ligand-exchange column (manufactured by Sumika Chemical Analysis Service, Ltd.) to obtain both the peak area S (L) derived from L-lactic acid and peak area S (D) derived from D-lactic acid. Using these peak areas, it is possible to find the optical purity X as follows:

$$X(L\text{ form})\ \%=100\times S(L)/(S(L)+S(D))$$

$$X(D\text{ form})\ \%=100\times S(D)/(S(L)+S(D))$$

$$\text{Optical purity } X\ \%=|X(L\text{ form})-X(D\text{ form})|$$

Needless to say, L-form lactic acid and D-form lactic acid, serving as starting materials, are optical isomers which have the same physical and chemical properties except optical properties. When they are used for polymerization, their reactivities are equal to each other, and the compositional ratio of the monomers as starting materials is the same as the compositional ratio of the monomers in the polymer.

The optical purity of 80% or lower is preferred since the obtained resin is improved in solubility in a solvent and transparency.

The ratio between X of a D-form monomer and X of an L-form monomer constituting the polyester skeleton A is equal to the ratio between a D-form monomer and an L-form monomer used for forming the polyester skeleton A. Thus, it is possible to control the optical purity X (%) of the polyester skeleton A of the binder resin as converted to monomer components, by using an L-form monomer and a D-form monomer in combination in an appropriate ratio to obtain a racemic compound.

The method for producing a polylactic acid resin is not particularly limited and may be any conventionally known method. In one known production method, starch (e.g., cone) serving as a starting material is fermented to obtain lactic acid. The obtained lactic acid monomer is subjected directly to dehydration condensation. Alternatively, the obtained lactic acid monomer is formed into a cyaclic dimer lactide, which is then subjected to ring-opening polymerization in the presence of a catalyst. Among them, a method utilizing ring-opening polymerization is preferred since the molecular weight of the polylactic acid resin can be controlled with the amount of an initiator and from the viewpoint of the productivity; e.g., the reaction can be completed in a short time of period.

The reaction initiator usable may be any conventionally known one having any number of functional groups, so long as it is an alcohol compound that does not evaporate after drying under reduced pressure at 100° C. and 20 mmHg or lower or after heating for polymerization at about 200° C.

—Skeleton B not Containing in a Repeating Structure a Constituent Unit Formed Through Dehydration Condensation of Hydroxycarboxylic Acid—

The skeleton B not containing in a repeating structure a constituent unit formed through dehydration condensation of hydroxycarboxylic acid (hereinafter referred to as "skeleton B") is not particularly limited and may be appropriately selected depending on the intended purpose, so long as it does not contain in a repeating structure a constituent unit formed through dehydration condensation of hydroxycarboxylic acid. The skeleton B preferably has a glass transition temperature of 20° C. or lower, which enables a binder resin to have a structure where inner phases each mainly made of the skeleton B are finely dispersed in an outer phase mainly made of the polyester skeleton A. The skeleton B is preferably formed from a compound containing at least two hydroxyl groups. In the presence of the above compound serving as an initiator, it is possible to subject to ring-opening polymerization a monomer forming the polyester skeleton A such as lactide, to thereby form a binder resin. Such two or more hydroxyl groups-containing compound for forming the skeleton B improves the affinity to a colorant. Also, when the high Tg units derived from the polyester skeleton A are located at both the ends, it is possible to construct the above-described skeleton of the binder resin where the low Tg units derived from the skeleton B tend to be dispersed internally.

The skeleton B is not particularly limited so long as it meets the above-described requirements. Examples thereof include a polyether, a polycarbonate, a polyester, a hydroxyl group-containing vinyl resin, and a silicone resin containing a hydroxyl group at the end thereof. Among them, the skeleton B is preferably a polyester skeleton from the viewpoint of improving the affinity to a colorant, with a polyester skeleton having a branched structure being particularly preferred.

The polyester skeleton can be obtained by a polyesterification reaction between one kind or two or more kinds of polyols represented by the following General Formula (1) and one kind or two or more kinds of polycarboxylic acids represented by the following General Formula (2).

A-(OH)m General Formula (1)

In the General Formula (1), A represents an alkyl group having 1 to 20 carbon atoms, an alkylene group having 1 to 20 carbon atoms, or an aromatic group or heterocyclic aromatic group which may have a substituent group. m represents an integer of 2 to 4.

B-(COOH)n General Formula (2)

In the General Formula (2), B represents an alkyl group having 1 to 20 carbon atoms, an alkylene group having 1 to 20 carbon atoms, or an aromatic group or heterocyclic aromatic group which may have a substituent group. n represents an integer of 2 to 4.

Examples of polyols represented by the General Formula (1) include ethylene glycol, diethylene glycol, triethylene glycol, 1,2-propylene glycol, 1,3-propylene glycol, 1,4-butanediol, neopentyl glycol, 1,4-butenediol, 1,5-pentanediol, 3-methyl-1,5-pentanediol, 1,6-hexanediol, 1,4-cyclohexanedimethanol, dipropylene glycol, polyethylene glycol, polypropylene glycol, polytetramethylene glycol, sorbitol, 1,2,3,6-hexanetetrol, 1,4-sorbitan, pentaerythritol, dipentaerythritol, tripentaerythritol, 1,2,4-butanetriol, 1,2,5-pentane triol, glycerol, 2-methylpropane triol, 2-methyl-1,2,4-butane triol, trimethylol ethane, trimethylol propane, 1,3,5-trihydroxymethyl benzene, bisphenol A, bisphenol A ethylene oxide adducts, bisphenol A propylene oxide adducts, hydrogenated bisphenol A, hydrogenated bisphenol A ethylene oxide adducts, and hydrogenated bisphenol A propylene oxide adducts. These may be used alone or in combination.

Examples of polycarboxylic acids represented by the General Formula (2) include maleic acid, fumaric acid, citraconic acid, itaconic acid, glutaconic acid, phthalic acid, isophthalic acid, terephthalic acid, succinic acid, adipic acid, sebacic acid, azelaic acid, malonic acid, n-dodecenylsuccinic acid, isooctyl succinic acid, isododecenylsuccinic acid, n-dodecylsuccinic acid, isododecylsuccinic acid, n-octenyl succinic acid, n-octyl succinic acid, isooctenyl succinic acid, isooctyl succinic acid, 1,2,4-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, Enpol trimer acid, cyclohexanedicarboxylic acid, cyclohexenedicarboxylic acid, butanetetracarboxylic acid, diphenylsulfonetetracarboxylic acid, and ethylene glycol bis(trimellitic acid). These may be used alone or in combination.

The above polyester skeleton preferably contains as an acid component a trivalent or higher polycarboxylic acid in an amount of 1.5 mol % or more, with the trivalent or higher polycarboxylic acid being trimellitic acid. Introducing the trivalent or higher polycarboxylic acid can provide an appropriate branched/crosslinked structure, with which the substantial molecular chain can be shortened. As a result, the dispersion diameter of the skeleton B dispersed in the inner phase can be controlled small, making it possible to decrease the average of the maximum Feret diameters of the first phase difference regions in the dispersion phase which correspond to the greater phase difference regions observed with the AFM. When the amount of the trivalent or higher polycarboxylic acid is less than 1.5 mol %, the branched structure formed becomes insufficient, and the dispersion diameter of the skeleton B is easier to increase more than required. As a result, the average of the maximum Feret diameters of the first phase difference regions in the dispersion phase which correspond to the greater phase difference regions tend to be large, potentially adversely affecting the heat resistance storage stability. Also, the above polyester skeleton preferably contains as an acid component a trivalent or higher polycarboxylic acid in an amount of 3.0 mol % or less. When the amount of the trivalent or higher polycarboxylic acid is more than 3.0 mol %, the branched/crosslinked structure formed is complicated to result in that the molecular weight of the formed resin may increase or the dissolvability of the formed resin in a solvent may degrade, which is not preferred.

The dispersion state in the binder resin is confirmed from a phase image obtained with an atomic force microscope (AFM) of tapping mode. The tapping mode of an atomic force microscope is the method described in Surface Science Letter, 290, 668 (1993) which is also called intermittent contact mode or dynamic force microscope (DFM). The phase image is obtained by scanning the surface profile of a sample with a vibrating cantilever, as described in, for example, Poymer, 35, 5778 (1994), Macromolecules, 28, 6773 (1995). In this scanning, phase differences are generated between the actual vibration and the vibration of a drive that vibrates a cantilever, due to viscoeleastic properties of the surface the sample. The phase image is obtained by mapping the phase differences. Here, soft parts show larger phase delay and hard parts show smaller phase delay.

The binder resin in the present invention contains the low Tg units which are soft and observed as greater phase difference images, and the high Tg unit which is hard and observed as smaller phase difference images. Here, the binder resin in the present invention must have a structure containing as the outer phase the second phase difference region which is hard and corresponds to the regions of smaller phase differences and containing as the inner phase the first phase difference regions which are soft and correspond to the regions of greater phase differences where the first phase difference regions are finely dispersed in the second phase difference region.

A sample observed for obtaining the phase image may be a cut piece of a block of the binder resin which is prepared under the following conditions using, for example, an ultramicrotome ULTRACUT UCT (product of Leica):

Cutting thickness: 60 nm

Cutting speed: 0.4 mm/sec

Diamond knife (Ultra Sonic35°) used

A typical device used for obtaining the AFM phase image is, for example, MFP-3D (product of Asylum Technology Co., Ltd.), in which OMCL-AC240TS-C3 is used as a cantilever to observe under the following measurement conditions:

Target amplitude: 0.5 V

Target percent: −5%

Amplitude setpoint: 315 mV

Scan rate: 1 Hz

Scan points: 256×256

Scan angle: 0°

In the present invention, one employable specific method for measuring the average of the maximum Feret diameters of the first phase difference regions (i.e., soft, low-Tg units) which correspond to greater phase difference regions in the phase image is a method using a binarized image prepared by subjecting the phase image obtained with the tapping-mode AFM to binarization using, as a threshold, an intermediate value between the maximum value and the minimum value of the image differences. Specifically, the binarized image is obtained through a process containing: measuring the binder resin with an atomic force microscope (AFM) of tapping mode to obtain phase differences at locations of the binder resin; converting the phase differences to image densities of pixels so that the locations having greater phase differences are lighter than the locations having smaller phase differences; mapping the locations to obtain the phase image; and subjecting the phase image to binarization using, as a threshold, an intermediate value between a maximum value and a minimum value of the image densities so that the image densities of the first pixels are equal to or more than the minimum value but less than the intermediate value and the image densities of the second pixels are equal to or more than the intermediate value but equal to or less than the maximum value. The above binarized image is obtained as described above by photographing a phase image so as to have a contrast where the regions of smaller phase differences are dark colored and the regions of greater phase differences are light colored, and then by subjecting the phase image binarization using as a boundary value an intermediate value between a maximum value and a minimum value of the phase differences. Ten images are selected from a 300 nm×300 nm area of the binarized image, and 30 of the first phase difference regions formed of the first pixel are selected in the order of decreasing the maximum Feret diameter; i.e., the maximum Feret diameters of the selected 30 first phase difference regions are from the greatest to the $30^{th}$ greatest. Then, these greatest to the $30^{th}$ greatest maximum Feret diameters are averaged to obtain an average of the maximum Feret diameters. Notably, fine particles that are clearly judged as image noise or are difficult to determine whether they are image noise or phase difference regions are excluded from calculation of the average diameter. Specifically, the first phase difference regions that should be excluded from calculation of the average diameter are those having an area of 1/100 the first phase difference region having the greatest maximum Feret diameter in the same image of the observed phase image. The maximum Feret diameter is a distance between two parallel lines drawn so as to sandwich each phase difference region.

The average of the maximum Feret diameters is preferably 10 nm or greater but less than 45 nm, more preferably 10 nm or greater but less than 30 nm. When the average of the maximum Feret diameters is 45 nm or less, the low-Tg units that are highly adhesive are easily exposed due to stress, potentially degrading the filming property of toner. When it is less than 10 nm, the extent of releaving stress is considerably weakened, and as a result their improving effect on the strength may be insufficient.

Figure 2:
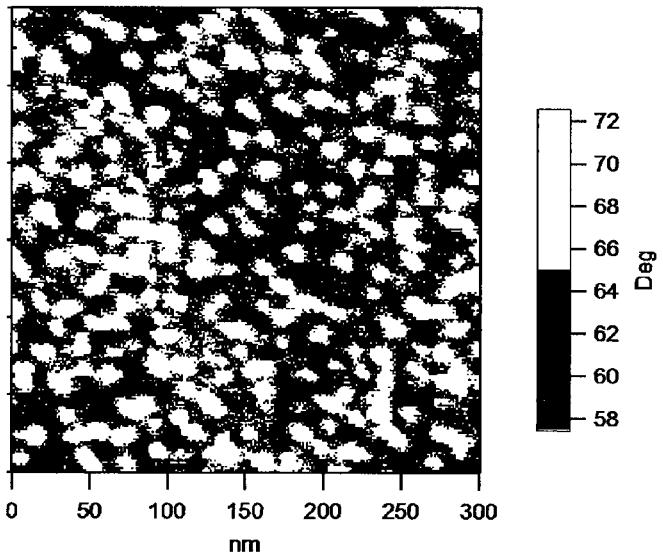
FIG. 2 is a binarized image of a phase image of binder resin 1 used in Example 1, which is measured with AFM of tapping mode.

FIG. 1 is a phase image of binder resin 1 used in Example 1, which is a representative binder resin in the present invention. FIG. 2 is a binarized image of a phase image of this binder resin. In FIG. 2, light regions are the first phase difference regions having greater phase differences (greater phase difference regions) and a dark region is the second phase difference region having a smaller phase difference (smaller phase difference region).

The glass transition temperature of the binder resin can be calculated from an endothermic chart obtained with a differential scanning calorimeter (DSC) which is typified by Q2000 (product of TA Instruments). Specifically, 5 mg to 10 mg of the binder resin is charged to a readily sealable aluminum pan, which is then subjected to the following measuring flow:

the first heating: 30° C. to 220° C., 5° C./min, where after reaching 220° C., the sample is maintained at 220° C. for 1 min;

Cooling: the sample is quenched to −60° C. without being temperature-controlled, where after reaching −60° C., the sample is maintained at −60° C. for 1 min; and the second heating: −60° C. to 180° C., 5° C./min.

The glass transition temperature is obtained by reading a value in a thermogram for the second heating with the midpoint method stipulated in ASTM D3418/82. Notably, the glass transition temperature is preferably identified by determining the inflection point from the DrDSC chart which has been subjected to first derivation.

The glass transition temperature Tg of the binder resin is not particularly limited and may be appropriately selected depending on the intended purpose, so long as it is one point and is 25° C. to 65° C. in the temperature range of the above measuring flow, but is preferably one point and is 30° C. to 45° C. When the Tg is lower than 25° C., the formed toner easily cause blocking during storage. When it is higher than 65° C., the fixation requires much energy to perform, which is not preferred.

When the glass transition temperature of the polyester skeleton A and the glass transition temperature of the skeleton B are denoted respectively by TgA and TgB and the mass ratio of the polyester skeleton A and the mass ratio of the skeleton B are denoted respectively by MA and MB, the following relationship is preferably satisfied;

$$-5 \leq Tg-(TgA \times MA/(MA+MB)+TgB \times MB/(MA+MB)) \leq 5.$$

When the polyester skeleton A and the skeleton B dissolve each other, the glass transition temperature is generally determined as one point depending on the mixing ratio therebetween. However, as described above, the structure of the binder resin in the present invention contains soft, low-Tg units and a hard, high-Tg unit where the soft, low-Tg units are dispersed in the hard, high-Tg unit as observed with AFM; i.e., these two different units are not completely dissolved each other. When there are two mutually different, non-dissolvable units having different Tgs, the glass transition temperature of the binder resin is generally observed at two points. Thus, while the binder resin in the present invention contains soft and hard different domains, these domains are in a special state where they are semi-dissolved each other due to high affinity therebetween, as shown by only one glass transition temperature that they have. In the present invention, the binder resin that satisfies the above conditions is necessary for improving both stress resistance (strength) and heat resistance storage stability of toner.

When there are two or more glass transition temperatures observed, the polyester skeleton A and the skeleton B have poor affinity therebetween. As a result, the average of the maximum Feret diameters derived from the skeleton B (i.e., the low-Tg units) easily becomes large. In this case, the formed toner is easier to deform due to stress applied during long-term stirring of the developer and the low-Tg units are easily exposed on the toner surface, causing sticking to carrier or the developing device to lead to background smear and white streaks, which is not preferred. Also, even when the above glass transition temperature satisfies the above relationship and is one point and no dispersion structure formed of hard and soft domains is observed (i.e., the average of the maximum Feret diameters is considerably small or absence), it can be judged that the polyester skeleton A and the skeleton B almost completely dissolve each other to form a homogeneous resin. In this case, the effects of the skeleton B advantageous for stress relaxation are considerably lowered to potentially make background smear severer.

The amount of the binder resin contained in the skeleton B is not particularly limited and may be appropriately selected depending on the intended purpose, but is preferably 5% by mass to 25% by mass, more preferably 15% by mass to 25% by mass. When the amount thereof is less than 5% by mass, the above-described fine domain structure is not observed with AFM and the formed binder resin is easier to be brittle. When it is more than 25% by mass, the average of the maximum Feret diameters under AFM is easily 45 nm or more, and the formed toner is poor in resistance to stress, which is not preferred.

The number average molecular weight Mn (B) of the skeleton B is not particularly limited and may be appropriately selected depending on the intended purpose, but is preferably 1,000 or higher but lower than 3,000, more preferably 1,500 or higher but lower than 2,800. When the number average molecular weight of the skeleton B is lower than 1,000, the above-described fine domain structure is not observed with AFM and the formed binder resin is easier to be brittle. When it is higher than 3,000, the average of the maximum Feret diameters under AFM is easily 45 nm or more, and the formed toner is poor in resistance to stress, which is not preferred. The number average molecular weight Mn (B) of 1,000 or higher but lower than 3,000 is preferred from the viewpoint of achieving the above-described mutually dissolved/phase-separated state.

The number average molecular weight Mn of the binder resin is not particularly limited and may be appropriately selected depending on the intended purpose, but is preferably 20,000 or lower, more preferably 8,000 to 15,000. When the number average molecular weight Mn thereof is higher than 20,000, the formed toner may be degraded in fixabilty and dissolvability to a solvent, which is not preferred.

The amount of the binder resin contained in the toner is not particularly limited and may be appropriately selected depending on the intended purpose, but is preferably 60% by mass or more, more preferably 80% by mass or more. When the amount thereof is less than 60% by mass, there may be considerable degradation in low-temperature fixing property and blocking property of the formed toner.

<Colorant>

The colorant is not particularly limited and may be appropriately selected depending on the intended purpose from known dyes and pigments. Examples thereof include carbon black, nigrosine dye, iron black, naphthol yellow S, Hansa yellow (10G, 5G and G), cadmium yellow, yellow iron oxide, yellow ocher, yellow lead, titanium yellow, polyazo yellow, oil yellow, Hansa yellow (GR, A, RN and R), pigment yellow L, benzidine yellow (G and GR), permanent yellow (NCG), vulcan fast yellow (5G, R), tartrazinelake, quinoline yellow lake, anthrasan yellow BGL, isoindolinon yellow, colcothar, red lead, lead vermilion, cadmium red, cadmium mercury red, antimony vermilion, permanent red 4R, parared, fiser red, parachloroorthonitro anilin red, lithol fast scarlet G, brilliant fast scarlet, brilliant carmine BS, permanent red (F2R, F4R, FRL, FRLL and F4RH), fast scarlet VD, vulcan fast rubin B, brilliant scarlet G, lithol rubin GX, permanent red F5R, brilliant carmin 6B, pigment scarlet 3B, bordeaux 5B, toluidine Maroon, permanent bordeaux F2K, Helio bordeaux BL, bordeaux 10B, BON maroon light, BON maroon medium, eosin lake, rhodamine lake B, rhodamine lake Y, alizarin lake, thioindigo red B, thioindigo maroon, oil red, quinacridone red, pyrazolone red, polyazo red, chrome vermilion, benzidine orange, perinone orange, oil orange, cobalt blue, cerulean blue, alkali blue lake, peacock blue lake, victoria blue lake, metal-free phthalocyanin blue, phthalocyanin blue, fast sky blue, indanthrene blue (RS and BC), indigo, ultramarine, iron blue, anthraquinon blue, fast violet B, methylviolet lake, cobalt purple, manganese violet, dioxane violet, anthraquinon violet, chrome green, zinc green, chromium oxide, viridian, emerald green, pigment green B, naphthol green B, green gold, acid green lake, malachite green lake, phthalocyanine green, anthraquinon green, titanium oxide and zinc flower, lithopone. These may be used alone or in combination.

The amount of the colorant contained in the toner is not particularly limited and may be appropriately selected depending on the intended purpose. The amount thereof is preferably 1% by mass to 15% by mass, more preferably 3% by mass to 10% by mass. When the amount is less than 1% by mass, the coloring capability of the toner decreases. When the amount is more than 15% by mass, the pigment is poorly dispersed in the toner, potentially leading to a decrease in coloring capability and degradation of electrical properties of the toner.

The colorant may be compounded with a resin to form a masterbatch. The resin is not particularly limited and may be appropriately selected depending on the intended purpose from resins known in the art. Examples thereof include styrene polymers, polymers of substituted styrene, styrene copolymers, polymethyl methacrylates, polybutyl methacrylates, polyvinyl chlorides, polyvinyl acetates, polyethylenes, polypropylenes, epoxy resins, epoxy polyol resins, polyurethanes, polyamides, polyvinyl butyrals, polyacrylic acid resins, rosin, modified rosin, terpene resins, aliphatic hydrocarbon resins, alicyclic hydrocarbon resins, aromatic petroleum resins, chlorinated paraffins and paraffin waxes. These may be used alone or in combination.

Examples of the styrene polymers and the polymers of substituted styrene include polyester resins, polystyrenes, poly-p-chlorostyrenes and polyvinyltoluenes. Examples of the styrene copolymers include styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-α-methyl chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers and styrene-maleic acid ester copolymers.

The masterbatch can be produced by mixing or kneading the colorant and the resin for use in a masterbatch with the application of high shearing force. In doing so, an organic solvent is preferably added to enhance the interaction between the colorant and the resin. Also, use of the so-called flashing method is suitable in that a wet cake of the colorant can be used as it is, without the need to dry it. The flashing method is a method in which an aqueous paste containing a colorant is mixed or kneaded with a resin and an organic solvent and then the colorant is transferred to the resin to remove water and components of the organic solvent. For this mixing or kneading, a high-shearing dispersing apparatus such as a three-roll mill is suitably used.

<Other Ingredients>

The other ingredients are not particularly limited and may be appropriately selected depending on the intended purpose. Examples thereof include a releasing agent, a charge controlling agent, fine inorganic particles, a flowability improving agent, a cleanability improving agent and a magnetic material.

—Releasing Agent—

The releasing agent is not particularly limited and may be appropriately selected depending on the intended purpose. The melting point thereof is preferably low; i.e., 50° C. to 120° C. When dispersed together with the above resins, such a low-melting-point releasing agent effectively exhibits its releasing effects on the interface between the fixing roller and each toner particle. Thus, even when an oil-less mechanism is employed (in which a releasing agent such as oil is not applied onto the fixing roller), good hot offset resistance is attained.

The releasing agent is suitably a wax, for example. Examples of the wax include natural waxes such as vegetable waxes (e.g., carnauba wax, cotton wax, Japan wax and rice wax), animal waxes (e.g., bees wax and lanolin), mineral waxes (e.g., ozokelite and ceresine) and petroleum waxes (e.g., paraffin waxes, microcrystalline waxes and petrolatum). Further examples thereof include synthetic hydrocarbon waxes (e.g., Fischer-Tropsch waxes and polyethylene waxes); and synthetic waxes (e.g., ester waxes, ketone waxes and ether waxes). Still further examples thereof include fatty acid amides such as 12-hydroxystearic acid amide, stearic acid amide, phthalic anhydride imide and chlorinated hydrocarbons; low-molecular-weight crystalline polymer resins such as acrylic homopolymers (e.g., poly-n-stearyl methacrylate and poly-n-lauryl methacrylate) and acrylic copolymers (e.g., n-stearyl acrylate-ethyl methacrylate copolymers); and crystalline polymers having a long alkyl group as a side chain. These may be used alone or in combination.

The melting point of the releasing agent is not particularly limited and may be appropriately selected depending on the intended purpose, but is preferably 50° C. to 120° C., more preferably 60° C. to 90° C. When the melting point thereof is lower than 50° C., the wax may adversely affect the heat resistance storage stability of the formed toner. When it is higher than 120° C., the formed toner may easily cause cold offset upon fixing at low temperatures.

The melt viscosity of the releasing agent is preferably 5 cps to 1,000 cps, more preferably 10 cps to 100 cps, as measured at a temperature higher by 20° C. than the melting point of the releasing agent. When the melt viscosity thereof is less than 5 cps, the releaseability of the formed toner may decrease. When it is more than 1,000 cps, the releasing agent cannot exhibit the effects of improving hot offset resistance and low-temperature fixing property.

The amount of the releasing agent contained in the toner is not particularly limited and may be appropriately selected depending on the intended purpose, but is preferably less than 40% by mass, more preferably 3% by mass to 30% by mass. When it is more than 40% by mass, the formed toner may be degraded in flowability.

—Charge Controlling Agent—

The charge controlling agent is not particularly limited and may be appropriately selected depending on the intended purpose from known charge controlling agents. Examples thereof include nigrosine dyes, triphenylmethane dyes, chrome-containing metal complex dyes, molybdic acid chelate pigments, rhodamine dyes, alkoxy amines, quaternary ammonium salts (including fluorine-modified quaternary ammonium salts), alkylamides, phosphorus, phosphorus compounds, tungsten, tungsten compounds, fluorine active agents, metal salts of salicylic acid, and metal salts of salicylic acid derivatives. These may be used alone or in combination.

The charge controlling agent may be a commercially available one. Examples thereof include: nigrosine dye BONTRON 03, quaternary ammonium salt BONTRON P-51, metal-containing azo dye BONTRON S-34, oxynaphthoic acid-based metal complex E-82, salicylic acid-based metal complex E-84 and phenol condensate E-89 (these products are of ORIENT CHEMICAL INDUSTRIES CO., LTD); quaternary ammonium salt molybdenum complexes TP-302 and TP-415 (these products are of Hodogaya Chemical Co., Ltd.); quaternary ammonium salt COPY CHARGE PSY VP 2038, triphenylmethane derivative COPY BLUE PR, quaternary ammonium salt COPY CHARGE NEG VP2036 and COPY CHARGE NX VP434 (these products are of Clariant Inc.); LRA-901 and boron complex LR-147 (these products are of Japan Carlit Co., Ltd.); copper phthalocyanine, perylene, quinacridone, azo pigments, and polymeric compounds having, as a functional group, a sulfonic acid group, a carboxyl group and/or a quaternary ammonium salt.

The amount of the charge controlling agent contained in the toner depends upon the type of the resin, the presence or absence of additive(s) and the dispersing process employed and therefore cannot be unequivocally defined. However, the amount is preferably 0.1 parts by mass to 10 parts by mass, more preferably 0.2 parts by mass to 5 parts by mass, per 100 parts by mass of the binder resin. When the amount thereof is less than 0.1 parts by mass, favorable charge controlling properties cannot be obtained in some cases. When it is greater than 10 parts by mass, the chargeability of the toner is so large that the effects of a main charge controlling agent are reduced, and the electrostatic attractive force between the toner and the developing roller increases, which possibly lead to a degradation of the flowability of a developer and/or of image density.

—Fine Inorganic Particles—

The fine inorganic particles are preferably used as an external additive to impart flowability, developability and chargeability to toner particles.

The fine inorganic particles are not particularly limited and may be appropriately selected from known fine inorganic particles depending on the intended purpose. Examples thereof include silica, alumina, titanium oxide, barium titanate, magnesium titanate, calcium titanate, strontium titanate, zinc oxide, tin oxide, silica sand, clay, mica, wollastonite, diatomite, chromium oxide, cerium oxide, colcothar, antimony trioxide, magnesium oxide, zirconium oxide, barium sulfate, barium carbonate, calcium carbonate, silicon carbide, and silicon nitride. These may be used alone or in combination.

The primary particle diameter of the fine inorganic particles is preferably 5 nm to 2 μm, more preferably 5 nm to 500 nm.

The amount of the fine inorganic particles contained in the toner is preferably 0.01% by mass to 5.0% by mass, more preferably 0.01% by mass to 2.0% by mass.

—Flowability Improving Agent—

The flowability improving agent is an agent applying surface treatment to improve hydrophobic properties, and is capable of inhibiting the degradation of flowability or chargeability under high humidity environment. Examples of the flowability improving agent include silane coupling agents, silylating agents, silane coupling agents having a fluorinated alkyl group, organotitanate coupling agents, aluminum coupling agents, silicone oils, and modified silicone oils. It is particularly preferable that silica and titanium oxide be subjected to surface treatment with such a flowability improver and used as hydrophobic silica and hydrophobic titanium oxide.

—Cleanability Improving Agent—

The cleanability improving agent is added to the toner in order for the residual developer containing the toner to be removed from a photoconductor or a primary transfer member after transferring. Examples of the cleaning improver include: fatty acid metal salts such as zinc stearate, calcium stearate and stearic acid; and fine polymer particles formed by soap-free emulsion polymerization, such as fine polymethylmethacrylate particles and fine polystyrene particles. The fine polymer particles have preferably a narrow particle size distribution. It is preferable that the volume average particle diameter thereof be 0.01 μm to 1 μm.

—Magnetic Material—

The magnetic material is not particularly limited and may be appropriately selected depending on the intended purpose from known magnetic materials. Examples of the magnetic materials include iron powder, magnetite and ferrite. Among them, one having a white color is preferable in terms of color tone.

The toner according to the present invention can be produced by the following preferred method, but the production method is not limited thereto.

The toner production method according to the present invention preferably includes emulsifying or dispersing a toner material solution or a toner material dispersion in an aqueous medium to prepare an emulsified or dispersed liquid, followed by formation of toner particles. More specifically, the method preferably includes the following steps (1) to (6).

(1) Preparation of Toner Material Solution or Toner Material Dispersion

The toner material solution or toner material dispersion is produced by dissolving or dispersing the toner material in an organic solvent.

The toner material is not particularly limited as long as it can form toner and may be appropriately selected depending on the intended purpose. For example, the toner material includes the binder resin, and furthermore the above other ingredients such as a releasing agent, a colorant, and a charge controlling agent according to need.

The toner material solution or toner material dispersion is produced by dissolving or dispersing the toner material in an organic solvent. The organic solvent is removed during or after formation of toner particles.

The organic solvent is not particularly limited as long as it can allow the toner material to be dissolved or dispersed therein and may be appropriately selected depending on the intended purpose. It is preferable that the organic solvent be a solvent having a boiling point of less than 150° C. in terms of easy removal. Examples thereof include toluene, xylene, benzene, carbon tetrachloride, methylene chloride, 1,2-dichloroethane, 1,1,2-trichloroethane, trichloroethylene, chloroform, monochlorobenzene, dichloroethylidene, methylacetate, ethylacetate, methyl ethyl ketone, and methyl isobutyl ketone. Among these solvents, ester-based solvents are preferable, and ethyl acetate is particularly preferable. These solvents may be used alone or in combination.

The amount of organic solvent is not particularly limited and may be appropriately selected depending on the intended purpose; preferably, the amount is 40 parts by mass to 300 parts by mass, more preferably 60 parts by mass to 140 parts by mass, and further preferably 80 parts by mass to 120 parts by mass based on 100 parts by mass of the toner material.

(2) Preparation of Aqueous Medium

The aqueous medium is not particularly limited and may be appropriately selected depending on the intended purpose from known ones. Examples thereof include water, water-miscible solvents, and mixture thereof. Among these, water is particularly preferable.

The water-miscible solvent is not particularly limited as long as it is miscible with water. Examples thereof include alcohols, dimethylformamide, tetrahydrofuran, cellosolves, and lower ketones.

Examples of the alcohols include methanol, isopropanol, and ethylene glycol. Examples of the lower ketones include acetone and methyl ethyl ketone. These may be used alone or in combination.

The aqueous medium phase may be prepared, e.g., through dispersing resin fine particles in the aqueous medium. The amount of resin fine particles added to the aqueous medium is not particularly limited and may be appropriately selected depending on the intended purpose; preferably, the amount is 0.5% by mass to 10% by mass.

The resin fine particles are not particularly limited as long as it can form an aqueous dispersion in an aqueous medium and may be appropriately selected depending on the intended purpose known resins. The resin fine particles may be of thermoplastic resins or thermosetting resins; examples thereof include vinyl resins, polyurethane resins, epoxy resins, polyester resins, polyamide resins, polyimide resins, silicone resins, phenol resins, melamine resins, urea resins, aniline resins, ionomer resins, and polycarbonate resins.

These may be used alone or in combination. Among these, the resin fine particles formed of the vinyl resins, polyurethane resins, epoxy resins, or polyester resins or any combination thereof are preferable by virtue of easily producing aqueous dispersion of fine spherical resin particles.

The vinyl resins are polymers in which a vinyl monomer is mono- or co-polymerized. Examples of the vinyl resins include styrene-(meth)acrylate ester resins, styrene-butadiene copolymers, (meth)acrylate-acrylic acid ester copolymers, styrene-acrylonitrile copolymers, styrene-maleic anhydride copolymers, and styrene-(meth)acrylate copolymers.

The resin fine particles may be formed of copolymer containing a monomer having at least two unsaturated groups.

The monomer having at least two unsaturated groups is not particularly limited and may be appropriately selected depending on the intended purpose. Examples of such monomers include sodium salt of sulfate ester of methacrylic acid ethylene oxide adduct (ELEMINOL RS-30, manufactured by Sanyo Chemical Industries, Co., Ltd.), divinylbenzene, and 1,6-hexane-diol acrylate.

The resin fine particles may be formed through known polymerization processes appropriately selected depending on the intended purpose, and are preferably produced into an aqueous dispersion of resin fine particles. Examples of the preparation processes of the aqueous dispersion include (i) a direct preparation process of aqueous dispersion of the resin fine particles in which, in the case of the vinyl resin, a vinyl monomer as a starting material is polymerized by suspension-polymerization process, emulsification-polymerization process, seed polymerization process or dispersion-polymerization process; (ii) a preparation process of aqueous dispersion of the resin fine particles in which, in the case of the polyaddition or condensation resin such as polyester resin, polyurethane resin, or epoxy resin, a precursor (e.g., monomer or oligomer) or solvent solution thereof is dispersed in an aqueous medium in the presence of a suitable dispersing agent, and heated or added with a curing agent so as to be cured, thereby producing the aqueous dispersion of the resin fine particles; (iii) a preparation process of aqueous dispersion of the resin fine particles in which, in the case of the polyaddition or condensation resin such as polyester resin, polyurethane resin, or epoxy resin, a suitable emulsifier is dissolved in a precursor (e.g., monomer or oligomer) or solvent solution thereof (preferably being liquid, or being liquidized by heating), and then water is added so as to induce phase inversion emulsification, thereby producing the aqueous dispersion of the resin fine particles; (iv) a preparation process of aqueous dispersion of the resin fine particles, in which a resin, previously prepared by polymerization process which may be any of addition polymerization, ring-opening polymerization, polyaddition, addition condensation, or condensation polymerization, is pulverized by means of a pulverizing mill such as mechanical rotation-type or jet-type, and classified to obtain resin fine particles, and then the resin fine particles are dispersed in an aqueous medium in the presence of a suitable dispersing agent, thereby producing the aqueous dispersion of the resin fine particles; (v) a preparation process of aqueous dispersion of the resin fine particles, in which a resin, previously prepared by a polymerization process which may be any of addition polymerization, ring-opening polymerization, polyaddition, addition condensation or condensation polymerization, is dissolved in a solvent, the resultant resin solution is sprayed in the form of a mist to thereby obtain resin fine particles, and then the resulting resin fine particles are dispersed in an aqueous medium in the presence of a suitable dispersing agent, thereby producing the aqueous dispersion of the resin fine particles; (vi) a preparation process of aqueous dispersion of the resin fine particles, in which a resin, previously prepared by a polymerization process, which may be any of addition polymerization, ring-opening polymerization, polyaddition, addition condensation or condensation polymerization, is dissolved in a solvent and then the resultant resin solution is subjected to precipitation by adding a poor solvent, or a resin is dissolved with heating in a solvent and then the resultant resin solution is subjected to precipitation by cooling, the solvent is removed to thereby obtain resin fine particles, and then the resulting resin fine particles are dispersed in an aqueous medium in the presence of a suitable dispersing agent, thereby producing the aqueous dispersion of the resin fine particles; (vii) a preparation process of aqueous dispersion of the resin fine particles, in which a resin, previously prepared by a polymerization process, which may be any of addition polymerization, ring-opening polymerization, polyaddition, addition condensation or condensation polymerization, is dissolved in a solvent to thereby obtain a resin solution, the resin solution is dispersed in an aqueous medium in the presence of a suitable dispersing agent, and then the solvent is removed by heating or reduced pressure to thereby obtain the aqueous dispersion of the resin fine particles; (viii) a preparation process of aqueous dispersion of the resin fine particles, in which a resin, previously prepared by a polymerization process, which is any of addition polymerization, ring-opening polymerization, polyaddition, addition condensation or condensation polymerization, is dissolved in a solvent to thereby obtain a resin solution, a suitable emulsifier is dissolved in the resin solution, and then water is added to the resin solution so as to induce phase inversion emulsification, thereby producing the aqueous dispersion of the resin fine particles.

When preparing the aqueous dispersion, a dispersant is preferably used according to need at the time of emulsifying and/or dispersing (to be described later) in order to stabilize oil droplets formed from toner material solution or toner material dispersion and sharpen the particle size distribution while yielding a desirable shape.

The dispersant is not particularly limited and may be appropriately selected depending on the intended purpose. Examples thereof include surfactants, water-insoluble inorganic dispersants, and polymeric protective colloids. These may be used alone or in combination. Among these, surfactants are preferable.

Examples of the surfactants include anionic surfactants, cationic surfactants, nonionic surfactants, and ampholytic surfactants.

Examples of the anionic surfactants include alkylbenzene sulfonic acid salts, α-olefin sulfonic acid salts, phosphoric acid esters, and anionic surfactants having fluoroalkyl group. Among these, anionic surfactants having fluoroalkyl group are preferable. Examples of the anionic surfactants having fluoroalkyl group include C2 to C10 fluoroalkyl carboxylic acids or metal salts thereof, disodium perfluorooctanesulfonylglutamate, sodium-3-[omega-fluoroalkyl (C6 to C11) oxy]-1-alkyl (C3 to C4) sulfonate, sodium-3-[omega-fluoroalkanoyl (C6 to C8)-N-ethylamino]-1-propanesulfonate, fluoroalkyl (C11 to C20) carboxylic acids or metal salts thereof, perfluoroalkyl (C7 to C13) carboxylic acids or metal salts thereof, perfluoroalkyl (C4 to C12) sulfonic acid or metal salt thereof, perfluorooctanesulfonic acid diethanol amide, N-propyl-N-(2-hydroxyethyl)perfluorooctanesulfone amide, perfluoroalkyl (C6 to C10) sulfoneamidepropyltrimethylammonium salts, perfluoroalkyl (C6 to C10)-N-ethylsulfonyl glycin salts, and monoperfluoroalkyl (C6 to C16) ethylphosphate ester. Examples of commercially available surfactants having fluoroalkyl group include SURFLON S-111, S-112 and S-113 (manufactured by Asahi Glass Co., Ltd.); FRORARD FC-93, FC-95, FC-98 and FC-129 (manufactured by Sumitomo 3M Ltd.); UNIDYNE DS-101 and DS-102 (manufactured by Daikin Industries, Ltd.); MEGAFAC F-110, F-120, F-113, F-191, F-812 and F-833 (manufactured by Dainippon Ink and Chemicals, Inc.); EFTOP EF-102, 103, 104, 105, 112, 123A, 123B, 306A, 501, 201 and 204 (manufactured by Tohchem Products Co., Ltd.); FUTARGENT F-100 and F150 (manufactured by Neos Co., Ltd.).

Examples of the cationic surfactants include amine salt surfactants, quaternary ammonium salt surfactants, and cationic surfactants having fluoroalkyl group. Examples of the amine salt surfactants include alkyl amine salts, aminoalcohol fatty acid derivatives, polyamine fatty acid derivatives, and imidazoline. Examples of the quaternary ammonium salt surfactants include alkyltrimethyl ammonium salts, dialkyldimethyl ammonium salts, alkyldimethyl benzyl ammonium salts, pyridinium salts, alkyl isoquinolinium salts, and benzethonium chloride. Examples of the cationic surfactants having fluoroalkyl group include primary, secondary or tertiary aliphatic amine acids having fluoroalkyl group, aliphatic quaternary ammonium salts such as perfluoroalkyl (C6 to C10) sulfoneamidepropyl trimethylammonium salt, benzalkonium salts, benzetonium chloride, pyridinium salts, and imidazolinium salts.

Examples of commercially available cationic surfactants include SURFLON S-121 (manufactured by Asahi Glass Co., Ltd.), FRORARD FC-135 (manufactured by Sumitomo 3M Ltd.), UNIDYNE DS-202 (manufactured by Daikin Industries, Ltd.), MEGAFACK F-150 and F-824 (manufactured by Dainippon Ink and Chemicals, Inc.), EFTOP EF-132 (manufactured by Tohchem Products Co., Ltd.), and FUTARGENT F-300 (manufactured by Neos Co., Ltd.).

Examples of the nonionic surfactants include fatty acid amide derivatives, and polyol derivatives.

Examples of the ampholytic surfactants include alanine, dodecyldi(aminoethyl)glycin, di(octylaminoethyl)glycin, and N-alkyl-N,N-dimethylammonium betaine.

Examples of the water-insoluble inorganic dispersant include tricalcium phosphate, calcium carbonate, titanium oxide, colloidal silica, and hydroxyapatite.

Examples of the polymeric protective colloid include acids, (meth)acrylic monomers having hydroxyl group, vinyl alcohols or ethers thereof, esters of vinyl alcohol and compound having carboxyl group, amide compounds or methylol compounds thereof, chlorides, homopolymers or copolymers having nitrogen atom or heterocyclic rings thereof, polyoxyethylenes, and celluloses.

Examples of the acids include acrylic acid, methacrylic acid, α-cyanoacrylic acid, α-cyanomethacrylic acid, itaconic acid, crotonic acid, fumaric acid, maleic acid, and maleic anhydride.

Examples of the (meth)acrylic monomers having hydroxyl group include β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycol monoacrylic ester, diethyleneglycol monomethacrylic ester, glycerin monoacrylic ester, glycerin monomethacrylic ester, N-methylol acrylamido, and N-methylol methacrylamide.

Examples of the vinyl alcohols or ethers thereof include vinyl methyl ether, vinyl ethyl ether, and vinyl propyl ether.

Examples of the ethers of vinyl alcohol and compound having carboxyl group include vinyl acetate, vinyl propionate, and vinyl butyrate.

Examples of the amide compound or methylol compound thereof include acryl amide, methacrylic amide, and diacetone acrylic amide acid or methylol thereof.

Examples of the chlorides include acrylic chloride, and methacrylic chloride.

Examples of the homopolymers or copolymers having nitrogen atom or heterocyclic rings thereof include vinyl pyridine, vinyl pyrrolidone, vinyl imidazole, and ethylene imine.

Examples of the polyoxyethylenes include polyoxyethylene, polyoxypropylene, polyoxyethylene alkylamine, polyoxypropylene alkylamine, polyoxyethylene alkylamide, polyoxypropylene alkylamide, polyoxyethylene nonylphenylether, polyoxyethylene laurylphenylether, polyoxyethylene stearylphenyl ester, and polyoxyethylene nonylphenyl ester.

Examples of the celluloses include methyl cellulose, hydroxyethyl cellulose, and hydroxypropyl cellulose.

In the preparation of the dispersion, a dispersing stabilizer may be used as required. Examples of the dispersing stabilizer include an acid-soluble or alkali-soluble compound such as calcium phosphate salt.

When a modified polyester (prepolymer) reactive with an active hydrogen group-containing compound is included as a binder resin of the solution or dispersion, a catalyst for reaction may be used as necessary. Examples of the catalyst include dibutyltin laurate and dioctyltin laurate.

(3) Emulsification or Dispersion

In the emulsification or dispersion of the toner material solution or toner material dispersion, the solution or dispersion is preferably dispersed in the aqueous medium while stirring. The method for the dispersion is not particularly limited. Examples of equipment for dispersion include: batch type emulsifiers such as HOMOGENIZER (manufactured by IKA Co., Ltd.), POLYTRON (manufactured by Kinematica Co. Ltd.), and TK AUTO HOMO MIXER (manufactured by Primix Corp.); continuous emulsifiers such as EBARA MILDER (manufactured by Ebara Corp.), TK FILLMIX, TK PIPELINE HOMO MIXER (manufactured by Primix Corp.), COLLOID MILL (manufactured by Kobelco Eco-Solutions Co., Ltd.), SLASHER, TRIGONAL Wet-Type Mill (manufactured by Mitsui Miike Machinery Co., Ltd.), CAVITRON (manufactured by Eurotec Co., Ltd.), and FINE FLOW MILL (manufactured by Pacific Machinery & Engineering Co., Ltd.); high-pressure emulsifiers such as MICROFLUIDIZER (manufactured by Mizuho Industrial Co., Ltd.), NANOMIZER (manufactured by Nanomizer Co., Ltd.) and APV GORLIN (manufactured by Gaulin Co., Ltd.); membrane emulsifiers such as membrane emulsifier (manufactured by Reica Co., Ltd.); vibration emulsifiers such as VIBRO MIXER (manufactured by Reica Co., Ltd.); and ultrasonic emulsifiers such as ULTRASONIC HOMOGENIZER (manufactured by Branson Co., Ltd.). Among these, APV GAULIN, HOMOGENIZER, TK AUTO HOMO MIXER, EBARA MILDER, TK FILLMIX, and TK PIPELINE HOMO MIXER are preferably used for their capability of realizing uniform particle diameters.

(4) Removal of Solvent

The organic solvent is removed from emulsified slurry resulting from emulsification or dispersion. The removal of organic solvent is carried out, for example, by the following methods: (1) the temperature of the reaction system is gradually raised, and the organic solvent in the oil droplets are completely evaporated and removed; (2) emulsified dispersion is sprayed in a dry atmosphere and the water-insoluble organic solvent is completely evaporated and removed from the oil droplets to form fine toner particles, while aqueous dispersant being evaporated and removed simultaneously.

(5) Washing, Drying, and Classification

Once the organic solvent is removed, toner particles are formed. The toner particles are then subjected to, for example, washing and drying, then toner particles may be classified as necessary. The classification is, for example, carried out using a cyclone, decanter, or centrifugal separation thereby removing fine particles in the solution. Alternatively, the classification may be carried out after toner particles are produced in a form of powder after drying. In the case where a dispersing stabilizer such as an acid-soluble or alkali-soluble compound such as calcium phosphate is employed, the dispersing stabilizer is dissolved by action of an acid such as hydrochloric acid, and then washed with water to be removed from toner particles.

(6) External Addition of Charge Controlling Agent and Fine Inorganic Particles

The toner particles thus obtained are mixed with fine inorganic particles such as silica fine particles or titanium oxide fine particles, and a charge controlling agent as required, and mechanical impact is applied thereto, thereby preventing particles such as the releasing agent from falling off the surfaces of the toner particles.

Examples of the method of applying mechanical impact include a method in which impact is applied to the mixture by means of a blade rotating at high speed, and a method in which impact is applied by introducing the mixture into a high-speed flow to cause particles to collide with each other or to cause composite particles to collide against an impact board. Examples of a device employed for these method include ANGMILL (manufactured by Hosokawa micron Co., Ltd.), modified I-TYPE MILL (manufactured by Nippon Pneumatic Mfg. Co., Ltd.) to decrease pulverization air pressure, HYBRIDIZATION SYSTEM (manufactured by Nara Machinery Co., Ltd.), KRYPTRON SYSTEM (manufactured by Kawasaki Heavy Industries, Ltd.), and automatic mortars.

The physical properties such as the shape and size of the toner according to the present invention are not particularly limited and may be appropriately selected depending on the intended purpose. Preferably, the toner has, for example, the following volume average particle diameter (Dv), a ratio (Dv/Dn) of volume average particle diameter (Dv) to number average particle diameter (Dn), penetration, low-temperature fixing properties, and offset non-occurring temperature.

The volume average particle diameter (Dv) of the toner is, for example, preferably 3 μm to 8 μm. In the case where the volume average particle diameter is less than 3 μm, the toner of two-component developer is liable to fuse onto carrier surfaces as a result of stirring in the developing unit for a long-period, and the toner of one-component developer is liable to cause a filming to a developing roller or fusion to a member such as a blade for reducing a thickness of a toner layer formed onto a developing roller. In the case where the volume average particle diameter is more than 8 μm, an image of high resolution and high quality is rarely obtained, and the mean toner particle diameter may fluctuate very much after consumption and supply of toner.

The ratio (Dv/Dn) of the volume average particle diameter (Dv) to the number average particle diameter (Dn) is preferably 1.00 to 1.25.

In the case where the ratio (Dv/Dn) is less than 1.00, the toner of a two-component developer is liable to fuse onto carrier surfaces as a result of stirring in a developing unit for a long-period, thereby degrading a charging ability of the carrier or cleaning properties, and the toner of one-component developer is liable to cause a filming to a developing roller or fusion to a member such as a blade for reducing a thickness of a toner layer formed onto a developing roller. In the case where the ratio is more than 1.30, an image of high resolution and high quality is rarely obtained, and the mean toner particle diameter may fluctuate very much after consumption and supply of toner.

In the case where the ratio (Dv/Dn) of volume average particle diameter to number average particle diameter falls within a range of 1.00 to 1.25, the toner excels the following properties such as storage stability, low-temperature fixing properties, and hot offset resistance and, particularly, exhibits excellent image glossiness in the case where the toner is used in a full color copier. Thus, in the case of the toner of two-component developer, even when the toner is repeatedly consumed and supplied for a long-period, the mean toner particle diameter dose not fluctuate very much, and even if stirred for long-period in a developing unit, good and stable developing properties can be obtained. Further, in the case of the toner of one-component developer, there is not much fluctuation in particle diameter even when the toner is repeatedly consumed and supplied, there is no filming of the toners on a development roller or fusion of toners to a member such as a blade for reducing a thickness of a toner layer formed onto a developing roller, and even if used (stirred) for a long-period in a developing unit, good and stable developing properties and high quality images can be obtained.

The volume average particle diameter and the ratio (Dv/Dn) can be measured, for example, by means of a particle size analyzer, MULTISIZER II (manufactured by Beckmann Coulter Inc.).

The penetration is preferably 15 mm or more, more preferably 25 mm or more in accordance with a penetration test (JIS K2235-1991).

In the case where the penetration is less than 15 mm, it is liable to degrade heat resistance storage stability.

The penetration is measured in accordance with JIS K2235-1991. Specifically, the penetration is measured by filling a toner into a 50 mL glass container, leaving the glass container filled with the toner in a thermostat of 50° C. for 20 hours, sequentially cooling the toner to an ambient temperature, and then carrying out a penetration test thereto. The "penetration" in the present invention refers to a penetrated depth in mm. Note that, the higher the penetration is, the more the excellent heat resistance storage stability the toner has.

As the low-temperature fixing properties of the toner, the lowest fixing temperature is preferably as low as possible, and the offset non-occurring temperature is preferably as high as possible, in view of realizing both lower fixing temperature and prevention of occurrence of the offset. When the lowest fixing temperature is less than 145° C. and the offset non-occurring temperature is 180° C. or more, both the lower fixing temperature and prevention of offset are realized.

The lowest fixing temperature is determined as follows. A transfer sheet is set in an image-forming apparatus, a copy test is carried out, the thus obtained fixed image is scrubbed by pads, and the persistence of the image density is measured. The lowest fixing temperature is determined as a temperature at which the persistence of the image density becomes 70% or more.

The offset non-occurring temperature is measured as follows. A transfer sheet is set in an image-forming apparatus, and the image-forming apparatus is adjusted so as to develop a solid image in each color of yellow, magenta, cyan, and black, as well as intermediate colors of red, blue, and green, and so as to vary the temperature of a fixing belt. The offset non-occurring temperature is determined as the highest fixing temperature at which offset does not occur.

The coloration of the toner is not particularly limited and may be appropriately selected depending on the intended purpose. For example, the coloration may be a black toner, a cyan toner, a magenta toner or a yellow toner or any combination thereof. Each color toner is obtained by appropriately selecting the colorant to be contained therein.

Second Embodiment

The toner of the present invention is not particularly limited and may be appropriately selected depending on the intended purpose, so long as it contains the above-described binder resin. However, in a second embodiment, the toner preferably has one of the following structures (1) and (2);

(1) a structure where resin particles (A) each containing at least resin (a) are attached onto the surface of resin particles (B) each containing binder resin (b); and (2) a structure where a coating film (P) containing resin (a) is formed on the surface of resin particles (B) each containing binder resin (b).

In the toner according to a second embodiment of the present invention, the resin (a) is a polyester resin formed from polycarboxylic acid and polyol and the resin (b) is the above-described binder resin.

In electrophotographic toners, there are high needs of toners having excellent low-temperature fixing property for achieving energy saving. Under such circumstances, it is desired to decrease the fixing temperature of an electrophotographic toner. Toners designed to be superior in low-temperature fixing property newly have a problem of heat resistant storageability. Specifically, since a constant pressure is often applied to toners during transportation of the toners or toner-containing cartridges, deformation of the toner due to pressure in a high-temperature, high-humidity environment is unavoidable simply by modifying the surface of the toner particles to be increased in glass transition temperature.

The above problem is also seen in a binder resin using polylactic acid, and there is a need to improve a toner in low-temperature fixability, heat-resistant storageability, and durability to stress applied during long-term stirring. Hitherto, there has been proposed a method of covering a toner surface with fine resin particles or a coating film formed from a polyester resin, to thereby impart hot offset resistance and environmental stability to the toner without degrading the low-temperature fixability of a binder resin (see JP-A No. 2011-13245). However, the strength of base particles themselves is not sufficient.

There have not been provided a polylactic acid-containing toner excellent in strength, image density, haze, fixability, heat resistance storage stability, environmental stability, less change in fixability over time and low-temperature fixability; and relavent technologies. Thus, at present, demand has arisen for further improvement and development.

The toner of a second embodiment of the present invention having the above-described structure is excellent in hot offset resistance and low-temperature fixing property and can form images superior in image density, haze and environmental stability without causing sticking during long-term storage at high temperatures or background smear, filming or toner scattering.

<Resin (a)>

Intrinsically, the polyester resin (a) cannot be dispersed or dissolved in water by itself; i.e., the polyester resin (a) is essentially insoluble in water. It is substantially synthesized from polycarboxylic acid and polyol. Next will be described the constituent components that form the polyester resin (a).

—Polycarboxylic Acid—

The polycarboxylic acid is not particularly limited and may be appropriately selected depending on the intended purpose. Examples thereof include aromatic dicarboxylic acids, aliphatic dicarboxylic acids and alicyclic dicarboxylic acids.

Examples of the aromatic dicarboxylic acids include terephthalic acid, isophthalic acid, orthophthalic acid, naphthalenedicarboxylic acid and biphenyldicarboxylic acid. If necessary, a small amount of sodium 5-sulfoisophthalic acid or 5-hydroxyisophthalic acid may be used in addition, provided that water resistance is not impaired.

Examples of the aliphatic dicarboxylic acids include saturated dicarboxylic acids such as oxalic acid, succinic acid, succinic anhydride, adipic acid, azelaic acid, sebacic acid, dodecanedioic acid and hydrogenated dimer acid; and unsaturated dicarboxylic acids such as fumaric acid, maleic acid, maleic anhydride, itaconic acid, itaconic acid anhydride, citraconic acid, citraconic anhydride and dimer acid.

Examples of the alicyclic dicarboxylic acids include 1,4-cyclohexanedicarboxylic acid, 1,3-cyclohexanedicarboxylic acid, 1,2-cyclohexanedicarboxylic acid, 2,5-norbornenedicarboxylic acid (anhydride) and tetrahydrophthalic acid (anhydride).

The total amount of the aromatic polycarboxylic acids relative to the entire polycarboxylic acid components is preferably 50 mol % or higher. When this amount is less than 50 mol %, the structure derived from aliphatic and alicyclic polycarboxylic acids accounts for the resin skeleton in an amount more than the half thereof. Thus, the formed coating film tends to be decreased in hardness, contamination resistance and water proofness. Also, an aqueous dispersion of the resin may be decreased in storage stability since aliphatic and/or alicyclic ester bonds are poorer than aromatic ester bonds in hydrolyzation resistance. In order to ensure the storage stability of the aqueous dispersion, the total amount of the aromatic polycarboxylic acids relative to the entire polycarboxylic acid components is preferably 70 mol % or higher. Particularly preferably, terephthalic acid accounts for 65 mol % or more of the entire polycarboxylic acid components constituting the polyester resin for achieving the objects of the present invention, since the formed coating film can be improved in processability, water proofness, chemical resistance and weatherability while maintaining a balance between these properties and other properties.

—Polyol—

The polyol is not particularly limited and may be appropriately selected depending on the intended purpose. Examples thereof include glycols such as C2-C10 aliphatic glycols, C6-C12 alicyclic glycols and ether bond-containing glycols.

Examples of the C2-C10 aliphatic glycols include ethylene glycol, 1,2-propylene glycol, 1,3-propanediol, 1,4-butanediol, 2-methyl-1,3-propanediol, 1,5-pentanediol, neopentyl glycol, 1,6-hexanediol, 3-methyl-1,5-pentanediol, 1,9-nonanediol and 2-ethyl-2-butylpropanediol.

Examples of the C6-C12 alicyclic glycols include 1,4-cyclohexanedimethanol.

Examples of the ether bond-containing glycols include diethylene glycol, triethylene glycol, dipropylene glycol, and glycols which are each obtained by adding one to several moles of ethylene oxide or propylene oxide to two phenolic hydroxyl groups of a bisphenol, such as 2,2-bis(4-hydroxyethoxyphenyl)propane.

If necessary, polyethylene glycol, polypropylene glycol or polytetramethylene glycol may also be used as the polyol; it should, however, be noted that it preferably occupies 10% by mass or less, more preferably 5% by mass or less, of the total polyol content, since an ether structure degrades the water resistance and weatherability of a polyester resin coating.

In the present invention, preferably, ethylene glycol and/or neopentyl glycol accounts for 50 mol % or more, especially 65 mol % or more, of the entire polyol components of the polyester resin. Ethylene glycol and neopentyl glycol are mass-produced on an industrial basis and thus are inexpensive. They also strike a balance between properties of the coating film formed. Specifically, the ethylene glycol component improves chemical resistance among others and the neopentyl glycol component improves weatherability among others.

The polyester resin used as the resin (a) may be synthesized, if necessary through copolymerization with a trifunctional or higher polycarboxylic acid and/or a trifunctional or higher polyol.

Examples of the trifunctional or higher polycarboxylic acid include trimellitic acid, trimellitic anhydride, pyromellitic acid, pyromellitic anhydride, benzophenonetetracarboxylic acid, benzophenonetetracarboxylic anhydride, trimesic acid, ethylene glycol bis(anhydro trimellitate), glycerol tris(anhydro trimellitate) and 1,2,3,4-butanetetracarboxylic acid.

Examples of the trifunctional or higher polyol include glycerin, trimethylolethane, trimethylolpropane and pentaerythritol.

The trifunctional or higher polycarboxylic acid and/or the trifunctional or higher polyol are/is copolymerized such that (when one of them is used) its amount occupies 10 mol % or less, preferably 5 mol % or less, of all acid/alcohol components, and (when both of them are used) their amounts occupy 10 mol % or less, preferably 5 mol % or less, of all acid and alcohol components respectively. When they/it occupy/occupies more than 10 mol %, high processability, which is an advantage of a polyester resin, cannot be fully exhibited.

Further, if necessary, any of the following may also be used as components as the resin (a): fatty acids such as lauric acid, myristic acid, palmitic acid, stearic acid, oleic acid, linoleic acid and linolenic acid, and ester-forming derivatives thereof, high-boiling-point monocarboxylic acids such as benzoic acid, p-tert butylbenzoic acid, cyclohexane acid and 4-hydroxyphenyl stearic acid; high-boiling-point monoalcohols such as stearyl alcohol and 2-phenoxyethanol; and hydroxy carboxylic acids such as ϵ-caprolactone, lactic acid, β-hydroxybutyric acid and p-hydroxybenzoic acid, and ester-forming derivatives thereof.

The acid value of the resin (a) is preferably 10 mgKOH/g to 40 mgKOH/g, more preferably 10 mgKOH/g to 35 mgKOH/g. When the acid value thereof is more than 40 mgKOH/g, the formed coating film may be poor in waterproofness. When the acid value thereof is less than 10 mgKOH/g, the amount of the carboxyl group imparting hydrophilicity to the coating film is not sufficient, and as a result a stable aqueous dispersion cannot be obtained in many cases.

Also, the resin (a) preferably has a weight average molecular weight of 9,000 or higher as measured through GPC (gel permeation chromatography, on the polystyrene basis) or the resin (a) preferably has a relative viscosity of 1.20 or more as measured at 20° C. using a solution of 1% by mass of the resin (a) dissolved in a solvent mixture of phenol and 1,1,2,2-tetrachloroethane in an equiamount by mass.

When the weight average molecular weight is lower than 9,000 or the relative viscosity is less than 1.20, a coating film having satisfactory processability cannot be obtained from an aqueous dispersion of the polyester resin in some cases. Furthermore, the weight average molecular weight of the polyester resin is preferably 12,000 or higher, particularly preferably 15,000 or higher. The upper limit of the weight average molecular weight thereof is preferably 45,000 or lower. When the weight average molecular weight is higher than 45,000, the producibility of the polyester resin may degrade. In addition, an aqueous dispersion containing such a polyester resin tends to be too high in viscosity. The relative viscosity of the polyester resin is preferably 1.22 or more, more preferably 1.24 or more. The upper limit of the relative viscosity thereof is preferably 1.95 or less. When the relative viscosity thereof is more than this upper limit, the producibility of the polyester resin may degrade. In addition, an aqueous dispersion containing such a polyester resin tends to be too high in viscosity.

The resin (a) is synthesized from the above-listed monomers by a known method. Examples of the method for synthesizing the resin (a) include: (a) a method where all of the monomer components and/or oligomers thereof are esterified in an inert atmosphere at 180° C. to 250° C. for about 2.5 hours to about 10 hours, and then are subjected to polycondensation reaction in the presence of a catalyst at a reduced pressure of 1 Torr or lower at 220° C. to 280° C. until the melt viscosity of the resultant resin reaches a desired melt viscosity, to thereby produce a polyester resin; (b) a method which is the same as the method (a) except that the polycondensation reaction is terminated before the melt viscosity of the resultant resin reaches a target melt viscosity, and the reaction product is mixed at the next step with a chain extending agent selected from a polyfunctional epoxy compound, isocyanate compound and oxazolin compound, followed by reaction for a short time to increase the molecular weight; and (c) a method which is the same as the method (a) except that the polycondensation reaction is allowed to proceed until the melt viscosity of the resultant resin exceeds a target melt viscosity, and then monomer components are further added to the reaction system, followed by depolymerization in an inert atmosphere under normal to pressurized system to thereby produce a polyester resin having a target melt viscosity.

The carboxyl group required for hydrophilicity is preferably localized at the ends of the resin molecular chain rather than being located inside the resin skeleton, from the viewpoint of waterproofness of the formed coating film. Preferred examples of the method of introducing a specific amount of carboxyl groups into the ends of the molecular chain of a high-molecular-amount polyester resin without causing side reaction or gelling reaction include: a method which is the same as the above method (a) except that trifunctional or higher polycarboxylic acid components are added after the initiation of the polycondensation reaction or polycarboxylic acid anhydrides are added immidiately before the termination of the polycondensation reaction; a method which is the same as the above method (b) except that a low-molecular-weight polyester resin where most of the ends of the molecular chain are carboxyl groups is increased in molecular weight using the chaing extending agent; and a method which is the same as the above method (c) except that a polycarboxylic acid component is used as a depolymerizing agent.

The amount of the polyester resin contained in the polyester resin aqueous dispersion may be appropriately selected depending on the applications, the film thickness after drying, and the molding method, but is generally 0.5% by mass to 50% by mass, preferably 1% by mass to 40% by mass. As described below, the polyester resin aqueous dispersion in the present invention has an advantage that its storage stability is excellent even when the amount of the polyester resin is 20% by mass or higher, which is a high solid content concentration. However, when the amount of the polyester resin is higher than 50% by mass, the viscosity of the aqueous dispersion of the polyester resin is considerably high, it may be substantially difficult to perform molding.

[Basic Compound (i.e., Compound Having Basicity)]

When dispersed in an aqueous medium, the polyester resin of the resin (a) is neutralized with a basic compound. In the present invention, the neutralization reaction between the basic compound and the carboxyl group in the polyester resin causes hydrophilication (formation of fine resin particles). In addition, electrical repulsion between the formed carboxy anions can prevent aggregation between the fine particles by using in combination a trace amount of the below-described compound that behaves as protective colloids. The basic compound is preferably a compound that evaporates during formation of the coating film or during bake-curing with a curing agent. Examples of such a basic compound include ammonia and organic amine compounds each having a boiling point of 250° C. or lower.

Examples of the organic amine compounds include triethylamine, N, N-diethylethanolamine, N,N-dimethylethanolamine, aminoethanolamine, N-methyl-N,N-diethanolamine, isopropylamine, iminobispropylamine, ethylamine, diethylamine, 3-ethoxypropylamine, 3-diethylaminopropylamine, sec-butylamine, propylamine, methylaminopropylamine, dimethylaminopropylamine, methyliminobispropylamine, 3-methoxypropylamine, monoethanolamine, diethanolamine, triethanolamine, morpholine, N-methylmorpholine and N-ethylmorpholine. Depending on the carboxyl group contained in the polyester resin, the basic compound is added in such an amount as to neutralize the carboxyl group at least partially; i.e., the basic compound is added preferably in an equivalent amount of 0.2 times to 1.5 times the carboxyl group, more preferably 0.4 times to 1.3 times the carboxyl group. When the amount of the basic compound is less than the equivalent amount of 0.2 times the carboxyl group, the effects of the basic compound added cannot be obtained. When it is more than the equivalent amount of 1.5 times the carboxyl group, the polyester resin aqueous dispersion may considerably be thickened.

[Amphiphilic Organic Solvent]

In the present invention, it is necessary to use at the hydrophilication step an amphiphilic organic compound having an ability to plasticize the polyester resin in order to accelerate the speed of hydrophilication. The amphiphilic organic compound used is a commonly used compound called an organic solvent, which has a boiling point of 250° C. or lower and has low toxicity, explosibility and flammability. This is because a compound having a boiling point of 250° C. or higher is so low in evaporation speed that such a compound cannot sufficiently be removed upon drying of the coating film.

The properties required for the organic solvent in the present invention are an amphiphilic property and an ability to plasticize the polyester resin. Here, the amphiphilic organic solvent refers to an organic solvent having solubility to water at 20° C. which is at least 5 g/L or higher, preferably 10 g/L or higher. The amphiphilic organic solvent having the solubility of less than 5 g/L is poor in effect of accelerating the speed of hydrophilication. The plasticizing ability of an organic solvent can be judged with the following simple, convenient test. Specifically, a polyester resin of interest is used to form a square plate of 3 cm×3 cm×0.5 cm (thickness), and the formed plate is immersed in 50 mL of an organic solvent and left to stand still at 25° C. to 30° C. Then, the organic solvent is judged as having an ability to plasticize the polyester resin when the square plate is clearly deformed 3 hours after the immersion or when a stainless steel rod 0.2 cm in diameter is brought into contact with the square plate at 1 kg/cm$^2$ statically applied in the thickness direction and the stainless steel rod enters the square plate by a length of 0.3 cm or greater. The organic solvent judged as not having plasticizing ability is poor in effect of accelerating the speed of hydrophilication.

Examples of the organic solvent include: alcohols such as ethanol, n-propanol, isopropanol, n-butanol, isobutanol, sec-butanol, tert-butanol, n-amylalcohol, isoamylalcohol, sec-amylalcohol, tert-amylalcohol, 1-ethyl-1-propanol, 2-methyl-1-propanol, n-hexanol and cyclohexanol; ketones such as methyl ethyl ketone, methyl isobutyl ketone, ethyl butyl ketone, cyclohexanone and isophoron; ethers such as tetrahydrofuran and dioxane; esters such as ethyl acetate, n-propyl acetate, isopropyl acetate, n-butyl acetate, isobutyl acetate, sec-butyl acetate, 3-methoxybutyl acetate, methyl propionate, ethyl propionate, diethyl carbonate and dimethyl carbonate; glycol derivatives such as ethylene glycol, ethylene glycol monomethyl ether, ethylene glycol monoethyl ether, ethylene glycol monobutyl ether, ethylene glycol ethylether acetate, diethylene glycol, diethylene glycol monomethyl ether, diethylene glycol monoethyl ether, diethylene glycol monobutyl ether, diethylene glycol ethylether acetate, propylene glycol, propylene glycol monomethyl ether, propylene glycol monobutyl ether and propylene glycol methylether acetate; and 3-methoxyl-3-methylbutanol, 3-methoxylbutanol, acetonitrile, dimethylformamide, dimethylacetamide, diacetone alcohol and ethyl acetoacetate. These organic solvents may be used alone or in combination.

Using alone or in combination the above-listed organic solvents that satisfy the following two conditions is preferred since the effect of accelerating the speed of hydrophilication is particularly excellent and also an aqueous dispersion of the formed polyester resin is excellent in storage stability:

Condition 1; the molecule has a hydrophobic structure formed of four or more carbon atoms directly bonded together; and Condition 2: the molecule has at the ends a polar substituent containing one or more atoms each having a Pauling electronegativity of 3.0 or higher, in which substituent the $^{13}$C-NMR (nuclear magnetic resonance) spectrum chemical shift of the carbon atom directly bonded with the atom having an electronegativity of 3.0 or higher is 50 ppm or more as measured in $CDCl_3$ at room temperature.

Examples of the substituent that satisfies the above Condition 2 include alcoholic hydroxyl groups, methyl ether groups, ketone groups, acetyl groups and methyl ester groups. Particularly preferred examples of the compound serving as the organic solvent that satisfies the above two conditions include: alcohols such as n-butanol, isobutanol, sec-butanol, tert-butanol, n-amylalcohol, isoamylalcohol, sec-amylalcohol, tert-amylalcohol, n-hexanol and cyclohexanol; ketones such as methyl isobutyl ketone and cyclohexanone; esters such n-butyl acetate, isobutyl aceate, sec-butyl acetate and 3-methoxybutyl acetate; glycol derivatives such as ethylene glycol monobutyl ether, diethylene glycol monobutyl ether and propylene glycol monobutyl ether; and 3-methoxyl-3-methylbutanol and 3-methoxyl butanol.

When such organic solvents have a boiling point of 100° C. or lower or can be co-boiled with water, part or all of them can be removed to the outside from the reaction system (i.e., stripping) at the hydroliphication step or the subsequent steps. Finally, the amount of the organic solvent contained in the polyester resin aqueous dispersion is preferably 0.5% by mass to 10% by mass, more preferably 0.5% by mass to 8.0% by mass, still more preferably 1.0% by mass to 5.0% by mass. The polyester resin aqueous dispersion containing the organic solvent in an amount of 0.5% by mass to 10% by mass is excellent in storage stability and also in coating film formability. When the amount thereof is less than 0.5% by mass, it takes a long time to complete satisfactory hydroliphication. In addition, there is a problem that polyester resin particles having a desired particle size distribution are formed. When it is more than 10% by mass, the organic solvent impedes the hydroliphication. Furthermore, since the rate of secondary particles present in the below-described aqueous dispersion is high, there may be the following failures: the viscosity of the aqueous dispersion becomes considerably high; and the aqueous dispersion is degraded in storage stability and coating film formability.

[Compound that Behaves as Protective Colloids]

In the present invention, if necessary, a compound that behaves protective colloids is used for the purpose of ensuring stability of the aqueous dispersion during storage or the step of removing the organic solvent to the outside (i.e., stripping). The protective colloids in the present invention refer to compounds having an effect of adsorbing the surfaces of fine resin particles in an aqueous medium to exhibit stabilization effects, called "mixing effect," "osmotic effect" and "volume restriction effect," to thereby prevent adsorption between the fine resin particles. Examples of the compound that behaves as protective colloids include polyvinyl alcohol, carboxymethyl cellulose, hydroxyethyl cellulose, hydroxypropyl cellulose, modified starch, polyvinylpyrrolidone, polyacrylic acid, a polymer of a vinyl monomer containing acrylic acid and/or methacrylic acid as one component, polyitaconic acid, gelatin, gum arabic, casein and swellable mica. Such compounds become water soluble by being partially neutralized with an aueous or basic compound. In order to avoid degradation in waterproofness of the coating film formed, the basic compound must be ammonia and/or the above-listed organic amine compound. Also, the compound that behaves as protective colloids preferably has a number average molecular weight of 1,500 or higher, more preferably 2,000 or higher, still more preferably 2,500 or higher, since it can exhibit the effects as protective colloids in a small amount and the coating film formed is not degraded in waterproofness and chemical resistance.

The amount of the compound that behaves as the protective colloids is preferably 0.01% by mass to 3% by mass, more preferably 0.03% by mass to 2% by mass, relative to the amount of the polyester resin. When the amount thereof is in the above range, it can remarkably improve stability of the polyester resin aqueous dispersion at the hydrophilication step and during storage without degrading properties of the coating film formed. Also, use of the compound that behaves as the protective colloids can reduce the acid value of the polyester resin and the amount of the organic solvent contained. The amount of the compound that behaves as the protective colloids is 0.05% by mass, preferably 0.03% by mass or less, relative to the amount of the resin (a). When the amount thereof is 0.05% by mass or less, it can remarkably improve stability of the polyester resin aqueous dispersion at the hydrophilication step and during storage without degrading properties of the coating film formed.

The toner according to the above-described second embodiment can be produced by any method so long as the toner has a structure where resin particles (A) each containing resin (a) are attached onto the surface of resin particles (B) each containing binder resin (b); or a structure where a coating film (P) containing resin (a) is formed on the surface of resin particles (B) each containing binder resin (b); or combination thereof.

The toner according to the second embodiment may be resin particles produced by any method and any process. Examples of the method include Production Methods (I) and (II) below.

(I) A method of mixing an aqueous dispersion liquid (W) of the resin particles (A) which contains the resin (a) with [the binder resin (b), or a organic solvent solution or dispersion liquid thereof] (hereinafter referred to as (O)), dispersing (O) in (W), and thus forming the resin particles (B) which contains (b) in (W).

In this case, the resin particle (A) or the coating film (P) is attached to the surface of (B) simultaneously with the formation of (B) so as to form an aqueous dispersion (X) of the toner, then an aqueous medium is removed from this aqueous dispersion (X), and toner is thus produced.

(II) A method in which the resin particle (B) which contains the previously produced resin (b) is coated with a coating agent (W) which contains the resin (a) so as to produce the toner.

In this case, the coating agent (W') may be in any form such as liquid form or solid form. The resin particles (B) which contains the previously produced resin (b) may be coated with a precursor (a') of the resin (a), and then (a') may be reacted to yield the resin (a). Also, the resin particles (B) may be produced by any method and may, for example, be resin particles produced by means of, for example, emulsion polymerization aggregation or a resin particle produced by means of pulverization. The method of the coating is not particularly limited, and examples thereof include a method of dispersing the resin particles (B) or a dispersion of the resin particles (B), which has been previously produced, in an aqueous dispersion liquid (W) of the resin particles (A) which contains the resin (a), and a method of applying a solution of the resin (a) as a coating agent over (B). Among them, Production Method (I) is preferable.

The above toner is more preferably produced by the following production method since it becomes resin particles having a uniform particle diameter. Specifically, the method includes: mixing an aqueous dispersion liquid (W) of the resin particles (A) with (O) (binder resin (b), or a organic solvent solution or dispersion liquid thereof); and dispersing the (O) in the aqueous dispersion liquid (W) to form the resin particles (B) each containing the resin (b) as well as to adsorb the resin particles (A) onto the surfaces of the resin particles (B), to thereby obtain a toner. With this method, unification among the toner can be prevented, and the toner can be made less dividable under high shearing conditions. This makes it possible to converge the particle size of the toner to a definite value, and thus to perform a function of forming uniform particles.

Examples of preferred properties of the resin particles (A) include the following (i) to (iii): (i) that the resin particles (A) have strength to such an extent that they are not broken by shearing at the temperature at which dispersion takes place; (ii) that the resin particles (A) do not easily swell or dissolve in water; and (iii) that the resin particles (A) do not easily dissolve in the binder resin (b), or an organic solvent solution thereof or a dispersion liquid thereof.

The toner components such as a colorant, a releasing agent, and a layered inorganic mineral are encapsulated in the resin particle (B). Accordingly, before (W) is mixed with (O), the toner components may be dispersed in the solution of (O). The charge controlling agent may be encapsulated in or externally added to the resin particle (B). In the case were the charge controlling agent is encapsulated in the resin particle (B), it is advisable to disperse the charge controlling agent in the solution of (O) along with, for example, the colorant. In the case where the charge controlling agent is externally added to the resin particle (B), the charge controlling agent may be externally added after the formation of the toner.

It is preferred that, for example, the molecular weights, sp values (the sp values are calculated in accordance with Polymer Engineering and Science, February, 1974, VoL 14, No. 2P, 147 to 154), crystallinity, molecular weights between cross-linking points of the resin (a) be appropriately adjusted to reduce the swelling and dissolution of the resin particles (A) in a solvent (used at the time of dispersion) and water.

In the present invention, the number average molecular weight (Mn) and the weight average molecular weight (Mw) of resins such as polyester resins are measured by means of gel permeation chromatography (GPC) under the following conditions, with respect to those soluble in tetrahydrofuran (THF).

Apparatus (example): HLC-8120, manufactured by TOSOH CORPORATION

Column (example): TSKgel GMHXL (two columns) :TSKgel Multipore HXL-M (one column)

Sample solution: 0.25% THF solution

Amount of solution injected: 100 μL

Flow amount: 1 mL/min

Measurement temperature: 40° C.

Detection apparatus: refractive index detector

Reference substance: 12 standard polystyrenes, manufactured by TOSOH CORPORATION (TSK STANDARD POLYSTYRENE) (molecular weight: 500, 1,050, 2,800, 5,970, 9,100, 18,100, 37,900, 96,400, 190,000, 355,000, 1,090,000 and 2,890,000)

The glass transition temperature (Tg) of the resin (a) is preferably 50° C. to 100° C., more preferably 51° C. to 90° C., particularly preferably 52° C. to 75° C. from the viewpoints of uniformity in particle diameter of the formed toner, flowability as powder, heat resistance during storage and stress resistance. When the Tg thereof is lower than a temperature at which the resin aqueous dispersion is prepared, the effects of preventing aggregation and splitting are lowered to thereby lower the effect of improving the uniformity in particle diameter. For the same reasons as described above, the Tg of the resin particles (A) each containing the resin (a) or the coating film (P) containing the resin (a) is preferably 20° C. to 200° C., more preferably 30° C. to 100° C., particularly preferably 40° C. to 85° C. In the present invention, the Tg is calculated from DSC measurement, or measurement with a flow tester (in the case where DSC measurement is impossible).

In the case of DSC measurement, the melting point and the Tg are measured by the method (DSC method) prescribed in ASTM D3418-82, using DSC 20 and SSC/580, manufactured by Seiko Instruments & Electronics Ltd. In the case of measurement with a flow tester, the elevated flow tester CFT 500, manufactured by SHIMADZU CORPORATION. The conditions under which the flow tester is used are as follows. The after-mentioned measurements with the flow tester are all carried out under the conditions below.

(Conditions for Measurement with Flow Tester)

Load: 30 kg/cm$^2$

Temperature increase rate: 3.0° C./min

Die diameter: 0.50 mm

Die length: 10.0 mm

The glass transition temperature (Tg) of the resin (a) can easily be adjusted by modifying the molecular weight of the resin (a) and/or the monomer composition of the resin (a). The method for adjusting the molecular weight of the resin (a) may be a known method (here, the greater the molecular weight becomes, the higher the Tg becomes). For example, when polymerization is performed through step reaction as in the case of producing a polyester resin, the compositional ratio of starting monomers may be adjusted to adjust the glass transition temperature (Tg) of the resin (a).

Besides water, an organic solvent (for example, acetone, methyl ethyl ketone) which is miscible with water, among any of the after-mentioned examples of the organic solvent (u), may be contained in the aqueous dispersion liquid (W) of the resin particles (A). The organic solvent contained is not particularly limited as long as it does not cause aggregation of the resin particles (A), it does not dissolve the resin particles (A), and it does not hinder formation of the toner. The amount of the organic solvent is not particularly limited either, as long as the foregoing requirements are satisfied. Use of such an organic solvent which occupies 40% by mass or less of the total amount of water and the organic solvent and which does not remain in the dried toner is preferable.

An organic solvent (u) used in the present invention may if necessary be added into an aqueous medium or an emulsified dispersion [an oil phase (O) which contains the resin (b)] at the time of emulsification dispersion. Examples of the organic solvent (u) include aromatic hydrocarbon solvents such as toluene, xylene, ethyl benzene and tetralin; aliphatic or alicyclic hydrocarbon solvents such as n-hexane, n-heptane, mineral spirits and cyclohexane; halogen solvents such as methyl chloride, methyl bromide, methyl iodide, methylene dichloride, carbon tetrachloride, trichloroethylene and perchloroethylene; ester or ester ether solvents such as ethyl acetate, butyl acetate, methoxybutyl acetate, methyl cellosolve acetate and ethyl cellosolve acetate; ether solvents such as diethyl ether, tetrahydrofuran dioxane, ethyl cellosolve, butyl cellosolve and propylene glycol monomethyl ether; ketone solvents such as acetone, methyl ethyl ketone, methyl isobutyl ketone, di-n-butyl ketone and cyclohexanone; alcohol solvents such as methanol, ethanol, n-propanol, isopropanol, n-butanol, isobutanol, t-butanol, 2-ethylhexyl alcohol and benzyl alcohol; amide solvents such as dimethylformamide and dimethylacetamide; sulfoxide solvents such as dimethyl sulfoxide; heterocyclic compound solvents such as N-methylpyrrolidone; and mixed solvents which are each composed of two or more of these solvents.

A plasticizer (v) may if necessary be added into the aqueous medium or the emulsified dispersion [the oil phase (O) which contains the resin (b)] at the time of emulsification dispersion. The plasticizer (v) is not particularly limited. Examples of the plasticizer include the following:

(v1) Phthalic acid esters [such as dibutyl phthalate, dioctyl phthalate, butyl benzyl phthalate and diisodecyl phthalate];

(v2) Aliphatic dibasic acid esters [such as di-2-ethylhexyl adipate and 2-ethylhexyl sebacate];

(v3) Trimellitic acid esters [such as tri-2-ethylhexyl trimellitate and trioctyl trimellitate];

(v4) Phosphoric acid esters [such as triethyl phosphate, tri-2-ethylhexyl phosphate and tricresol phosphate];

(v5) Fatty acid esters [such as butyl oleate];

(v6) Mixtures which are each composed of two or more of the (v1) to (v5).

The particle diameter of the resin particles (A) is generally smaller than that of the formed resin particles (B). From the viewpoint of uniformity of the particle diameter, the ratio of [volume average particle diameter of the resin particles (A)]/[volume average particle diameter of the resin particles (B)] is preferably 0.001 to 0.3. The lower limit of this ratio is more preferably 0.003, and the upper limit thereof is more preferably 0.25. When the above ratio is greater than 0.3, the resin particles (A) are not efficiently adsorbed onto the surfaces of the resin particles (B), and the particle size distribution of the obtained toner tends to become broad.

The volume average particle diameter of the resin particles (A) may be appropriately adjusted with the above-mentioned range of the particle diameter ratio maintained, such that their particle diameters are suitable for obtaining the toner having the desired particle diameter. In general, the volume average particle diameters of (A) are preferably in the range of 0.0005 μm to 1 μm. The upper limit of the volume average particle diameters is more preferably 0.75 μm, particularly preferably 0.5 μm. The lower limit of the volume average particle diameters is more preferably 0.01 μm, particularly preferably 0.02 μm, most preferably 0.04 μm. In the case where the toner with a volume average particle diameter of 1 μm is to be obtained, the volume average particle diameters of (A) are preferably in the range of 0.0005 μm to 0.30 μm, particularly preferably 0.001 μm to 0.2 μm. In the case where the toner with a volume average particle diameter of 10 μm is to be obtained, the volume average particle diameters of the (A) are preferably in the range of 0.005 μm to 0.8 μm, particularly preferably 0.05 μm to 1 μm. Parenthetically, the volume average particle diameters can, for example, be measured by the laser particle size distribution measuring apparatus LA-920 (manufactured by HORIBA, Ltd.), MULTISIZER III (manufactured by Beckman Coulter, Inc.), or ELS-800 (manufactured by Otsuka Electronics Co., Ltd.) which employs a laser Doppler method for an optical system. In case there are differences between these measuring apparatuses in terms of obtained measurement values of particle diameters, the measurement value obtained using ELS-800 is employed. From the viewpoint of easily obtaining the above ratio of the particle diameters, the volume average particle diameter of the below-described resin particles (B) is preferably 0.1 μm to 15 μm, further preferably 0.5 μm to 10 μm, particularly preferably 1 μm to 8 μm.

The amount of the aqueous dispersion liquid (W) used is preferably 50 parts by mass to 2,000 parts by mass, more preferably 100 parts by mass to 1,000 parts by mass, per 100 parts by mass of the binder resin (b). When it is 50 parts by mass or more, the dispersion state of the binder resin (b) is excellent. When it is 2,000 parts by mass or less, it is economical.

The toner is obtained through a process including: mixing the aqueous dispersion liquid (W) of the resin particles (A) each containing the resin (a) with the binder resin (b) or an organic solvent solution or dispersion liquid (O) thereof so that the (O) is dispersed in the (W), to thereby obtain an aqueous resin dispersion (X) of toner particles each having a structure where the resin (a) is attached onto the surface of the resin particles (B) each containing the binder resin (b); and removing the aqueous medium from the aqueous resin dispersion (X). The resin (a) may be attached onto the surface of the resin particles (B) in the form of resin particles (A) or coating film (P). Whether the resin (a) is in the form of (A) or (P) depends on the Tg of the resin (a) and the production conditions for toner (e.g., desolvation temperature).

As to how to control the shape of the toner particles obtained by Production Method (I), it is possible to control the particle shape and the particle surface properties by controlling the differences in sp value between the resin (a) and the binder resin (b), and/or the molecular weights of the resin (a). When the differences in sp value are small, a particle with a distorted shape and a smooth surface tends to be obtained. When the differences in sp value are large, a spherical particle with a rough surface tends to be obtained. When the molecular weights of the resin (a) are large, a particle with a rough surface tends to be obtained. When the molecular weights of the resin (a) are small, a particle with a smooth surface tends to be obtained. It should, however, be noted that when the differences in sp value between the resin (a) and the binder resin (b) is too small or too large, particle formation becomes difficult. Also, when the molecular weights of the resin (a) are too small, particle formation becomes difficult as well. Thus, the differences in sp value between the resin (a) and the binder resin (b) are preferably in the range of 0.01 to 5.0, more preferably 0.1 to 3.0, even more preferably 0.2 to 2.0.

In Production Method (II), the shape of the toner particles is greatly affected by the shape of the previously prepared resin particle (B), and the toner particles has much the same shape as the resin particle (B). It should, however, be noted that when the resin particle (B) has a distorted shape, use of a large amount of the coating agent (W') in Production Method (II) enables the resin particle to have a spherical shape.

In the present invention, in view of the particle diameter uniformity and storage stability of the toner particles, it is preferred that the amount of the resin particles (A) which contains the resin (a) or the coating film (P) which contains the resin (a), contained in the toner, be in the range of 0.01% by mass to 60% by mass, and the amount of the resin particles (B) which contains the binder resin (b), contained in the toner, be in the range of 40% by mass to 99.99% by mass. It is more preferred that the amount of the resin particles (A) or the coating film (P) be in the range of 0.1% by mass to 50% by mass, and the amount of the resin particle (B) be in the range of 50% by mass to 99.9% by mass. It is particularly preferred that the amount of the resin particles (A) or the coating film (P) be in the range of 1% by mass to 45% by mass, and the amount of the resin particle (B) be in the range of 55% by mass to 99% by mass. When the amount of the resin particles (A) or the coating film (P) is 0.01% by mass or greater, favorable blocking resistance can be obtained. When the amount of the resin particles (A) or the coating film (P) is 60% by mass or less, favorable fixation properties, especially low-temperature fixation properties, can be obtained.

In view of the particle diameter uniformity, powder fluidity, storage stability of the toner particles, it is preferred that the resin particles (A) which contains the resin (a) or the coating film (P) which contains the resin (a) cover a total of 5% or greater, preferably 30% or greater, more preferably 50% or greater, particularly preferably 80% or greater, of the surface of the resin particle (B) contained in the toner particles. The surface coverage of the toner particles can be calculated based upon the following equation, analyzing an image obtained with a scanning electron microscope (SEM).

Surface coverage (%)=[Area of part covered with the resin particles (*A*) or the coating film (*P*)/Area of part covered with the resin particles (*A*) or the coating film (*P*)+Area of part where resin particle (*B*) is exposed]×100

In view of the particle diameter uniformity of the toner particles, the variation coefficient of the volume distribution of the toner particles is preferably 30% or less, more preferably in the range of 0.1% to 15%. In view of the particle diameter uniformity of the toner particles, the value of [Volume average particle diameter/Number average particle diameter] is in the range of 1.0 to 1.4, more preferably 1.0 to 1.3. The volume average particle diameter of the toner particles varies according to the use. Nevertheless, in general, the volume average particle diameter is preferably in the range of 0.1 μm to 16 μm. The upper limit is further preferably 11 μm, particularly preferably 9 μm, and the lower limit is further preferably 0.5 μm, particularly preferably 1 μm. Here, the volume average particle diameter and the number average particle diameter can be measured at the same time, using MULTISIZER II (manufactured by Beckman Coulter, Inc.).

The surface of the toner particles of the present invention can be provided with depressions and protrusions in a desirable manner by changing the particle diameters of the resin particles (A) and the resin particle (B), and the coverage of the surface of the resin particle (B) covered with the coating film (P) containing the resin (a) respectively. In the case where improved powder fluidity is to be obtained, the BET specific surface area of the toner particles is preferably in the range of 0.5 $m^2/g$ to 5.0 $m^2/g$. In the present invention, the BET specific surface area is measured (measurement gas: He/Kr=99.9/0.1 vol.%, calibration gas: nitrogen) using a surface area measuring apparatus such as QUANTASORB (manufactured by YUASA-IONICS COMPANY, LIM- ITED). In view of powder fluidity, the surface average center line roughness Ra of the toner particles is preferably 0.01 μm to 0.8 μm. Ra denotes a value obtained by arithmetically averaging the absolute value of the deviation between a roughness curve and its center line. For instance, Ra can be measured using a scanning probe microscope system (manufactured by TOYO Corporation).

The toner particles are preferably shaped like a sphere in view of, for example, its powder fluidity and melt leveling properties. In that case, the resin particle (B) is preferably shaped like a sphere as well. The toner particles preferably have an average circularity of 0.95 to 1.00, more preferably 0.96 to 1.0, even more preferably 0.97 to 1.0. The average circularity is a value obtained by optically detecting particles, and dividing the circumferential length of the optically detected particles by the circumferential length of a circle having an equal projected area. Specifically, the average circularity is measured using a flow particle image analyzer (FPIA-2000, manufactured by Sysmex Corporation). In a predetermined container, 100 mL to 150 mL of water from which impure solid matter has been removed is placed, 0.1 mL to 0.5 mL of a surfactant (DRIWEL, manufactured by FUJIFILM Corporation) is added as a dispersant, and further, approximately 0.1 g to 9.5 g of a measurement sample is added. The suspension in which the sample is dispersed is subjected to dispersion treatment for approximately 1 minute to approximately 3 minutes using an ultrasonic dispersing device (Ultrasonic Cleaner Model VS-150, manufactured by VELVO-CLEAR), the resin particle dispersion concentration is adjusted to the range of 3,000 (number)/μL to 10,000 (number)/μL, and the shapes and distribution of the resin particles are measured.

The toner of the present invention preferably contains a layered inorganic mineral in which at least some of interlayer ions have been modified with organic ions. The layered inorganic mineral in which at least some of interlayer ions have been modified with organic ions is preferably a layered inorganic mineral having a smectite-based crystalline structure, modified with organic cations. Additionally, by replacing part of a divalent metal of the layered inorganic mineral with a trivalent metal, metal anions can be introduced. It should, however, be noted that the introduction of metal anions causes an increase in hydrophilicity, and so preference is given to a layered inorganic compound in which at least some of metal anions have been modified with organic anions.

The organic cation modifier for use with the layered inorganic mineral in which at least some of ions are modified with organic ions includes quaternary alkyl ammonium salts, phosphonium salts and imidazolium salts. Among these, quaternary alkyl ammonium salts are preferable. Examples of quaternary alkyl ammoniums include trimethylstearylammonium, dimethylstearylbenzylammonium and oleylbis(2-hydroxyethyl)methylammonium.

The organic anion modifier further includes sulfates, sulfonates, carboxylates or phosphates, which contain branched, unbranched or cyclic alkyls (C1-C44), alkenyls (C1-C22), alkoxys (C8-C32), hydroxyalkyls (C2-C22), ethylene oxide, and propylene oxide. Preference is given to carboxylic acid having ethylene oxide skeletons.

By modifying at least some of ions of the layered inorganic mineral with organic ions, appropriate hydrophobicity can be yielded, the oil phase (O) including a toner composition has a non-Newtonian viscosity, and the toner can be deformed. Here, the layered inorganic mineral partially modified with organic ions preferably occupies 0.05% by mass to 10% by mass, more preferably 0.05% by mass to 5% by mass, of the materials for the toner.

The layered inorganic mineral partially modified with organic ions may be appropriately selected, and examples thereof include montmorillonite, bentonite, hectorite, attapulgite, sepiolite, and mixtures thereof. Among these, organically modified montmorillonite or bentonite is preferable in that toner properties are not adversely affected, viscosity adjustment can be facilitated, and the amount thereof can be small.

Examples of the commercially available layered inorganic mineral partially modified with organic ions include quaternium-18 bentonite such as BENTONE 3, BENTONE 38 and BENTONE 38V (manufactured by Rheox, Inc.), TIXOGEL VP (manufactured by United Catalyst Corporation), and CLAYTONE 34, CLAYTONE 40 and CLAYTONE XL (manufactured by Southern Clay Products, Inc.); stearalkonium bentonite such as BENTONE 27 (manufactured by Rheox, Inc.), TIXOGEL LG (manufactured by United Catalyst Corporation) and CLAYTONE AF and CLAYTONE APA (manufactured by Southern Clay Products, Inc.); quaternium-18/benzalkonium bentonite such as CLAYTONE HT and CLAYTONE PS (manufactured by Southern Clay Products, Inc.). Among these, particularly preferable are CLAYTONE AF and CLAYTONE APA. Also, DHT-4A (manufactured by Kyowa Chemical Industry Co., Ltd.) modified with organic anions represented by General Formula (3) below is particularly preferable as the layered inorganic mineral partially modified with organic ions. Examples of organic anions represented by General Formula (3) below include HITENOL 330T (manufactured by DAI-ICHI KOGYO SEIYAKU CO., LTD.).

$$R^1(OR^2)nOSO_3M \qquad \text{General Formula (3)}$$

In General Formula (3), $R^1$ denotes a C13 alkyl group, $R^2$ denotes a C2-C6 alkylene group, n denotes an integer of 2 to 10, and M denotes a monovalent metal element.

(Developer)

The developer in the present invention contains at least the toner of the present invention and further contains appropriately selected other optional ingredients such as carriers. The developer is either one-component developer or two-component developer. However, the two-component developer is preferable in view of improved life span when the developer is used with, for example, a high speed printer that complies with improvements in recent information processing speed.

The one-component developers, using the toner of the present invention, may exhibit less fluctuation in toner-particle diameter even after consumption or supply of toner, and also bring about less toner filming on developing rollers or toner fusion onto members such as a blade for reducing a thickness of a toner layer, therefore providing excellent and stable developing property and images over long-term use (stirring) of a developing unit. The two-component developers, using toner of the present invention, may exhibit less fluctuation in the toner particle diameter even after the toner is repeatedly consumed and supplied, and the excellent and stable developing property is maintained after stirring in a developing unit for prolonged periods.

<Carrier>

The carrier is not particularly limited and may be appropriately selected depending on the intended purpose; the carrier preferably has a core material and a resin layer on the core material.

The core material is not particularly limited and may be appropriately selected from known ones. Preferable are manganese-strontium (Mn—Sr) materials and manganese-magnesium (Mn—Mg) materials of 50 emu/g to 90 emu/g, and also highly magnetized materials such as iron powder (100 emu/g or more) and magnetite (75 emu/g to 120 emu/g) in view of ensuring appropriate image density. Weak-magnetizable materials such as copper-zinc (Cu—Zn) materials (30 emu/g to 80 emu/g) are also preferred in view of reducing the shock to the photoconductor the toner ears from, which is advantageous for high image quality. These may be used alone or in combination.

The core material preferably has a volume average particle size of 10 μm to 150 μm, more preferably 20 μm to 80 μm.

In the case where the volume average particle size is smaller than 10 μm, an increased amount of fine powder is observed in the carrier particle size distribution, and thus magnetization per particle is lowered, which may cause the carrier to fly. In the case where the average particle size is larger than 150 μm, the specific surface area is reduced, which may cause the toner to fly. Therefore, a full color image having many solid parts may not be well reproduced particularly in the solid parts.

The resin material is not particularly limited and may be appropriately selected from known ones depending on the intended purpose. Examples thereof include amino resins, polyvinyl resins, polystyrene resins, halogenated olefin resins, polyester resins, polycarbonate resins, polyethylene resins, polyvinyl fluoride resins, polyvinylidene fluoride resins, polytrifluoroethylene resins, polyhexafluoropropylene resins, copolymers of vinylidene fluoride and acrylic monomer, copolymers of vinylidene fluoride and vinyl fluoride, fluoroterpolymers such as terpolymer of tetrafluoroethylene, vinylidene fluoride and non-fluoride monomer, and silicone resins. These may be used alone or in combination.

Examples of amino resins include urea-formaldehyde resins, melamine resins, benzoguanamine resins, urea resins, polyamide resins, and epoxy resins. Examples of polyvinyl resins include acrylic resins, polymethylmethacrylate resins, polyacrylonitrile resins, polyvinyl acetate resins, polyvinyl alcohol resins, and polyvinyl butyral resins. Examples of polystyrene resins include polystyrene resins, and styrene acryl copolymer resins. Examples of halogenated olefin resins include polyvinyl chlorides. Examples of polyester resins include polyethyleneterephthalate resins and polybutyleneterephthalate resins.

The resin layer may contain, for example, conductive powder, as necessary. Examples of conductive powder include metal powder, carbon black, titanium oxide, tin oxide, and zinc oxide. The average particle diameter of conductive powder is preferably 1 μm or less. When the average particle diameter is more than 1 μm, controlling of the electrical resistance may be difficult.

The resin layer may be formed, for example, by dissolving the silicone resins in a solvent to prepare a coating solution, uniformly applying the coating solution to the surface of core material by known coating processes, then drying and baking Examples of coating processes include immersion, spray, and brushing.

The solvent is not particularly limited and may be appropriately selected depending on the intended purpose. Examples thereof include toluene, xylene, methyl ethyl ketone, methyl isobutyl ketone, and cellosol-butylacetate.

The baking is not particularly limited and may be carried out through external or internal heating. Examples of the baking processes include those by use of fixed electric furnaces, flowing electric furnaces, rotary electric furnaces, burner furnaces, or microwave.

The content of resin layer in the carrier is preferably 0.01% by mass to 5.0% by mass. When the content is less than 0.01% by mass, the resin layer may be formed nonuniformly on the surface of the core material, and when the content is more than 5.0% by mass, the resin layer may become excessively thick to cause granulation between carriers, and carrier particles may be formed nonuniformly.

When the developer is a two-component developer, the content of the carrier in the two-component developer is not particularly limited and may be appropriately selected depending on the intended purpose; preferably, the content is 90% by mass to 98% by mass, more preferably 93% by mass to 97% by mass.

(Process Cartridge)

The process cartridge used in the present invention includes at least a latent electrostatic image bearing member for bearing thereon a latent electrostatic image and a developing unit for developing the latent electrostatic image on the latent electrostatic image bearing member using the developer of the present invention to form a visible image, and further includes appropriately selected other units according to need.

The developing unit includes at least a developer container for storing the developer of the present invention and a developer carrier for carrying and transferring the developer stored in the developer container and may further contain a layer-thickness control member for controlling the thickness of carried toner layer.

The process cartridge may be detachably mounted on a variety of electrophotographic image forming apparatuses, and is preferably detachably mounted on an image forming apparatus according to the present invention to be described later.

Figure 4:
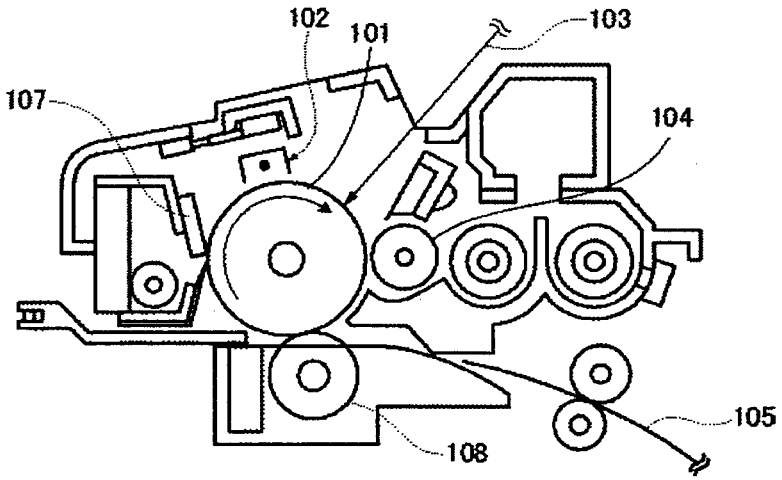
FIG. 4 is an explanatory, schematic view of one exemplary process cartridge according to the present invention.

The process cartridge includes, for example as shown in FIG. 4, a built-in latent electrostatic image bearing member 101, a charging unit 102, a developing unit 104, a transferring unit 108 and a cleaning unit 107, and also other members according to need. In FIG. 4, 103 denotes exposure performed by an exposing unit, and 105 denotes a recording medium.

In the image forming process by use of the process cartridge shown in FIG. 4, a latent electrostatic image, corresponding to the exposed image, is formed on the surface of the latent electrostatic image bearing member 101, rotating in the arrow direction, by the charge of the charging unit 102 and the exposure 103 performed by an exposing unit. The latent electrostatic image is developed by means of the developing unit 104, the visualized image is then transferred to the recording medium 105 by means of the transferring unit 108 and printed out. Then the latent electrostatic image bearing member surface after the image transfer is cleaned by means of the cleaning unit 107, followed by discharging through a charge-eliminating unit (not shown) and these operations are carried out repeatedly.

(Image Forming Method and Image Forming Apparatus)

An image forming method of the present invention includes a step of forming a latent electrostatic image, a developing step, a transferring step, a fixing step and appropriately selected other steps such as a discharging step, a cleaning step, a recycling step, and a controlling step, as necessary.

An image forming apparatus of the present invention includes a latent electrostatic image bearing member, a latent electrostatic image forming unit, a developing unit, a transferring unit, a fixing unit and appropriately selected other units such as a discharging unit, a cleaning unit, a recycling unit and a controlling unit as necessary.

The step of forming a latent electrostatic image is one that forms a latent electrostatic image on the latent electrostatic image bearing member, and includes a charging step and an exposing step.

For example, materials, shapes, structures or sizes of the latent electrostatic image bearing member (sometimes referred to as "electrophotographic photoconductor", "photoconductor", or "latent electrostatic image bearing member") is not particularly limited and may be appropriately selected from known ones depending on the intended purpose and the latent electrostatic image bearing member has preferably of a drum shape. The materials for the latent electrostatic image bearing member includes inorganic photoconductors such as amorphous silicon and selenium, and organic photoconductors (OPC) such as polysilane and phthalopolymethine. Among these materials, amorphous silicon is preferred by virtue of longer operating life.

The latent electrostatic image may be formed, for example, by uniformly charging a surface of the latent electrostatic image bearing member, and exposing imagewise, which may be performed in the latent electrostatic image forming unit.

The latent electrostatic image forming unit includes at least a charger which uniformly charges the surface of the latent electrostatic image bearing member (charging unit), and an exposing device which exposes the surface of the latent electrostatic image bearing member imagewise (exposing unit).

The charging may be performed, for example, by applying a voltage to the surface of the latent electrostatic image bearing member using the charger.

The charger is not particularly limited and may be appropriately selected depending on the intended purpose. Examples thereof include known contact chargers equipped with conductive or semi-conductive roller, brush, film or rubber blade and non-contact chargers using corona discharges such as corotron and scorotron.

It is preferable that the chargers be placed in contact with or not in contact with the latent electrostatic image bearing member and that a direct and alternating voltages are superimposed and applied to charge the surface of the latent electrostatic image bearing member.

Further, it is preferable that the chargers be a charge roller which is allocated near but without contacting the latent electrostatic image bearing member through a gap tape and that the direct and alternating voltages are superimposed and applied to charge the surface of the latent electrostatic image bearing member.

Exposures may be performed by exposing the surface of the latent electrostatic image bearing member imagewise using the exposure device, for example.

The exposing device is not particularly limited as long as it can expose imagewise on the surface of the latent electrostatic image bearing member charged by the charger and may be appropriately selected depending on the intended purpose. Examples of the exposing device include copying optical systems, rod lens array systems, laser optical systems and liquid crystal shutter optical systems.

In the present invention, the back-exposure method may be adopted in which the latent electrostatic image bearing member is exposed imagewise from the back side.

—Developing Step and Developing Unit—

The developing step is one where a latent electrostatic image is developed using the toner or developer of the present invention to form a visible image.

The visible image may be formed, for example, by developing a latent electrostatic image using the toner or developer of the present invention, which may be performed by the developing unit.

The developing unit is not particularly limited as long as it can develop an image by using the toner or developer of the present invention, and may be appropriately selected from known developing units. For example, a preferable developing unit contains the toner or developer of the present invention and includes a developing device which can impart the developer in a contact or non-contact manner to a latent electrostatic image.

The developing device may be of dry-type or wet-type, and may also be of monochrome or multi-color. As a preferable example, the developing device has an agitator that frictions and agitates the developer for charging and a rotatable magnet roller.

In the developing device, the toner and the carrier may, for example, be mixed and stirred together. The toner is charged by friction, and forms a magnetic brush on the surface of the rotating magnet roller. Since the magnet roller is arranged near the latent electrostatic image bearing member (photoconductor), a part of the toner constructing the magnetic brush formed on the surface of the magnet roller is moved toward the surface of the latent electrostatic image bearing member (photoconductor) due to the force of electrical attraction. As a result, the latent electrostatic image is developed by the use of toner, and a visible toner image is formed on the surface of the latent electrostatic image bearing member (photoconductor).

—Transferring Step and Transferring Unit—

The transferring step is one transferring the visible image to a recording medium. It is preferred that the transferring step is carried out in such a way that the visible images are primary-transferred on an intermediate transfer member, then the visible images are secondary-transferred from the intermediate transfer member to the recording medium; it is more preferred that toners of two or more colors, preferably full-color toners are employed, and the transferring step is carried out by way of the first transfer step in which visual images are transferred on the intermediate transfer member to form complex transferred images and the second transfer step in which the complex transferred images are transferred to the recording medium.

The transfer of the visible images may be performed by charging the latent electrostatic image bearing member (photoconductor) using a transfer-charging device, which may be performed by the transferring unit. The transferring unit preferably includes a primary transferring unit that transfers visible images to an intermediate transfer member to form complex transferred images and a secondary transferring unit that transfers the complex transferred images to the recording medium.

The intermediate transfer member is not particularly limited and may be appropriately selected depending on the intended purpose from known transfer members; favorable examples include a transfer belt.

The transferring unit (primary transferring unit and secondary transferring unit) preferably includes at least a transferring device that strips and charges the visible images formed on the latent electrostatic image bearing member (photoconductor) to the side of the recording medium. The transferring unit may exist one or plural.

Examples of the transferring device include corona transferring devices on the basis of corona discharge, transfer belts, transfer rollers, pressure transfer rollers and adhesive transferring devices.

Also, the recording medium is not particularly limited and may be appropriately selected from known recording media (recording paper).

The fixing step is one that fixes visible images transferred to the recording medium using a fixing unit. The fixing may be carried out for each color upon transferred onto the recording medium, or simultaneously after all colors are laminated.

The fixing unit is not particularly limited and may be appropriately selected depending on the intended purpose; preferable are known heating and pressing units. Examples thereof include combinations of heating rollers and pressing rollers, and combinations of heating rollers, pressing rollers, and endless belts.

In a preferable aspect, the fixing unit is a heat fixing unit which includes a heat application member having a heater, a film contacting the heart application member, and a pressure application member for pressure contacting the heat application member through the film, and fixes an unfixed image on a recording medium while the recording medium is passed between the film and pressure application member. The heating temperature in the heating and pressing units is preferably 80° C. to 200° C.

In addition, in the present invention, known optical fixing units may be used along with or in place of the fixing step and fixing unit, according to the purpose.

The charge-eliminating step is one that applies a discharge bias to the latent electrostatic image bearing member, which may be performed by a charge-eliminating unit.

The charge-eliminating unit is not particularly limited as long as it can apply a discharge bias to the latent electrostatic image bearing member and may be appropriately selected from known ones. Examples thereof include charge-eliminating lamps.

The cleaning step is one in which residual toner on the latent electrostatic image bearing member is removed, which may be performed by a cleaning unit.

The cleaning unit is not particularly limited as long as it can remove residual toners on the latent electrostatic image bearing member and may be appropriately selected from known ones. Examples thereof include magnetic brush cleaners, electrostatic brush cleaners, magnetic roller cleaners, blade cleaners, brush cleaners, and web cleaners.

The recycling step is one in which the toner, removed in the cleaning step, is recycled for use in the developing, which may be performed by a recycling unit.

The recycling unit is not particularly limited and may be constructed from known transport units.

The controlling step is one in which the respective processes are controlled, which may be preferably carried out by a controlling unit.

The controlling units are not particularly limited as long as it can control the performance of each unit and may be appropriately selected depending on the intended purpose. Examples thereof include instruments such as sequencers or computers.

An aspect of the image forming method using the image forming apparatus of the present invention will be described with reference to FIG. 5. An image forming apparatus 100 shown in FIG. 5 is equipped with a photoconductor drum 10 (hereafter referred to as "photoconductor 10") as the latent electrostatic latent electrostatic image bearing member, a charge roller 20 as the charging unit, an exposure device 30 as the exposing unit, a developing device 40 as the developing unit, an intermediate transfer member 50, a cleaning device 60 as the cleaning means having a cleaning blade, and a charge-eliminating lamp 70 as a charge-eliminating unit.

Figure 5:
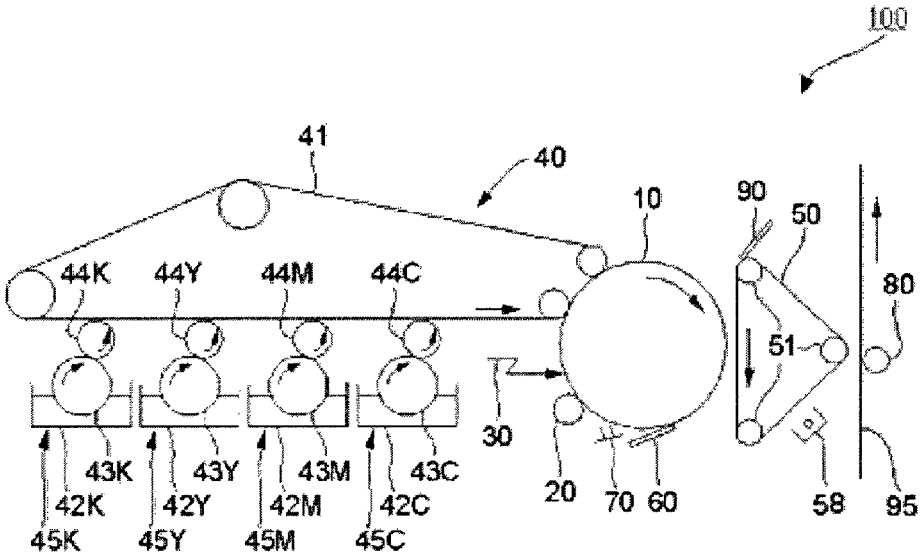
FIG. 5 is an explanatory, schematic view of one exemplary image forming apparatus according to the present invention.

The intermediate transfer member 50 is an endless belt being extended over the three rollers 51 placed inside the belt and designed to be moveable in arrow direction in FIG. 5. A part of three rollers 51 function as a transfer bias roller capable of applying a specified transfer bias (primary transfer bias), to the intermediate transfer member 50. The cleaning blade 90 for intermediate transfer member is placed near the intermediate transfer member 50, and a transfer roller 80, as a transferring unit capable of applying a transfer bias for transferring (secondary transferring) a visible image (toner image) onto a recording medium 95, is placed face to face with the intermediate transfer member 50. In the surrounding area of the intermediate transfer member 50, a corona charger 58 for supplying an electrical charge to the visible image on the intermediate transfer belt 50 is placed between contact area of the photoconductor 10 and the intermediate transfer member 50, and contact area of the intermediate transfer member 50 and the recording medium 95 in the rotational direction of the intermediate transfer member 50.

The developing device 40 is constructed with a developing belt 41 as a developer carrier, a black developing device 45K, yellow developing device 45Y, magenta developing device 45M and cyan developing device 45C disposed together in the surrounding area of the developing belt 41. The black developing device 45K is equipped with a developer container 42K, a developer feeding roller 43K, and a developing roller 44K. The yellow developing device 45Y is equipped with a developer container 42Y, a developer feeding roller 43Y, and a developing roller 44Y. The magenta developing device 45M is equipped with a developer container 42M, a developer feeding roller 43M, and a developing roller 44M. The cyan developing device 45C is equipped with a developer container 42C, a developer feeding roller 43C, and a developing roller 44C. The developing belt 41 is an endless belt and is extended between several belt rollers as rotatable, and a part of the developing belt 41 is in contact with the photoconductor 10.

For example, the charge roller 20 charges the photoconductor 10 evenly in the image forming apparatus 100 shown in FIG. 5. The exposure device 30 exposes imagewise on the photoconductor 10 and forms a latent electrostatic image. The latent electrostatic image formed on the photoconductor drum 10 is then developed with the toner fed from the developing device 40 to form a visible image (toner image). The visible image (toner image) is then transferred (primary transferred) onto the intermediate transfer member 50 by a voltage applied from the roller 51 and is transferred (secondary transferred) onto the transfer paper 95. As a result, a transfer image is formed on the transfer paper 95. The residual toner on the photoconductor 10 is removed by the cleaning device 60 and the charge built up over the photoconductor 10 is temporarily removed by the charge-eliminating lamp 70.

Figure 6:
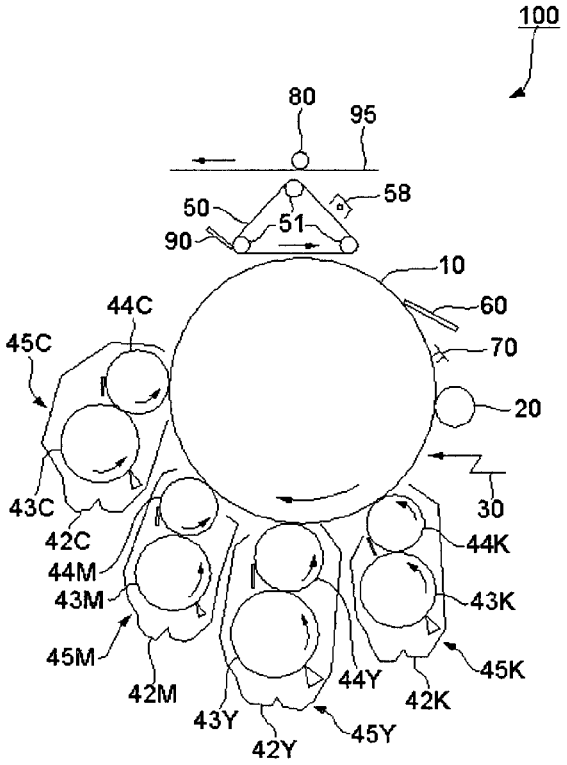
FIG. 6 is an explanatory, schematic view of another exemplary image forming apparatus according to the present invention.

Another aspect for implementing the image forming method according to the present invention performed by the image forming apparatuses will be described with reference to FIG. 6. An image forming apparatus 100 as shown in FIG. 6 has the same construction as the image forming apparatus 100 shown in FIG. 5 except that the developing belt 41 is not equipped and the black developing device 45K, the yellow developing device 45Y, the magenta developing device 45M and the cyan developing device 45C are placed in the surrounding area directly facing the photoconductor 10 and achieves the same effect as the image forming apparatus 100 shown in FIG. 5. The reference numbers used in FIG. 6 correspond to those used in FIG. 5.

Figure 7:
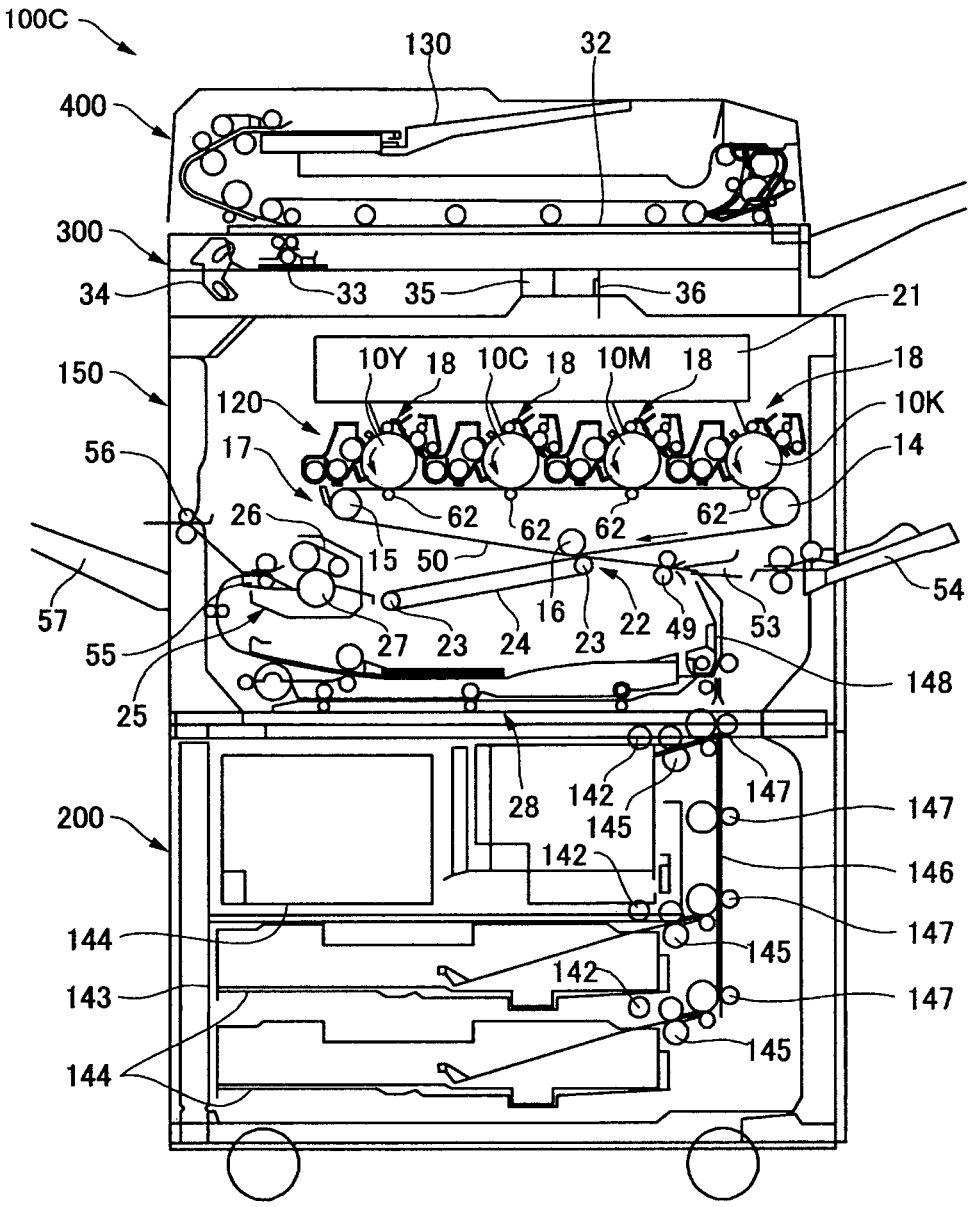
FIG. 7 is an explanatory, schematic view of one exemplary tandem color image forming apparatus which is an image forming apparatus of the present invention.

Still another aspect for implementing the image forming method according to the present invention performed by the image forming apparatuses will be described with reference to FIG. 7. A tandem image-forming apparatus shown in FIG. 7 is a tandem color-image-forming apparatus. The tandem image-forming apparatus includes a copying machine main body 150, a paper feeder table 200, a scanner 300, and an automatic document feeder (ADF) 400.

The copying machine main body 150 contains an endless-belt intermediate transfer member 50 in the central part thereof. The intermediate transfer member 50 is wound around support rollers 14, 15, and 16 and is configured to rotate in a clockwise direction in FIG. 7. There is disposed a cleaning device 17 for the intermediate transfer member 50 adjacent to the support roller 15. The cleaning device 17 is capable of removing a residual toner on the intermediate transfer member 50. Above the intermediate transfer member 50 wound around the support rollers 14 and 15, four image-forming units 18 of yellow, cyan, magenta, and black are arrayed in parallel in a conveyance direction of the intermediate transfer member 50 to thereby constitute a tandem developing device 120. There is also disposed an exposing device 21 adjacent to the tandem developing device 120. A secondary transfer device 22 is disposed on the opposite side of the intermediate transfer member 50 to where the tandem developing device 120 is disposed. The secondary transfer device 22 includes a secondary transferring belt 24 of an endless belt, which is wound around a pair of rollers 23. The secondary transfer device 22 is configured so that the recording medium (transfer sheet) conveyed on the secondary transferring belt 24 contacts with the intermediate transfer member 50. Adjacent to the secondary transfer device 22, there is disposed a fixing device 25. The fixing device 25 includes a fixing belt 26 which is an endless belt, and a pressurizing roller 27 which is disposed so as to contact against the fixing belt 26.

In the tandem image-forming apparatus, a sheet reverser 28 is disposed adjacent to the secondary transfer device 22 and the fixing device 25. The sheet reverser 28 is configured to reverse a transfer sheet in order to form images on the both sides of the transfer sheet.

Full-color image (color copy) is formed by means of the tandem developing device 120 in the following manner. Initially, a document is placed on a document platen 130 of the automatic document feeder (ADF) 400. Alternatively, the automatic document feeder 400 is opened, the document is placed on a contact glass 32 of the scanner 300, and the automatic document feeder 400 is closed to press the document.

At the time of pushing a start switch (not shown), the document placed on the automatic document feeder 400 is transported onto the contact glass 32. In the case where the document is initially placed on the contact glass 32, the scanner 300 is immediately driven to operate a first carriage 33 and a second carriage 34. Light is applied from a light source of the first carriage 33 to the document, and reflected light from the document is further reflected toward the second carriage 34. The reflected light is further reflected by a mirror of the second carriage 34 and passes through an image-forming lens 35 into a read sensor 36 to thereby read the color document (color image). The read color image is interrupted to image information of black, yellow, magenta and cyan.

Figure 8:
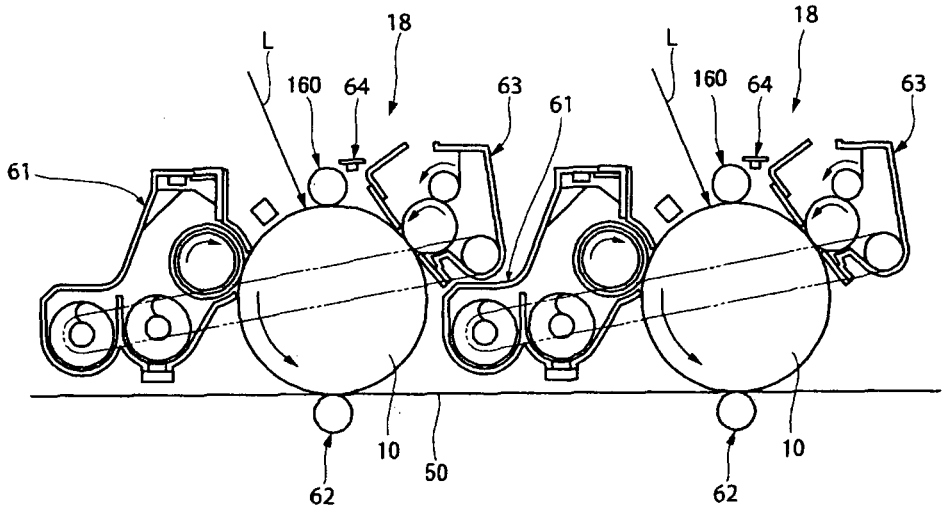
FIG. 8 is a partially enlarged schematic view of the image forming apparatus of FIG. 7.

Each of black, yellow, magenta, and cyan image information is transmitted to respective image-forming units 18 (black image-forming unit, yellow image-forming unit, magenta image-forming unit, and cyan image-forming unit) of the tandem developing device 120, and then toner images of black, yellow, magenta, and cyan are separately formed in each image-forming unit 18. With respect to each of the image-forming units 18 (black image-forming unit, yellow image-forming unit, magenta image-forming unit, and cyan image-forming unit) of the tandem developing device 120, as shown in FIG. 8, there are disposed a latent electrostatic image bearing member 10 (a latent electrostatic image bearing member for black 10K, a latent electrostatic image bearing member for yellow 10Y, a latent electrostatic image bearing member for magenta 10M, and a latent electrostatic image bearing member for cyan 10C), a charger 160 which uniformly charges the latent electrostatic image bearing member 10, an exposing device which exposes (L in FIG. 8) the latent electrostatic image bearing member 10 based on each color image information to thereby form a latent electrostatic image corresponding to each color image on the latent electrostatic image bearing member 10, an developing unit 61 which develops the latent electrostatic image with the corresponding color toner (a black toner, a yellow toner, a magenta toner, and a cyan toner) to form a toner image of each color, a transfer charger 62 for transferring the toner image to the intermediate transfer member 50, a cleaning device 63, and a charge-eliminating device 64. Accordingly, each mono-color images (a black image, a yellow image, a magenta image, and a cyan image) can be formed based on the corresponding color-image information. Thus obtained black toner image formed on the latent electrostatic image bearing member for black 10K, yellow toner image formed on the latent electrostatic image bearing member for yellow 10Y, magenta toner image formed on the latent electrostatic image bearing member for magenta 10M, and cyan toner image formed on the latent electrostatic image bearing member for cyan 10C are sequentially transferred (primary transferred) onto the intermediate transfer member 50 which is rotated by means of the support rollers 14, 15 and 16. These toner images are superimposed on the intermediate transfer member 50 to form a composite color image (color transferred image).

One of feeding rollers 142 of the feeder table 200 is selectively rotated, sheets (recording sheets) are ejected from one of multiple feeder cassettes 144 in a paper bank 143 and are separated by a separation roller 145 one by one into a feeder path 146, are transported by a transport roller 147 into a feeder path 148 in the copying machine main body 150 and are bumped against a registration roller 49. Alternatively, one of the feeding rollers 142 is rotated to ejected sheets (recording sheets) from a manual-feeding tray 54, and the sheets are separated by a separation roller 145 one by one into a feeder path 53, transported one by one and then bumped against the registration roller 49. Note that, the registration roller 49 is generally earthed, but it may be biased for removing paper dust of the sheets. The registration roller 49 is rotated synchronously with the movement of the composite color image (color transferred image) on the intermediate transfer member 50 to transport the sheet (recording sheet) into between the intermediate transfer member 50 and the secondary transferring unit 22, and the composite color image is transferred (secondary transferred) onto the sheet (recording sheet) by action of the secondary transferring unit 22. After transferring the toner image, the residual toner on the intermediate transfer member 50 is cleaned by means of the cleaning device 17 for intermediate transfer member.

The sheet (recording sheet) onto which the color-image has been transferred is transported by the secondary transferring unit 22 into the fixing device 25, is applied with heat and pressure in the fixing device 25 to fix the composite color image (color transferred image) to the sheet (recording sheet). Thereafter, the sheet (recording sheet) changes its direction by action of a switch blade 55, is ejected by an ejecting roller 56 and is stacked on an output tray 57. Alternatively, the sheet changes its direction by action of the switch blade 55 into the sheet reverser 28, turns the direction, is transported again to the transfer position, subjected to an image formation on the back surface thereof. The sheet bearing images on both sides thereof is then ejected with assistance of the ejecting roller 56, and is stacked on the output tray 57.

EXAMPLES

The present invention will next be described in detail by way of Examples and Comparative Examples. Notably, the unit "part(s)" in the Examples means "part(s) by mass."

[Measurement Method for Properties of Components Used in Examples and Comparative Examples]

(Measurement of Molecular Weight)

Apparatus: GPC (product of TOSOH CORPORATION)

Detector: RI

Measuring temperature: 40° C.

Mobile phase: tetrahydrofuran

Flow rate: 0.45 mL/min.

The molecular weights Mn and Mw are respectively number average molecular weight and weight average molecular weight which are measured through GPC (gel permeation chromatography) using as a standard a calibration curve prepared with polystyrene samples each having a known molecular weight.

(Measurement of Glass Transition Temperature (Tg))

Apparatus: DSC (Q2000, product of TA Instruments)

5 mg to 10 mg of a sample was charged to a readily sealable aluminum pan, which was then subjected to the following measuring flow: the first heating: 30° C. to 220° C., 5° C./min, where after reaching 220° C., the sample was maintained at 220° C. for 1 min;

Cooling: the sample was quenched to −60° C. without being temperature-controlled, where after reaching −60° C., the sample was maintained at −60° C. for 1 min; and the second heating: −60° C. to 180° C., 5° C./min.

With the midpoint method according to the method described in ASTM D3418/82, the glass transition temperature was measured from the thermogram obtained at the second heating and evaluated.

(Measurement of the Average of the Maximum Feret Diameters)

Apparatus: AFM (MFP-3D, product of Asylum Technology Co., Ltd.)

Cantilever: OMCL-AC240TS-C3

Target amplitude: 0.5 V

Target percent: −5%

Amplitude setpoint: 315 mV

Scan rate: 1 Hz

Scan points: 256×256

Scan angle: 0°

A block of the binder resin was cut under the following conditions with an ultramicrotome ULTRACUT UCT (product of Leica) and the cut piece was observed:

Cutting thickness: 60 nm

Cutting speed: 0.4 mm/sec

Diamond knife (Ultra Sonic35°) used

The obtained AFM phase image was binarized based on an intermediate value between the maximum value and the minimum value of the phase differences of the phase image, to thereby prepare a binarized image. Ten images were selected from a 300 nm×300 nm area of the binarized image, and 30 of the first phase difference regions formed of the first pixels were selected in the order of decreasing the maximum Feret diameter; i.e., the maximum Feret diameters of the selected 30 first phase difference regions were from the greatest to the $30^{th}$ greatest. Then, these greatest to the $30^{th}$ greatest maximum Feret diameters were averaged to obtain the average of the maximum Feret diameters.

Production Example 1

(Synthesis of Binder Resin 1)

A 300-mL reaction container equipped with a condenser, a stirrer and a nitrogen-introducing tube was charged with an alcohol component and acid components at a proportion shown in Table 1 so that the total amount of the reagents became 250 g. In addition, titanium tetraisopropoxide (1,000 ppm relative to the resin components) was also charged to the reaction container as a polymerizing catalyst. Under nitrogen flow, the resultant mixture was heated to 200° C. for about 4 hours and then heated to 230° C. for 2 hours, to thereby perform the reaction until no flow component was formed. Thereafter, the reaction mixture was further allowed to react at a reduced pressure of 10 mmHg to 15 mmHg for 5 hours to thereby obtain [Polyester initiator 1].

The number average molecular weight Mn and the glass transition temperature Tg of the obtained [Polyester initiator 1] are shown in Table 2.

Next, the [Polyester initiator 1], L-lactide and D-lactide were charged at a proportion shown in Table 2 to an autoclave reaction vessel equipped with a thermometer and a stirrer. In addition, titanium terephthalate was added to the resultant mixture in such an amount that the final concentration thereof became 1% by mass. After the autoclave reaction vessel had been purged with nitrogen, the mixture was allowed to polymerize at 160° C. for 6 hours to synthesize [Binder resin 1]. The weight average molecular weight Mw, number average molecular weight Mn and glass transition temperature Tg of the obtained [Binder resin 1] are shown in Table 6-1.

Production Example 2

(Synthesis of Binder Resin 2)

[Binder resin 2] was synthesized in the same manner as in Production Example 1 except that the amount of the [Polyester initiator 1] charged was changed to the amount shown in Table 2. The weight average molecular weight Mw, number average molecular weight Mn and glass transition temperature Tg of the obtained [Binder resin 2] are shown in Table 6-1.

Production Example 3

(Synthesis of Binder Resin 3)

[Binder resin 3] was synthesized in the same manner as in Production Example 1 except that the amount of the [Polyester initiator 1] charged was changed to the amount shown in Table 2. The weight average molecular weight Mw, number average molecular weight Mn and glass transition temperature Tg of the obtained [Binder resin 3] are shown in Table 6-1.

Production Example 4

(Synthesis of Binder Resin 4)

A 300-mL reaction container equipped with a condenser, a stirrer and a nitrogen-introducing tube was charged with an alcohol component and acid components at a proportion shown in Table 1 so that the total amount of the reagents became 250 g. In addition, titanium tetraisopropoxide (1,000 ppm relative to the resin components) was also charged to the reaction container as a polymerizing catalyst. Under nitrogen flow, the resultant mixture was heated to 200° C. for about 4 hours and then heated to 230° C. for 2 hours, to thereby perform the reaction until no flow component was formed. Thereafter, the reaction mixture was further allowed to react at a reduced pressure of 10 mmHg to 15 mmHg for 5 hours to thereby obtain [Polyester initiator 2].

The number average molecular weight Mn and the glass transition temperature Tg of the obtained [Polyester initiator 2] are shown in Table 2.

Next, the [Polyester initiator 2], L-lactide and D-lactide were charged at a proportion shown in Table 2 to an autoclave reaction vessel equipped with a thermometer and a stirrer. In addition, titanium terephthalate was added to the resultant mixture in such an amount that the final concentration thereof became 1% by mass. After the autoclave reaction vessel had been purged with nitrogen, the mixture was allowed to polymerize at 160° C. for 6 hours to synthesize [Binder resin 4]. The weight average molecular weight Mw, number average molecular weight Mn and glass transition temperature Tg of the obtained [Binder resin 4] are shown in Table 6-1.

Production Example 5

(Synthesis of Binder Resin 5)

A 300-mL reaction container equipped with a condenser, a stirrer and a nitrogen-introducing tube was charged with an alcohol component and acid components at a proportion shown in Table 1 so that the total amount of the reagents became 250 g. In addition, titanium tetraisopropoxide (1,000 ppm relative to the resin components) was also charged to the reaction container as a polymerizing catalyst. Under nitrogen flow, the resultant mixture was heated to 200° C. for about 4 hours and then heated to 230° C. for 2 hours, to thereby perform the reaction until no flow component was formed. Thereafter, the reaction mixture was further allowed to react at a reduced pressure of 10 mmHg to 15 mmHg for 5 hours to thereby obtain [Polyester initiator 3].

The number average molecular weight Mn and the glass transition temperature Tg of the obtained [Polyester initiator 3] are shown in Table 2.

Next, the [Polyester initiator 3], L-lactide and D-lactide were charged at a proportion shown in Table 2 to an autoclave reaction vessel equipped with a thermometer and a stirrer. In addition, titanium terephthalate was added to the resultant mixture in such an amount that the final concentration thereof became 1% by mass. After the autoclave reaction vessel had been purged with nitrogen, the mixture was allowed to polymerize at 160° C. for 6 hours to synthesize [Binder resin 5]. The weight average molecular weight Mw, number average molecular weight Mn and glass transition temperature Tg of the obtained [Binder resin 5] are shown in Table 6-1.

Production Example 6

(Synthesis of Binder Resin 6)

A 300-mL reaction container equipped with a condenser, a stirrer and a nitrogen-introducing tube was charged with an alcohol component and acid components at a proportion shown in Table 1 so that the total amount of the reagents became 250 g. In addition, titanium tetraisopropoxide (1,000 ppm relative to the resin components) was also charged to the reaction container as a polymerizing catalyst. Under nitrogen flow, the resultant mixture was heated to 200° C. for about 4 hours and then heated to 230° C. for 2 hours, to thereby perform the reaction until no flow component was formed. Thereafter, the reaction mixture was further allowed to react at a reduced pressure of 10 mmHg to 15 mmHg for 5 hours to thereby obtain [Polyester initiator 4].

The number average molecular weight Mn and the glass transition temperature Tg of the obtained [Polyester initiator 4] are shown in Table 2.

Next, the [Polyester initiator 4], L-lactide and D-lactide were charged at a proportion shown in Table 2 to an autoclave reaction vessel equipped with a thermometer and a stirrer. In addition, titanium terephthalate was added to the resultant mixture in such an amount that the final concentration thereof became 1% by mass. After the autoclave reaction vessel had been purged with nitrogen, the mixture was allowed to polymerize at 160° C. for 6 hours to synthesize [Binder resin 6]. The weight average molecular weight Mw, number average molecular weight Mn and glass transition temperature Tg of the obtained [Binder resin 6] are shown in Table 6-1.

Production Example 7

(Synthesis of Binder Resin 7)

Polyester polyol (product of Sumitomo Bayer Urethane Co., Ltd., DESMOPHEN 1652, number average molecular weight: about 1,100, hydroxyl value: 53 mgKOH/g), serving as an initiator, L-lactide and D-lactide were charged at a proportion shown in Table 2 to an autoclave reaction vessel equipped with a thermometer and a stirrer. In addition, titanium terephthalate was added to the resultant mixture in such an amount that the final concentration thereof became 1% by mass. After the autoclave reaction vessel had been purged with nitrogen, the mixture was allowed to polymerize at 160° C. for 6 hours to synthesize [Binder resin 7]. The weight average molecular weight Mw, number average molecular weight Mn and glass transition temperature Tg of the obtained [Binder resin 7] are shown in Table 6-1.

Production Example 8

(Synthesis of Binder Resin 8)

Polytetramethylene glycol (product of DuPont Co., Ltd., TERATHANE 2000, number average molecular weight: about 2,000), serving as an initiator, L-lactide and D-lactide were charged at a proportion shown in Table 2 to an autoclave reaction vessel equipped with a thermometer and a stirrer. In addition, titanium terephthalate was added to the resultant mixture in such an amount that the final concentration thereof became 1% by mass. After the autoclave reaction vessel had been purged with nitrogen, the mixture was allowed to polymerize at 160° C. for 6 hours to synthesize [Binder resin 8]. The weight average molecular weight Mw, number average molecular weight Mn and glass transition temperature Tg of the obtained [Binder resin 8] are shown in Table 6-1.

Production Example 9

(Synthesis of Binder Resin 9)

Polyester polyol (product of Sumitomo Bayer Urethane Co., Ltd., DESMOPHEN 1200, number average molecular weight: about 1,000, hydroxyl value: 165 mgKOH/g), serving as an initiator, L-lactide and D-lactide were charged at a proportion shown in Table 2 to an autoclave reaction vessel equipped with a thermometer and a stirrer. In addition, titanium terephthalate was added to the resultant mixture in such an amount that the final concentration thereof became 1% by mass. After the autoclave reaction vessel had been purged with nitrogen, the mixture was allowed to polymerize at 160° C. for 6 hours to synthesize [Binder resin 9]. The weight average molecular weight Mw, number average molecular weight Mn and glass transition temperature Tg of the obtained [Binder resin 9] are shown in Table 6-1.

Production Example 10

(Synthesis of Binder Resin 10)

A 300-mL reaction container equipped with a condenser, a stirrer and a nitrogen-introducing tube was charged with alcohol components and acid components at a proportion shown in Table 1 so that the total amount of the reagents became 250 g. In addition, titanium tetraisopropoxide (1,000 ppm relative to the resin components) was also charged to the reaction container as a polymerizing catalyst. Under nitrogen flow, the resultant mixture was heated to 200° C. for about 4 hours and then heated to 230° C. for 2 hours, to thereby perform the reaction until no flow component was formed. Thereafter, the reaction mixture was further allowed to react at a reduced pressure of 10 mmHg to 15 mmHg for 5 hours to thereby obtain [Polyester initiator 5].

The number average molecular weight Mn and the glass transition temperature Tg of the obtained [Polyester initiator 5] are shown in Table 2.

Next, the [Polyester initiator 5], L-lactide and D-lactide were charged at a proportion shown in Table 2 to an autoclave reaction vessel equipped with a thermometer and a stirrer. In addition, titanium terephthalate was added to the resultant mixture in such an amount that the final concentration thereof became 1% by mass. After the autoclave reaction vessel had been purged with nitrogen, the mixture was allowed to polymerize at 160° C. for 6 hours to synthesize [Binder resin 10]. The weight average molecular weight Mw, number average molecular weight Mn and glass transition temperature Tg of the obtained [Binder resin 10] are shown in Table 6-1.

Production Example 11

(Synthesis of Binder Resin 11)

43.8 parts of 1,2-propylene glycol, 44.8 parts of terephthalic acid dimethyl ester, 11.2 parts of adipic acid, and 0.2 parts of tetrabutoxytitanate (as a condensation catalyst), were placed into a reaction vessel equipped with a cooling pipe, a stirrer and a nitrogen gas inlet tube, allowing reaction to take place for 8 hours at 180° C. under nitrogen gas stream, followed by reaction for 4 hours at 230° C. Further, reaction was carried out under reduced pressure of 5 mmHg to 20 mmHg and, when the softening point reached 150° C., the reaction product was taken out. The taken out reaction product was cooled and pulverized to obtain [Polyester initiator 6]. The number-average molecular weight Mn and the glass transition temperature Tg of the obtained [Polyester initiator 6] are shown in Table 2.

Subsequently, the [Polyester initiator 6], L-lactide, and D-lactide were charged into an autoclave reaction vessel equipped with a thermometer and a stirrer at a proportion shown in Table 2. In addition, titanium terephthalate was added to the resultant mixture in such an amount that the final concentration thereof became 1% by mass. After the autoclave reaction vessel had been purged with nitrogen, the mixture was allowed to polymerize at 160° C. for 6 hours to synthesize [Binder resin 11]. The weight average molecular weight Mw, number average molecular weight Mn and glass transition temperature Tg of the obtained [Binder resin 11] are shown in Table 6-1.

Production Example 12

(Synthesis of Binder Resin 12)

Lauryl alcohol serving as an initiator, L-lactide and D-lactide were charged into an autoclave reaction vessel equipped with a thermometer and a stirrer at a proportion shown in Table 2. In addition, titanium terephthalate was added to the resultant mixture in such an amount that the final concentration thereof became 1% by mass. After the autoclave reaction vessel had been purged with nitrogen, the mixture was allowed to polymerize at 160° C. for 6 hours to synthesize [Binder resin 12]. The weight average molecular weight Mw, number average molecular weight Mn and glass transition temperature Tg of the obtained [Binder resin 12] are shown in Table 6-1.

Production Examples 13 to 23

(Synthesis of Binder Resins b-1 to b-11)

[Binder resin b-1] to [Binder resin b-10] and [Binder resin b-11] of Production Examples 13 to 22 and 23 were respectively synthesized in the same manner as in Production Examples 1 to 10 and 12. The number average molecular weight Mn and the glass transition temperature Tg of the obtained [Polyester initiator 1] to [Polyester initiator 5] are shown in Table 3. The weight average molecular weight Mw, number average molecular weight Mn and glass transition temperature Tg of the obtained [Binder resin 12] are shown in Table 7-1.

Each of the obtained binder resins 1 to 12 and b-1 to b-11 was observed with a tapping-mode AFM to obtain a phase image, which was then binarized based on an intermediate value between the maximum value and the minimum value of the phase differences of the phase image, to thereby prepare a binarized image. In the binder resins 1 to 8, 10, b-1 to b-8 and b-10, the first phase difference regions corresponding to the regions having greater phase differences were found to be dispersed in the second phase difference region corresponding to the regions having smaller phase differences. However, in the binder resins 9, 11 to 12, b-9 and b-11, the first phase difference regions of greater phase differences were not found to be dispersed in the second phase difference region of smaller phase differences. In their images, the first phase difference regions were not discriminated from image noise and definite domains and Feret diameters could not be defined. As to the binder resins 1 to 8, 10, b-1 to b-8 and b-10 where the first phase difference regions of greater phase differences were found to be dispersed in the second phase difference region of smaller phase differences, the average of the maximum Feret diameters of the first phase difference regions of greater phase differences in the dispersion phase was obtained. The results are shown in Tables 6-1 and 7-1.

Figure 3:
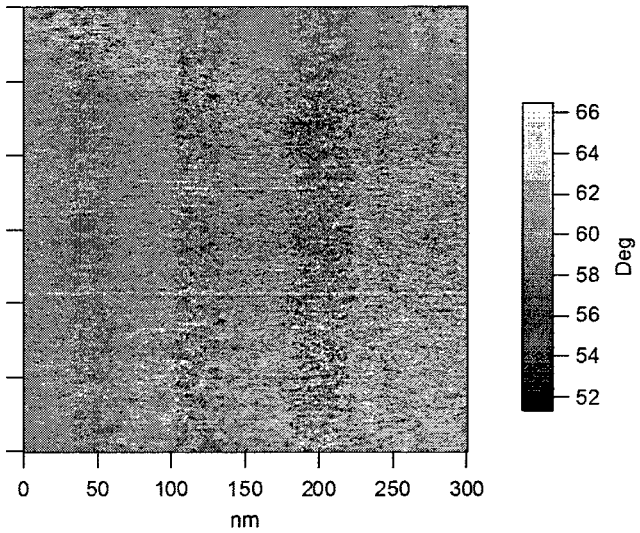
FIG. 3 is a phase image of binder resin 9 used in Comparative Example 1, which is measured with AFM of tapping mode.

FIG. 1 is a phase image of the binder resin 1 which was measured with tapping-mode AFM. FIG. 2 is a binarized image of the phase image which was binarized based on the intermediate value between the maximum value and the minimum value of the phase differences of the phase image. FIG. 3 is a phase image of binder resin 9 which was measured with tapping-mode AFM.

Calculation of $(Tg-(TgA\times MA/(MA+MB)+TgB\times MB/(MA+MB)))$

The value $(Tg-(TgA\times MA/(MA+MB)+TgB\times MB/(MA+MB)))$ was calculated where MA denotes the total amount of L-lactide and D-lactide, TgB denotes the glass transition temperature of the initiator, and MB denotes the amount of the initiator charged, as shown in Table 2. Notably, TgA denotes the glass transition temperature of the [Binder resin 12]. The reason for choosing the [Binder resin 12] is as follows. Specifically, the amount of the initiator was quite low in the [Binder resin 12] and also the molecular weight of the [Binder resin 12] was quite low, and thus the [Binder resin 12] can be regarded as an almost pure polylactic acid resin. When the L/D ratio is the same, the glass transition temperature of the [Binder resin 12] can be approximated to the glass transition temperature of the polylactic acid unit of the other binder resins. The results are shown in Tables 6-1 and 7-1.

TABLE 1

| | Alcohol component (mol %) | | Acid component (mol %) | | | |
|---|---|---|---|---|---|---|
| | 3-methyl-1,5-pentanediol | 1,3-propanediol | Dimethyl adipate | Dimethyl terephthalate | Trimellitic anhydride | OH/COOH molar ratio |
| Polyester initiator 1 | 100 | — | 17 | 80 | 3 | 1.3 |
| Polyester initiator 2 | 100 | — | 80 | 17 | 3 | 1.2 |
| Polyester initiator 3 | 100 | — | 18.5 | 80 | 1.5 | 1.3 |
| Polyester initiator 4 | 100 | — | 20 | 80 | 0 | 1.3 |
| Polyester initiator 5 | 70 | 30 | 80 | 17 | 3 | 1.2 |

TABLE 2

| | Initiator | Mn of Initiator | Tg of Initiator (° C.) | Percentage of Initiator (% by mass) | L-lactide (% by mass) | D-lactide (% by mass) |
|---|---|---|---|---|---|---|
| Binder resin 1 | Polyester initiator 1 | 2,800 | −22 | 20 | 68 | 12 |
| Binder resin 2 | Polyester initiator 1 | 2,800 | −22 | 25 | 63.7 | 11.3 |
| Binder resin 3 | Polyester initiator 1 | 2,800 | −22 | 10 | 76.5 | 13.5 |
| Binder resin 4 | Polyester initiator 2 | 2,700 | −57 | 15 | 72.3 | 12.7 |
| Binder resin 5 | Polyester initiator 3 | 2,800 | −18 | 20 | 68 | 12 |
| Binder resin 6 | Polyester initiator 4 | 2,700 | −21 | 20 | 68 | 12 |
| Binder resin 7 | Desmophen 1652 | 1,100 | −50 | 10 | 76.5 | 13.5 |
| Binder resin 8 | Polytetramethylene glycol | 2,000 | −70 | 13 | 74 | 13 |
| Binder resin 9 | Desmophen 1200 | 1,000 | −50 | 10 | 76.5 | 13.5 |
| Binder resin 10 | Polyester initiator 5 | 3,800 | −7 | 30 | 59.5 | 10.5 |
| Binder resin 11 | Polyester initiator 6 | 2,000 | 49 | 33 | 57 | 10 |
| Binder resin 12 | Lauryl alcohol | 186 | — | 1.3 | 83.9 | 14.8 |

TABLE 3

| | Initiator | Mn of Initiator | Tg of Initiator (° C.) | Percentage of Initiator (% by mass) | L-lactide (% by mass) | D-lactide (% by mass) |
|---|---|---|---|---|---|---|
| Binder resin b-1 | Polyester initiator 1 | 2,700 | −24 | 20 | 68 | 12 |
| Binder resin b-2 | Polyester initiator 1 | 2,700 | −24 | 25 | 63.7 | 11.3 |
| Binder resin b-3 | Polyester initiator 1 | 2,700 | −24 | 10 | 76.5 | 13.5 |
| Binder resin b-4 | Polyester initiator 2 | 2,600 | −58 | 15 | 72.3 | 12.7 |
| Binder resin b-5 | Polyester initiator 3 | 2,900 | −18 | 20 | 68 | 12 |
| Binder resin b-6 | Polyester initiator 4 | 2,600 | −20 | 20 | 68 | 12 |
| Binder resin b-7 | Desmophen 1652 | 1,100 | −50 | 10 | 76.5 | 13.5 |
| Binder resin b-8 | Polytetramethylene glycol | 2,000 | −69 | 13 | 74 | 13 |
| Binder resin b-9 | Desmophen 1200 | 1,000 | −50 | 10 | 76.5 | 13.5 |
| Binder resin b-10 | Polyester initiator 5 | 3,900 | −8 | 30 | 59.5 | 10.5 |
| Binder resin b-11 | Lauryl alcohol | 186 | — | 1.3 | 83.9 | 14.8 |

Production Example 24

(Production of Resin a-1)

In an autoclave, a mixture composed of 1,578 parts of terephthalic acid, 83 parts of isophthalic acid, 374 parts of ethylene glycol and 730 parts of neopentyl glycol was heated at 260° C. for 2.5 hours and subjected to esterification reaction. Subsequently, 0.262 parts of germanium dioxide as a catalyst was added, the temperature of the system was increased to 280° C. in 30 minutes, and the pressure of the system was gradually lowered such that it became 0.1 Torr (13.3 Pa) after 1 hour. Under these conditions, the polycondensation reaction was further continued. After 1.5 hours, the pressure of the system was changed to normal pressure using nitrogen gas, the temperature of the system was lowered, and when it became 260° C., 50 parts of isophthalic acid and 38 parts of trimellitic anhydride was added. The ingredients were stirred at 255° C. for 30 minutes and then taken out in the form of a sheet, and subsequently the sheet was cooled to room temperature, then pulverized with a crusher, and sieved so as to obtain a polyester resin [Resin a-1] corresponding to a sieve mesh size of 1 mm to 6 mm. Analysis results of [Resin a-1] are shown in Table 4.

Production Examples 25 and 26

(Production of Resin a-2 and Resin a-3)

[Resin a-2] and [Resin a-3] were obtained as polyester resins of Examples 25 and 26 in the same manner as in Production Example 24 except that the proportion of the alcohol components and the acid components was changed as shown in Table 4. Analysis results of each resin are shown in Table 4.

TABLE 4

| | Acid component | | | | | Aocohol component | | Property | | | |
|---|---|---|---|---|---|---|---|---|---|---|---|
| | | | | | | | | | Weight | | Glass |
| Resin a | Terephthalic acid (mol) | Isophthalic acid (mol) | Trimellitic acid (mol) | Phthalic acid (mol) | Adipic acid (mol) | Ethylene glycol (mol) | Neopentyl glycol (mol) | Acid value (mgKOH/g) | average molecular weight | Relative viscosity | Transition Temperature (° C.) |
| Resin a-1 | 95.1 | 8 | 2 | 0 | 0 | 44.3 | 55.7 | 30.3 | 10,000 | 1.29 | 69 |
| Resin a-2 | 67.8 | 32.9 | 21 | 0 | 0 | 39.8 | 60.2 | 22.3 | 14,000 | 1.31 | 63 |
| Resin a-3 | 60.1 | 15.9 | 0 | 1.5 | 24.8 | 44.4 | 55.7 | 9.2 | 19,000 | 1.36 | 51 |

Production Example 27

(Preparation of Fine Particle Dispersion Liquid W-1)

Into a 2 glass container with a jacket, the following were poured: 200 parts of [Resin a-1]; 35 parts of ethylene glycol mono-n-butyl ether; 459 parts of a polyvinyl alcohol ("UNITIKA POVAL" 050G, manufactured by UNITIKA LTD.); 0.5% by mass aqueous solution (hereinafter referred to as "PVA-1"); and an amount of N,N-dimethylethanolamine (hereinafter referred to also as "DMEA") equivalent to 1.2 times the amount of all carboxyl groups contained in the polyester resin. When these ingredients were stirred in an open system at 6,000 rpm using desktop HOMO DISPER (T.K. ROBOMIX, manufactured by Primix Corp.), it was confirmed that matter in the form of resin particles did not settle at the bottom of the container but was in a completely suspended state. This state was maintained, and 10 minutes after, hot water was passed into the jacket to carry out heating. When the temperature in the container reached 68° C., the rotational speed at which the stirring was carried out was changed to 7,000 rpm. The temperature in the container was kept in the range of 68° C. to 70° C. and the stirring was carried out for a further 20 minutes to thereby obtain a uniform aqueous dispersion which was milky white in color. Then cold water was passed into the jacket, with stirring carried out at 3,500 rpm, to cool the aqueous dispersion to room temperature, the aqueous dispersion was filtered using a stainless steel filter (635 mesh, plain weave). As a result, almost no resin particles were left on the filter. Analysis results of the obtained filtrate [fine particle dispersion liquid W-1] are shown in Table 5.

Production Examples 28 and 29

(Preparation of Fine Particle Dispersion Liquid W-2 and Fine Particle Dispersion Liquid W-3)

[Fine particle dispersion liquid W-2] and [Fine particle dispersion liquid W-3] were obtained as fine particle dispersion liquids of Production Examples 28 and 29 in the same manner as in Production Example 27 except that the type of Resin a and the composition of the dispersion liquid were changed as shown in Table 5.

TABLE 5

| | Dispersion liquid component | | | | | | Property | |
|---|---|---|---|---|---|---|---|---|
| | Resin a | | N,N-dimethyl ethanol amine | Triethylamine | Ethyleneglycol mono-n-butyl ether | PVA-1 | Solid | Volume average particle |
| | Type | Parts | (eq./—COOH) | (eq./—COOH) | (parts) | (parts) | content (%) | diameter (μm) |
| Fine Particle Dispersion Liquid W-1 | Resin a-1 | 200 | 1.2 | 0 | 35 | 459 | 30.0 | 0.12 |
| Fine Particle Dispersion Liquid W-2 | Resin a-2 | 200 | 0 | 1.2 | 37 | 460 | 29.8 | 0.13 |
| Fine Particle Dispersion Liquid W-3 | Resin a-3 | 200 | 1.3 | 0 | 45 | 470 | 29.0 | 0.11 |

Production Example 30

(Production of Fine Particle Dispersion Liquid W-4)

In a reaction container equipped with a stirring rod and a thermometer, 600 parts of water, 120 parts of styrene, 100 parts of methacrylic acid, 45 parts of butyl acrylate, 10 parts of sodium salt of alkyl allyl sulfosuccinic acid (ELEMINOL JS-2, manufactured by Sanyo Chemical Industries, Ltd.), and 1 part of ammonium persulfate were placed, and then stirred at a rotational speed of 400 rpm for 20 minutes. Thus, a white emulsion was obtained. This emulsion was heated until the temperature in the system reached 75° C., and subjected to reaction for 6 hours. Further, 30 parts of 1% ammonium persulfate aqueous solution was added, then the mixture was aged at 75° C. for 6 hours, to thereby prepare [fine particle dispersion liquid W-4] which is an aqueous dispersion liquid of a vinyl resin (i.e., a copolymer of styrene-methacrylic acid-butyl methacrylate-alkylallylsulfosuccinic acid sodium salt). The [fine particle dispersion liquid W-4] was found to have a volume average particle diameter of 0.08 μm as measured with ELS-800 (product of OTSUKA ELECTRIC CO., LTD.). Part of the [fine particle dispersion liquid W-4] was dried to isolate resin, and the isolated resin was measured with a flow tester for glass transition temperature which was found to be 74° C.

Example 1

Production of Toner 1

—Preparation of Aqueous Dispersion Liquid of Resin Particles W (Fine Particle Dispersion Liquid W)—

In a reaction container equipped with a stirring rod and a thermometer, 600 parts of water, 120 parts of styrene, 100 parts of methacrylic acid, 45 parts of butyl acrylate, 10 parts of sodium salt of alkyl allyl sulfosuccinic acid (ELEMINOL JS-2, manufactured by Sanyo Chemical Industries, Ltd.), and 1 part of ammonium persulfate were placed, and then stirred at a rotational speed of 400 rpm for 20 minutes. Thus, a white emulsion was obtained. This emulsion was heated until the temperature in the system reached 75° C., and subjected to reaction for 6 hours.

Further, 30 parts of 1% by mass ammonium persulfate aqueous solution was added, then the mixture was aged at 75° C. for 6 hours, to thereby prepare [fine particle dispersion liquid W] which is an aqueous dispersion liquid of a vinyl resin (i.e., a copolymer of styrene-methacrylic acid-butyl methacrylate-alkylallylsulfosuccinic acid sodium salt).

The [fine particle dispersion liquid W] was found to have a volume average particle diameter of 0.08 μm as measured with ELS-800 (product of OTSUKA ELECTRIC CO., LTD.).

Part of the [fine particle dispersion liquid W] was dried to isolate resin, and the isolated resin was measured with a flow tester for glass transition temperature which was found to be 74° C.

—Preparation of Aqueous Medium—

Three hundred parts of ion-exchange water, 300 parts of the [fine particle dispersion liquid W] and 0.2 parts of sodium dodecybenzenesulfonate were mixed and stirred to be homogeneously dissolved, to thereby prepare an aqueous medium.

—Preparation of Masterbatch—

Using a Henschel mixer (manufactured by Mitsui Mining Co., Ltd.), 1,000 parts of water, 530 parts of Carbon black (PRINTEX 35, manufactured by Evonik Degussa Japan Co., Ltd.) (DBP oil absorption: 42 mL/100 g, pH: 9.5), and 1,200 parts of [Binder resin 1] were mixed.

The obtained mixture was kneaded at 150° C. for 30 minutes using a double roll mill, then subjected to rolling and cooling, and pulverized using a pulverizer (manufactured by Hosokawa Micron Corporation) so as to produce a masterbatch.

—Production of Toner 1—

One hundred parts of [Binder resin 1] and 100 parts of ethyl acetate were poured into a reaction container and stirred to thereby prepare a resin solution 1.

Next, 5 parts of carnauba wax (weight average molecular weight: 1,800, acid value: 2.7 mgKOH/g, penetration: 1.7 mm (at 40° C.)) and 5 parts of the masterbatch were placed in the resin solution 1. The mixture was passed three times through ULTRA VISCO MILL (manufactured by AIMEX Corporation) as a bead mill under the following conditions: the solution-sending speed was 1 kg/h, the disc circumferential speed was 6 m/sec, and zirconia beads (0.5 mm in particle diameter) were supplied so as to occupy 80% by volume. In this manner, a toner material liquid was obtained.

Next, 150 parts of the aqueous medium was poured into a container. While stirring the aqueous medium at 12,000 rpm using T.K. HOMO MIXER (manufactured by Primix Corp.), 100 parts of the toner material liquid was added and mixed for 10 minutes so as to obtain an emulsified slurry.

Further, 100 parts of the emulsified slurry was placed in an egg-plant shaped flask equipped with a stirrer and a thermometer. While stirring the emulsified slurry at a stirring circumferential speed of 20 m/min, solvent removal was carried out at 30° C. for 10 hours so as to obtain a dispersed slurry.

Next, 100 parts of the dispersed slurry was filtered at reduced pressure, then 100 parts of ion-exchange water was added to the obtained filter cake, and these were mixed at 12,000 rpm for 10 minutes using T.K. HOMO MIXER and then filtered.

Three hundred parts of ion-exchange water was added to the obtained filter cake, these were mixed at 12,000 rpm for 10 minutes using T.K. HOMO MIXER and then filtered twice. Twenty parts of 10% by mass sodium hydroxide aqueous solution was added to the obtained filter cake, these were mixed at 12,000 rpm for 30 minutes using T.K. HOMO MIXER and then filtered at reduced pressure. Three hundred parts of ion-exchange water was added to the obtained filter cake, these were mixed at 12,000 rpm for 10 minutes using T.K. HOMO MIXER and then filtered. Three hundred parts of ion-exchange water was added to the obtained filter cake, these were mixed at 12,000 rpm for 10 minutes using T.K. HOMO MIXER and then filtered twice. Twenty parts of 10% by mass hydrochloric acid was added to the obtained filter cake, these were mixed at 12,000 rpm for 10 minutes using T.K. HOMO MIXER, then a 5% by mass solution of FTERGENT F-310 (manufactured by NEOS COMPANY LIMITED) in methanol as a fluorine quaternary ammonium salt compound was added to the mixture such that the amount of the fluorine quaternary ammonium salt was 0.1 parts with respect to 100 parts of the solid content of a toner. Stirring was carried out for 10 minutes, and then the mixture was filtered. Three hundred parts of ion-exchange water was added to the obtained filter cake, these were mixed at 12,000 rpm for 10 minutes using T.K. HOMO MIXER and then filtered twice, and a filter cake was thus obtained.

The obtained filter cake was dried at 40° C. for 36 hours using a circulation wind dryer and then sieved with a mesh whose sieve mesh size was 75 μm, and toner base particles 1 was thus produced. Next, 1.5 parts of hydrophobic silica (TS720, product of Cabot Corporation) was added to 100 parts of the toner base particles 1, and the resultant mixture was blended with a Henschel mixer at 3,000 rpm for 5 min to thereby obtain toner 1.

Examples 2 to 8

Production of Toners 2 to 8

Toners 2 to 8 of Examples 2 to 8 were produced in the same manner as in Example 1 except that the resin used was changed to [Binder resins 2 to 8] respectively.

Comparative Examples 1 to 4

Toners a to d of Comparative Examples 1 to 4 were produced in the same manner as in Example 1 except that the resin used was changed to [Binder resins 9 to 12] respectively.

Example 9

Production of Toner 9

—Preparation of Aqueous Medium—

Three hundred parts of ion-exchange water, 300 parts of the [fine particle dispersion liquid W-1] and 0.2 parts of sodium dodecylbenzenesulfonate were mixed and stirred to be homogeneously dissolved, to thereby prepare an [aqueous medium phase 1].

—Preparation of Masterbatch—

Using a Henschel mixer (manufactured by Mitsui Mining Co., Ltd.), 1,000 parts of water, 530 parts of Carbon black (PRINTEX 35, manufactured by Evonik Degussa Japan Co., Ltd.) (DBP oil absorption: 42 mL/100 g, pH: 9.5), and 1,200 parts of [Binder resin b-1] serving as the binder resin (b) were mixed.

The obtained mixture was kneaded at 150° C. for 30 minutes using a double roll mill, then subjected to rolling and cooling, and pulverized using a pulverizer (manufactured by Hosokawa Micron Corporation) so as to produce a masterbatch.

—Production of Toner 9—

One hundred parts of [Binder resin b-1] and 100 parts of ethyl acetate were poured into a reaction container, resin solution 1 was prepared.

Next, 5 parts of carnauba wax (molecular weight: 1,800, acid value: 2.7 mgKOH/g, penetration: 1.7 mm (at 40° C.)) and 5 parts of the masterbatch were placed in the resin solution 1. The mixture was passed three times through ULTRA VISCO MILL (manufactured by AIMEX Corporation) as a bead mill under the following conditions: the solution-sending speed was 1 kg/h, the disc circumferential speed was 6 m/sec, and zirconia beads (0.5 mm in particle diameter) were supplied so as to occupy 80% by volume. In this manner, a toner material liquid was obtained.

Next, 150 parts of [Aqueous medium phase 1] was poured into a container. While stirring the aqueous medium at 12,000 rpm using T.K. HOMO MIXER (manufactured by Primix Corp.), 100 parts of the toner material liquid was added and mixed for 10 minutes so as to obtain an emulsified slurry.

Further, 100 parts of the emulsified slurry b was placed in a flask equipped with a stirrer and a thermometer. While stirring the emulsified slurry at a stirring circumferential speed of 20 m/min, solvent removal was carried out at 30° C. for 10 hours so as to obtain a dispersed slurry b.

Next, 100 parts of the dispersed slurry b was filtered at reduced pressure, then 100 parts of ion-exchange water was added to the obtained filter cake, and these were mixed at 12,000 rpm for 10 minutes using T.K. HOMO MIXER and then filtered.

Three hundred parts of ion-exchange water was added to the obtained filter cake, these were mixed at 12,000 rpm for 10 minutes using T.K. HOMO MIXER and then filtered twice. Twenty parts of 10% by mass sodium hydroxide aqueous solution was added to the obtained filter cake, these were mixed at 12,000 rpm for 30 minutes using T.K. HOMO MIXER and then filtered at reduced pressure. Three hundred parts of ion-exchange water was added to the obtained filter cake, these were mixed at 12,000 rpm for 10 minutes using T.K. HOMO MIXER and then filtered. Three hundred parts of ion-exchange water was added to the obtained filter cake, these were mixed at 12,000 rpm for 10 minutes using T.K. HOMO MIXER and then filtered twice. Twenty parts of 10% by mass hydrochloric acid was added to the obtained filter cake, these were mixed at 12,000 rpm for 10 minutes using T.K. HOMO MIXER, then a 5% by mass solution of FTERGENT F-310 (manufactured by NEOS COMPANY LIMITED) in methanol as a fluorine quaternary ammonium salt compound was added in a 5% by mass methanol solution to the mixture such that the amount of the fluorine quaternary ammonium salt was 0.1 parts with respect to 100 parts of the solid content of a toner. Stirring was carried out for 10 minutes, and then the mixture was filtered. Three hundred parts of ion-exchange water was added to the obtained filter cake, these were mixed at 12,000 rpm for 10 minutes using T.K. HOMO MIXER and then filtered twice, and a filter cake was thus obtained.

The obtained filter cake was dried at 40° C. for 36 hours using a circulation wind dryer and then sieved with a mesh whose sieve mesh size was 75 and toner base particles 1 was thus produced. Next, 1.5 parts of hydrophobic silica (TS720, product of Cabot Corporation) was added to 100 parts of the toner base particles 1, and the resultant mixture was blended with a Henschel mixer at 3,000 rpm for 5 min to thereby obtain [toner 9].

Examples 10 to 16

—Production of Toners 10 to 16—

[Toner 10] to [Toner 16] of Examples 10 to 16 were produced in the same manner as in Example 9 except that the type of the binder resin (b) used and the type of the [fine particle dispersion liquid W] used were respectively changed as shown in Table 7-1.

Comparative Examples 5 to 7

—Production of Toners e to g—

[Toner e] to [Toner g] of Comparative Examples 5 to 7 were produced in the same manner as in Example 1 except that the type of the binder resin (b) used and the type of the [fine particle dispersion liquid W] used were respectively changed as shown in Table 7-1.

—Production of Carrier—

100 parts of a silicone resin (SR2411, manufactured by Dow Corning Toray Co., Ltd.), 5 parts of γ-(2-aminoethyl) aminopropyl trimethoxysilane, and 10 parts of carbon black were added to 100 parts of toluene. The mixture was dispersed by a homo mixer for 20 minutes to prepare a coating layer forming liquid. Then, 1,000 parts of spherical magnetite having a volume average particle diameter of 50 μm were coated with the coating layer forming liquid using a fluidized bed type coating apparatus to produce a magnetic carrier.

—Production of Developer—

5 parts of each of the toner of Examples 1 to 16 and Comparative Examples 1 to 7, and 95 parts of the carrier were ball mill mixed to produce two-component developers of Examples 1 to 16 and Comparative Examples 1 to 7, respectively.

With respect to the obtained developers of Examples 1 to 8 and Comparative Examples 1 to 4, (a) image density, (b) heat resistance storage stability, and (c) fixability, (d) toner filming, (e) background smear and (f) toner scattering were measured in the manner as described below. The results are shown in Table 6-2.

Also, the obtained developers of Examples 9 to 16, Example 1 and Comparative Examples 5 to 7 were measured for (g) haze and (h) environmental stability in addition to the above (a) to (f). The results are shown in Table 7-2.

(a) Image Density

A solid image with the deposited developer amount of 1.00±0.05 mg/cm$^2$ was formed on copy sheets (Type 6000 <70W>, manufactured by Ricoh Company, Ltd.) using a tandem color electrophotographic apparatus (IMAGIO NEO 450, manufactured by Ricoh Company, Ltd.) at a surface temperature of a fixing roller of 160±2° C. The image densities of 6 randomly chosen points in the obtained solid image were measured using a spectrometer (938 SPECTRODENSITOMETER, manufactured by X-Rite Co., Ltd.) followed by evaluation based on the following evaluation criteria. Note that the image density value was obtained by averaging the measured values at the six points.

[Evaluation Criteria]

A: 2.0 or more

B: 1.70 or more but less than 2.0

C: less than 1.70

(b) Heat Resistance Storage Stability (Penetration)

The penetration (mm) was measured by filling each toner into a 50 mL glass container, leaving the glass container filled with the toner in a thermostat bath of 50° C. for 24 hours, cooling the toner to 24° C., and then carrying out a penetration test (JIS K2235-1991) thereto. The "penetration" in the present invention refers to a penetrated depth in mm. Note that, the higher the penetration is, the more the excellent heat resistance storage stability the toner has. In the case where the penetration is less than 5 mm, a problem is likely to occur.

[Evaluation Criteria]

A: 25 mm or more

B: 15 mm or more but less than 25 mm

C: 5 mm or more but less than 15 mm

D: less than 5 mm (c) Fixability

Using a modified image forming apparatus (Copier MF-200 manufactured by Ricoh Company, Ltd.) in which the fixing section was modified by changing a fixing roller to a TEFLON (Trademark) roller, solid toner images with the deposited toner amount of 0.85±0.1 mg/cm$^2$ were produced on sheets of a plain paper (TYPE 6200, manufactured by Ricoh Company, Ltd.) and a thick transfer paper (COPY PAPER <135>, manufactured by Ricoh Business Expert Ltd.), while changing the temperature of a fixing belt. The highest fixing temperature used herein is the highest temperature of the fixing belt at which hot offset does not occur in the plain paper. Further, the lowest fixing temperature was measured using the thick transfer paper. The lowest fixing temperature used herein is the temperature of the fixing belt at which the residual rate of the image density was 70% or more after the obtained fixed image was rubbed with a pad.

[Evaluation Criteria]

—Highest Fixing Temperature—

A: 190° C. or more

B: 180° C. or more but less than 190° C.

C: 170° C. or more but less than 180° C.

D: less than 170° C.

—Lowest Fixing Temperature—

A: less than 135° C.

B: 135° C. or more but less than 145° C.

C: 145° C. or more but less than 155° C.

D: 155° C. or more (d) Toner Filming

In a tandem color image forming apparatus (IMAGIO NEO450, product of Ricoh Company, Ltd.), each of the produced developers was used to print on 200,000 sheets a chart having 20% image area, while the concentration of the toner was controlled so that the image density was 1.4±0.2. Thereafter, according to the following evaluation criteria, the toner filming was evaluated based on a change in charge amount (μc/g) of the electrophotographic developer (i.e., a decrease in charge amount after the running of 200,000 sheets/charge amount of before running). Notably, the charge amount was measured by the blow-off method.

[Evaluation Criteria]

A: less than 15%

B: 15% or more but less than 30%

C: 30% or more but less than 50%

D: 50% or more

Filming of the toner on the electrophotographic carrier causes a change in composition of the uppermost surface of the electrophotographic carrier, and as a result the developer decreases in charge amount. It is judged that the less the change in charge amount before and after the running, the less the extent of filming of the toner on the electrophotographic carrier.

(e) Background Smear

In a tandem color image forming apparatus (IMAGIO NEO450, product of Ricoh Company, Ltd.), each of the produced developers was used to continuously print 200,000 sheets a chart having 5% image area. Thereafter, the extent of background smear of the image was visually observed and evaluated according to the following evaluation criteria.

[Evaluation Criteria]

A: No background smear was observed in the image.

B: Slight background smear was observed in the image, which however was not practically problematic.

C: Background smear was observed in the image, which was practically problematic.

(f) Toner Scattering

In a tandem color image forming apparatus (IMAGIO NEO450, product of Ricoh Company, Ltd.), each of the produced developers was used to continuously print 200,000 sheets a chart having 5% image area. Thereafter, the extent of contamination by the toner in the apparatus was visually observed and evaluated according to the following 4-rank evaluation criteria.

[Evaluation Criteria]

A: There was completely no contamination by the toner in the image forming apparatus, which was in an excellent state.

B: There was no contamination by the toner in the image forming apparatus, which was in a good state.

C: There was contamination by the toner in the image forming apparatus, which was however a practically applicable level.

D: There was severe contamination by the toner in the image forming apparatus, which was a practically inapplicable level.

(g) Haze

A single-color image sample as an image sample used for evaluating fixability was developed on TYPE PPC-DX (manufactured by Ricoh Company, Ltd.) as an OHP sheet, with the temperature of a fixing belt set at 160° C. The haze of the sample on the sheet was measured using a direct-reading haze computer (HGM-2DP, manufactured by Suga Test Instruments Co., Ltd.). The haze is a measure showing the transparency of the toner. The lower this value is, the higher the transparency is, and the better color-generating properties are when an OHP sheet is used.

[Evaluation Criteria]

A: The haze was less than 20%.

B: The haze was 20% or higher but less than 30%.

C: The haze was 30% or more.

(h) Environmental Stability

In an environment in which the temperature was 23° C. and the relative humidity (RH) was 50% (M/M environment), each developer was stirred for 5 minutes using a ball mill. Thereafter, 1.0 g of the developer was taken out and subjected to a nitrogen blow treatment for 1 minute using a blow-off charge amount measuring apparatus (TB-200, manufactured by KYOCERA Chemical Corporation), then the charge amount of the developer was measured, and the obtained charge amount was employed as the charge amount. Also, this measurement was carried out in two conditions, i.e. an environment in which the temperature was 40° C. and the relative humidity (RH) was 90% (H/H environment) and an environment in which the temperature was 10° C. and the humidity was 30% (L/L environment), and the charge amount of each developer was thus evaluated in the two conditions. The rate of variability depending upon environment was calculated by means of the following equation. The lower the rate of variability depending upon environment is, the more stable chargeability the developer has.

[Evaluation Criteria]

A: The rate of variability depending upon environment was less than 10%.

B: The rate of variability depending upon environment was 10% or higher but less than 30%.

C: The rate of variability depending upon environment was 30% or higher but less than 50%.

D: The rate of variability depending upon environment was 50% or more.

TABLE 6-1

| | Toner No. | Binder resin No. | Mn of Binder resin | Mw of Binder resin | Tg (° C.) | Average of maximum Feret Diameter (nm) | Calculated value* |
|---|---|---|---|---|---|---|---|
| Ex. 1 | Toner 1 | 1 | 13,000 | 27,000 | 40 | 35 | 4.4 |
| Ex. 2 | Toner 2 | 2 | 16,000 | 30,000 | 36 | 42 | 4.0 |
| Ex. 3 | Toner 3 | 3 | 25,000 | 43,000 | 46 | 33 | 3.2 |
| Ex. 4 | Toner 4 | 4 | 16,000 | 30,000 | 33 | 20 | −0.95 |
| Ex. 5 | Toner 5 | 5 | 11,000 | 29,000 | 41 | 40 | 4.6 |
| Ex. 6 | Toner 6 | 6 | 14,000 | 31,000 | 42 | 45 | 6.2 |
| Ex. 7 | Toner 7 | 7 | 19,000 | 34,000 | 37 | 12 | −3.0 |
| Ex. 8 | Toner 8 | 8 | 17,000 | 27,000 | 36 | 28 | 1.6 |
| Com. Ex. 1 | Toner a | 9 | 10,000 | 22,000 | 42 | Not confirmed | 2.0 |
| Com. Ex. 2 | Toner b | 10 | 16,000 | 35,000 | 6/40 | 50 | — |
| Com. Ex. 3 | Toner c | 11 | 12,000 | 29,000 | 45 | Not confirmed | −4.67 |
| Com. Ex. 4 | Toner d | 12 | 12,000 | 25,000 | 50 | Not confirmed | — |

Calculated value*: Tg − (TgA × MA/(MA + MB) + TgB × MB/(MA + MB)

TABLE 6-2

| | Image Density | Heat resistance storage stability | Lowest fixing temperature | Highest fixing temperature | Toner Filming | Background Smear | Toner Scattering |
|---|---|---|---|---|---|---|---|
| Ex. 1 | A | A | A | A | A | A | A |
| Ex. 2 | A | B | A | B | B | B | A |
| Ex. 3 | A | A | B | A | A | A | A |
| Ex. 4 | A | A | A | A | A | B | B |
| Ex. 5 | A | A | A | A | B | A | B |
| Ex. 6 | A | A | A | A | B | B | C |
| Ex. 7 | A | A | B | B | A | A | A |
| Ex. 8 | A | A | A | B | A | A | A |
| Com. Ex. 1 | B | B | B | B | C | C | C |
| Com. Ex. 2 | A | A | A | A | D | C | C |
| Com. Ex. 3 | A | A | A | A | D | C | C |
| Com. Ex. 4 | C | D | D | C | D | C | D |

35

TABLE 7-1

| | Toner No. | Fine Particle Dispersion Liquid No. | Binder resin (b) No. | Mw of Binder resin (b) | Mn of Binder resin (b) | Tg (° C.) | Average of maximum Feret Diameter (nm) | Calculated value* |
|---|---|---|---|---|---|---|---|---|
| Ex. 9 | Toner 9 | W-1 | b-1 | 14,000 | 27,000 | 39 | 35 | 3.8 |
| Ex. 10 | Toner 10 | W-2 | b-2 | 17,000 | 32,000 | 33 | 42 | 1.5 |
| Ex. 11 | Toner 11 | W-3 | b-3 | 26,000 | 43,000 | 45 | 33 | 2.4 |
| Ex. 12 | Toner 12 | W-1 | b-4 | 16,000 | 29,000 | 34 | 20 | 0.2 |
| Ex. 13 | Toner 13 | W-1 | b-5 | 12,000 | 29,000 | 41 | 40 | 4.6 |
| Ex. 14 | Toner 14 | W-1 | b-6 | 14,000 | 30,000 | 42 | 45 | 6 |
| Ex. 15 | Toner 15 | W-1 | b-7 | 17,000 | 35,000 | 36 | 12 | −3.8 |
| Ex. 16 | Toner 16 | W-1 | b-8 | 16,000 | 26,000 | 35 | 28 | 0.47 |
| Ex. 1 | Toner 1 | W | 1 | 13,000 | 27,000 | 40 | 35 | 4.4 |
| Com. Ex. 5 | Toner e | W-1 | b-9 | 11,000 | 22,000 | 41 | Not confirmed | 1 |
| Com. Ex. 6 | Toner f | W-1 | b-10 | 16,000 | 34,000 | 7/42 | 50 | — |
| Com. Ex. 7 | Toner g | W-1 | b-11 | 14,000 | 27,000 | 55 | Not confirmed | — |

Calculated value*: Tg − (TgA × MA/(MA + MB) + TgB × MB/(MA + MB)

TABLE 7-2

| | Image Density | Heat resistance storage stability | Lowest fixing temperature | Highest fixing temperature | Toner Filming | Background Smears | Toner Scattering | Haze | Environmental stability |
|---|---|---|---|---|---|---|---|---|---|
| Ex. 9 | A | A | A | A | A | A | A | A | A |
| Ex. 10 | A | B | A | B | B | B | A | A | A |
| Ex. 11 | A | A | B | A | A | A | A | A | A |
| Ex. 12 | A | A | A | A | A | B | B | B | B |
| Ex. 13 | A | A | A | A | B | A | B | B | B |
| Ex. 14 | A | A | B | A | B | B | C | B | B |

TABLE 7-2-continued

| | Image Density | Heat resistance storage stability | Lowest fixing temperature | Highest fixing temperature | Toner Filming | Background Smears | Toner Scattering | Haze | Environmental stability |
|---|---|---|---|---|---|---|---|---|---|
| Ex. 15 | A | A | B | B | A | A | A | A | A |
| Ex. 16 | A | A | B | B | A | A | A | B | A |
| Ex. 1 | A | A | A | A | A | A | A | D | C |
| Com. Ex. 5 | B | B | C | B | C | C | C | D | C |
| Com. Ex. 6 | A | A | D | A | D | C | C | D | D |
| Com. Ex. 7 | C | D | D | C | D | C | D | D | D |

As shown in Tables 6-1 and 6-2, the electrophotographic toners of Examples 1 to 8 were found to be excellent in fixability, storageability, and resistance to stress applied during long-term stirring in the developing device. In addition, they were hard to cause background smear and toner scattering. The toner of Comparative Example 1 was broken in the developing device to cause filming. A possible reason for this is that the binder resin of this toner has a structure where the skeleton B (i.e., the low-Tg unit) and the polylactic acid skeleton are almost homogenuously present; i.e., an image having phase differences cannot be observed with AFM. The toner of Comparative Example 2 was found to have two different glass transition temperatures and also the average of the maximum Feret diameters with AFM was large. The toner formed using such a binder resin was good in fixability but was severe in filming, background smear and scattering. In the toner of Comparative Example 3, the glass transition temperature of the skeleton B serving as the initiator is close to that of the polylactic acid skeleton, and the phase differences reflecting hardness were not be observed with AFM. The toner formed using such a binder resin is insufficient in stress relaxation, and the toner is broken to cause severe background smear and scattering. The toner of Comparative Example 4, which was formed using the binder resin containing the polylactic acid resin almost homogeneously, was not found to exhibit satisfactory results in fixability, heat resistance storage stability, and stress resistance in the developing device.

As shown in Tables 7-1 and 7-2, the electrophotographic toner of Examples 9 to 16 were found to be excellent in fixability, storageability, and resistance to stress applied during long-term stirring in the developing device. In addition, they were hard to cause background smear and toner scattering. The toner of Comparative Example 5 was broken in the developing device to cause filming. A possible reason for this is that the binder resin of this toner has a structure where the skeleton B (i.e., the low-Tg unit) and the polylactic acid (PLA) skeleton are almost homogenuously present; i.e., an image having phase differences cannot be observed with AFM. The toner of Comparative Example 6 was found to have two different glass transition temperatures and also the average of the maximum Feret diameters with tapping-mode AFM was large. The toner formed using such a binder resin was good in fixability but was severe in filming, background smear and scattering. The toner of Comparative Example 7, which was formed using the binder resin containing the PLA resin almost homogeneously, was not found to exhibit satisfactory results in fixability, heat resistance storage stability, and stress resistance in the developing device.

Compared to the toner of Example 1, the toner of Example 9 has a structure where resin particles (A) each containing resin (a) are attached onto the surface of resin particles (B) each containing binder resin (b); or a structure where a coating film (P) containing resin (a) is formed on the surface of resin particles (B); or combination thereof. With this structure, the toner was found to be excellent in haze and environmental stability.

Aspects of the present invention are as follows, for example.

<1> An electrophotographic toner including:

a binder resin, wherein the binder resin has one glass transition temperature Tg and the glass transition temperature Tg of the binder resin is within 25° C. to 65° C. as measured in second heating with a differential scanning calorimeter at a heating rate of 5° C./min, and wherein a binarized image of a phase image of the binder resin contains first phase difference regions each formed of first pixels and a second phase difference region formed of second pixels such that the first phase difference regions are dispersed in the second phase difference region, where the binarized image of the phase image of the binder resin is obtained through a process containing: measuring the binder resin with an atomic force microscope (AFM) of tapping mode to obtain phase differences at locations of the binder resin; converting the phase differences to image densities of pixels so that the locations having smaller phase differences are dark colored and the locations having greater phase differences are light colored; mapping the locations to obtain the phase image; and subjecting the phase image to binarization using, as a threshold, an intermediate value between a maximum value and a minimum value of the image densities so that the image densities of the first pixels are equal to or more than the minimum value but less than the intermediate value and the image densities of the second pixels are equal to or more than the intermediate value but equal to or less than the maximum value.

<2> The electrophotographic toner according to <1>, wherein when the binder resin is expressed by binder resin (b), the electrophotographic toner has a structure where resin particles (A) each containing resin (a) are attached onto surface of resin particles (B) each containing binder resin (b); or a structure where a coating film (P) containing resin (a) is formed on a surface of resin particles (B) each containing binder resin (b); or combination thereof, where the resin (a) is a polyester resin formed from polycarboxylic acid and polyol.

<3> The electrophotographic toner according to <1> or <2>, wherein an average of maximum Feret diameters of the first phase difference regions in the binarized image is 10 nm or more but less than 45 nm.

<4> The electrophotographic toner according to any one of <1> to <3>, wherein the binder resin is a block copolymer containing: at least polyester skeleton A containing in a repeating structure a constituent unit formed through dehydration condensation of hydroxycarboxylic acid; and skeleton B not containing in a repeating structure a constituent unit formed through dehydration condensation of hydroxycarboxylic acid, and wherein the binder resin satisfies the following relationship:

$$-5 \leq Tg-(TgA \times MA/(MA+MB)+TgB \times MB/(MA+MB)) \leq 5$$

where TgA denotes a glass transition temperature of the polyester skeleton A, TgB denotes a glass transition temperature of the skeleton B, MA denotes a mass ratio of the polyester skeleton A, and MB denotes a mass ratio of the skeleton B.

<5> The electrophotographic toner according to <4>, wherein the skeleton B is a polyester skeleton having a branched structure.

<6> The electrophotographic toner according to <5>, wherein the polyester skeleton contains a polycarboxylic acid component as a constituent component, and the polycarboxylic acid component contains a trivalent or higher polycarboxylic acid in an amount of 1.5 mol % or more.

<7> The electrophotographic toner according to any one of <4> to <6>, wherein the polyester skeleton A is a ring-opening polymer of a mixture of L-lactide and D-lactide.

<8> The electrophotographic toner according to any one of <4> to <7>, wherein the skeleton B is contained in the binder resin in an amount of 5% by mass to 25% by mass.

<9> The electrophotographic toner according to any one of <4> to <8>, wherein the skeleton B in the binder resin has a number average molecular weight Mn (B) of 1,000 or higher but lower than 3,000.

<10> The electrophotographic toner according to any one of <1> to <9>, wherein the binder resin has a number average molecular weight Mn of 20,000 or lower.

<11> A developer including:

the electrophotographic toner according to any one of <1> to <10>.

<12> An image forming apparatus including:

a latent electrostatic image bearing member;

a charging unit configured to charge a surface of the latent electrostatic image bearing member;

an exposing unit configured to expose the charged surface of the the latent electrostatic image bearing member to light to thereby form a latent electrostatic image;

a developing unit configured to develop the latent electrostatic image with a developer to thereby form a visible image;

a transferring unit configured to transfer the visible image onto a recording medium; and a fixing unit configured to fix the transferred visible image on the recording medium, wherein the developer is the developer according to <11>.

REFERENCE SIGNS LIST

10 Photoconductor (photoconductor drum)
10K Latent electrostatic image bearing member for black
10Y Latent electrostatic image bearing member for yellow
10M Latent electrostatic image bearing member for magenta
10C Latent electrostatic image bearing member for cyan
14 Support roller
15 Support roller
16 Support roller
17 Cleaning device 17 for an intermediate transfer member
18 Image-forming unit
20 Charging roller
21 Exposing device
22 Secondary transfer device
23 Roller
24 Secondary transfer belt
25 Fixing device
26 Fixing belt
27 Pressurizing roller
28 Sheet reverser
30 Exposing device
32 Contact glass
33 First carriage
34 Second carriage
35 Image-forming lens
36 Read sensor
40 Developing device
41 Developing belt
42K Developer container
42Y Developer container
42M Developer container
42C Developer container
43K Developer feeding roller
43Y Developer feeding roller
43M Developer feeding roller
43C Developer feeding roller
44K Developing roller
44Y Developing roller
44M Developing roller
44C Developing roller
45K Black developing device
45Y Yellow developing device
45M Magenta developing device
45C Cyan developing device
49 Registration roller
50 Intermediate transfer member
51 Roller
53 Feeder path
55 Switch blade
56 Ejecting roller
57 Output tray
58 Corona charger
60 Cleaning device
61 Developing device
62 Transfer charger
63 Cleaning device for photoconductor
64 Charge-eliminating device
70 Charge-eliminating lamp
80 Transfer roller
90 Cleaning blade
95 Recording medium (paper)
100 Image forming apparatus
101 Latent electrostatic image bearing member
102 Charging unit
103 Exposure
104 Developing unit
105 Recording medium
107 Cleaning unit
108 Transfer unit
120 Tandem developing device
130 Document platen
142 Feeding roller
143 Paper bank
144 Feeder cassette
145 Separation roller
146 Feeder path
147 Transport roller
148 Feeder path
150 Copying machine main body
200 Feeder table
300 Scanner
400 Automatic document feeder (ADF)

The invention claimed is:

1. An electrophotographic toner comprising:

a binder resin, wherein the binder resin has one glass transition temperature Tg and the glass transition temperature Tg of the binder resin is within 25° C. to 65° C. as measured in second heating with a differential scanning calorimeter at a heating rate of 5° C./min, a binarized image of a phase image of the binder resin comprises first phase difference regions each formed of first pixels and a second phase difference region formed of second pixels such that the first phase difference regions are dispersed in the second phase difference region, and the binarized image of the phase image of the binder resin is obtained through a process comprising:

measuring the binder resin with an atomic force microscope of tapping mode to obtain phase differences at locations of the binder resin;

converting the phase differences to image densities of pixels so that locations having smaller phase differences are dark colored and locations having greater phase differences are light colored;

mapping the locations of the binder resin to obtain the phase image; and subjecting the phase image to binarization using, as a threshold, an intermediate value between a maximum value and a minimum value of the image densities so that the image densities of the first pixels are equal to or more than the minimum value but less than the intermediate value and the image densities of the second pixels are equal to or more than the intermediate value but equal to or less than the maximum value.

2. The electrophotographic toner according to claim 1, wherein when the binder resin is expressed by binder resin (b), the electrophotographic toner has a structure where resin particles (A) each comprising resin (a) are attached onto a surface of resin particles (B) each comprising the binder resin (b); or a structure where a coating film (P) comprising the resin (a) is formed on a surface of the resin particles (B) each comprising the binder resin (b); or a combination thereof, and the resin (a) is a polyester resin made from polycarboxylic acid and polyol.

3. The electrophotographic toner according to claim 1, wherein an average of maximum Feret diameters of the first phase difference regions in the binarized image is 10 nm or more but less than 45 nm.

4. The electrophotographic toner according to claim 1, wherein the binder resin is a block copolymer comprising:

a polyester skeleton A comprising in a repeating structure a constituent unit formed through dehydration condensation of hydroxycarboxylic acid; and a skeleton B not comprising in a repeating structure a constituent unit formed through dehydration condensation of hydroxycarboxylic acid, and the binder resin satisfies the following relationship:

$$-5 \leq Tg-(TgA \times MA/(MA+MB)+TgB \times MB/(MA+MB)) \leq 5$$

where TgA denotes a glass transition temperature of the polyester skeleton A, TgB denotes a glass transition temperature of the skeleton B, MA denotes a mass ratio of the polyester skeleton A, and MB denotes a mass ratio of the skeleton B.

5. The electrophotographic toner according to claim 4, wherein the skeleton B is a polyester skeleton having a branched structure.

6. The electrophotographic toner according to claim 5, wherein the polyester skeleton comprises a polycarboxylic acid component, and the polycarboxylic acid component comprises a trivalent or higher polycarboxylic acid in an amount of 1.5 mol % or more.

7. The electrophotographic toner according to claim 4, wherein the polyester skeleton A is a ring-opening polymer of a mixture of L-lactide and D-lactide.

8. The electrophotographic toner according to claim 4, wherein the skeleton B is present in the binder resin in an amount of from 5% by mass to 25% by mass.

9. The electrophotographic toner according to claim 4, wherein the skeleton B in the binder resin has a number average molecular weight Mn of 1,000 or higher but lower than 3,000.

10. The electrophotographic toner according to claim 1, wherein the binder resin has a number average molecular weight Mn of 20,000 or lower.

11. A developer comprising:

an electrophotographic toner, wherein the electrophotographic toner comprises: a binder resin, the binder resin has one glass transition temperature Tg and the glass transition temperature Tg of the binder resin is within 25° C. to 65° C. as measured in second heating with a differential scanning calorimeter at a heating rate of 5° C./min, a binarized image of a phase image of the binder resin comprises first phase difference regions each formed of first pixels and a second phase difference region formed of second pixels such that the first phase difference regions are dispersed in the second phase difference region, and the binarized image of the phase image of the binder resin is obtained through a process comprising:

measuring the binder resin with an atomic force microscope of tapping mode to obtain phase differences at locations of the binder resin;

converting the phase differences to image densities of pixels so that locations having smaller phase differences are dark colored and locations having greater phase differences are light colored;

mapping the locations of the binder resin to obtain the phase image; and subjecting the phase image to binarization using, as a threshold, an intermediate value between a maximum value and a minimum value of the image densities so that the image densities of the first pixels are equal to or more than the minimum value but less than the intermediate value and the image densities of the second pixels are equal to or more than the intermediate value but equal to or less than the maximum value.

12. An image forming method comprising:

charging a surface of a latent electrostatic image bearing member to form a charged surface of the latent electrostatic image bearing member;

exposing the charged surface of the latent electrostatic image bearing member to light to form a latent electrostatic image;

developing the latent electrostatic image with a developer to form a visible image;

transferring the visible image onto a recording medium to form a transferred visible image; and fixing the transferred visible image on the recording medium, wherein the developer comprises: an electrophotographic toner comprising a binder resin, the binder resin has one glass transition temperature Tg and the glass transition temperature Tg of the binder resin is within 25° C. to 65° C. as measured in second heating with a differential scanning calorimeter at a heating rate of 5° C./min, a binarized image of a phase image of the binder resin comprises first phase difference regions each formed of first pixels and a second phase difference region formed of second pixels such that the first phase difference regions are dispersed in the second phase difference region, and the binarized image of the phase image of the binder resin is obtained through a process containing:

measuring the binder resin with an atomic force microscope of tapping mode to obtain phase differences at locations of the binder resin;

converting the phase differences to image densities of pixels so that locations having smaller phase differences are dark colored and locations having greater phase differences are light colored;

mapping the locations of the binder resin to obtain the phase image; and subjecting the phase image to binarization using, as a threshold, an intermediate value between a maximum value and a minimum value of the image densities so that the image densities of the first pixels are equal to or more than the minimum value but less than the intermediate value and the image densities of the second pixels are equal to or more than the intermediate value but equal to or less than the maximum value.

* * * * *